US008268521B2

(12) United States Patent
Nukada et al.

(10) Patent No.: US 8,268,521 B2
(45) Date of Patent: Sep. 18, 2012

(54) ELECTROPHOTOGRAPHIC PHOTORECEPTOR, PROCESS CARTRIDGE, AND IMAGE FORMING APPARATUS

(75) Inventors: Katsumi Nukada, Kanagawa (JP); Hirofumi Nakamura, Kanagawa (JP); Mitsuhide Nakamura, Kanagawa (JP); Koji Bando, Kanagawa (JP); Kenny-tuan T Dinh, Webster, NY (US); Giuseppa Baranyi, Mississauga (CA); Nan-Xing Hu, Mississauga (CA); Michael Zak, Webster, NY (US)

(73) Assignees: Fuji Xerox Co., Ltd., Tokyo (JP); Xerox Corporation, Norwalk, CT (US)

( * ) Notice: Subject to any disclaimer, the term of this patent is extended or adjusted under 35 U.S.C. 154(b) by 516 days.

(21) Appl. No.: 12/466,701

(22) Filed: May 15, 2009

(65) Prior Publication Data

US 2010/0151366 A1 Jun. 17, 2010

(30) Foreign Application Priority Data

Dec. 16, 2008 (JP) ..... 2008-319780

(51) Int. Cl.
*G03G 5/00* (2006.01)
*G03G 15/00* (2006.01)

(52) U.S. Cl. ..... 430/66; 430/58.75; 430/58.85; 430/69; 399/11; 399/159

(58) Field of Classification Search ..... 430/66, 430/69, 58.75, 58.85; 399/111, 159
See application file for complete search history.

(56) References Cited

U.S. PATENT DOCUMENTS 5,283,145 A 2/1994 Nukada et al.
(Continued)

FOREIGN PATENT DOCUMENTS

EP 1174771 * 1/2002
(Continued)

OTHER PUBLICATIONS

Shimada et al., A-15 of the Proceedings of Imaging Conference, The Imaging Society of Japan, 2007.

*Primary Examiner* — Thorl Chea
(74) *Attorney, Agent, or Firm* — Oliff & Berridge, PLC

(57) ABSTRACT

According to an aspect of the invention, an electrophotographic photoreceptor including a conductive substrate and a photosensitive layer provided on a surface of the conductive substrate is provided. In the electrophotographic photoreceptor, an outermost layer of the photosensitive layer containing a crosslinked product formed from at least one charge transporting material having at least one substituent selected from the group consisting of —OH, —$OCH_3$, —$NH_2$, —SH, and —COOH, an acidic substance, and at least one compound selected from the group consisting of compounds represented by the following formula (A) and compounds represented by the following formula (B).

(A)

(B)

9 Claims, 6 Drawing Sheets

U.S. PATENT DOCUMENTS

| | | | | |
|---|---|---|---|---|
| 5,290,928 | A | 3/1994 | Nukada et al. | |
| 5,298,617 | A | 3/1994 | Nukada et al. | |
| 5,302,479 | A | 4/1994 | Daimon et al. | |
| 5,308,728 | A | 5/1994 | Imai et al. | |
| 5,338,636 | A | 8/1994 | Nukada et al. | |
| 5,358,813 | A | 10/1994 | Iijima et al. | |
| 5,368,967 | A | 11/1994 | Schank et al. | |
| 5,378,569 | A | 1/1995 | Nukada et al. | |
| 5,391,447 | A | 2/1995 | Pai et al. | |
| 5,393,629 | A | 2/1995 | Nukada et al. | |
| 5,413,886 | A | 5/1995 | Pai et al. | |
| 5,416,207 | A | 5/1995 | Imai et al. | |
| 5,456,989 | A | 10/1995 | Nogami et al. | |
| 5,459,004 | A | 10/1995 | Katsumi et al. | |
| 5,463,043 | A | 10/1995 | Nukada et al. | |
| 5,639,581 | A | 6/1997 | Iwasaki et al. | |
| 5,654,119 | A | 8/1997 | Ishii et al. | |
| 5,734,003 | A | 3/1998 | Iwasaki et al. | |
| 6,180,303 | B1 | 1/2001 | Uematsu et al. | |
| 6,187,491 | B1 * | 2/2001 | Ferrar et al. | 430/58.2 |
| 6,361,913 | B1 | 3/2002 | Pai et al. | |
| 2002/0119382 | A1 | 8/2002 | Nakata et al. | |
| 2007/0048636 | A1 * | 3/2007 | Qi et al. | 430/58.75 |
| 2007/0212626 | A1 | 9/2007 | Toshine et al. | |

FOREIGN PATENT DOCUMENTS

| | | |
|---|---|---|
| JP | A-62-251757 | 11/1987 |
| JP | A-04-189873 | 7/1992 |
| JP | A-05-098181 | 4/1993 |
| JP | A-05-140472 | 6/1993 |
| JP | A-05-140473 | 6/1993 |
| JP | A-05-263007 | 10/1993 |
| JP | A-05-279591 | 10/1993 |
| JP | A-06-059469 | 3/1994 |
| JP | A-06-230595 | 8/1994 |
| JP | A-07-146564 | 6/1995 |
| JP | A-07-199511 | 8/1995 |
| JP | A-07-253683 | 10/1995 |
| JP | A-08-176293 | 7/1996 |
| JP | A-08-208820 | 8/1996 |
| JP | A-2000-019749 | 1/2000 |
| JP | A-2000-066424 | 3/2000 |
| JP | A-2002-082469 | 3/2002 |
| JP | B2-3287678 | 6/2002 |
| JP | A-2005-234546 | 9/2005 |
| JP | A-2006-084711 | 3/2006 |
| JP | A-2007-279678 | 10/2007 |

* cited by examiner

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Applications No. 2008-319780 filed Dec. 16, 2008.

BACKGROUND

1. Technical Field

The present invention relates to an electrophotographic photoreceptor, a process cartridge, and an image forming apparatus.

2. Related Art

Generally, an electrophotographic image forming apparatus has the following structure and processes. Specifically, the surface of an electrophotographic photoreceptor is charged by a charging means to desired polarity and potential, and the charged surface of the electrophotographic photoreceptor is selectively removed of charge by subjecting to image-wise exposure to form an electrostatic latent image. The latent image is then developed into a toner image by attaching a toner to the electrostatic latent image by a developing means, and the toner image is transferred to an image-receiving medium by a transfer means, then the image-receiving medium is discharged as an image formed material.

Electrophotographic photoreceptors are currently been widely used in the field of copying machines, laser beam printers and other apparatus due to advantages of high speed and high printing quality. As electrophotographic photoreceptors used in image forming apparatus, organic photoreceptors using organic photoconductive materials are mainly used which are superior in cost efficiency, manufacturability and disposability, compared to conventionally used electrophotographic photoreceptors using inorganic photoconductive materials such as selenium, selenium-tellurium alloy, selenium-arsenic alloy and cadmium sulfide.

As a charging method, a corona charging method utilizing a corona charging device has been conventionally used. However, a contact charging method having advantages such as low ozone production and low electricity consumption has recently been put into practical used and is widely used. In the contact charging method, the surface of a photoreceptor is charged by bringing a conductive member as a charging member into contact with, or in close proximity to, the surface of the photoreceptor, and applying a voltage to the charging member. There are two methods of applying a voltage to the charging member: a direct current method in which only a direct current voltage is applied, and an alternating current superimposition method in which a direct current voltage superimposed by an alternating current voltage is applied.

SUMMARY

According to an aspect of the invention, an electrophotographic photoreceptor including a conductive substrate and a photosensitive layer provided on a surface of the conductive substrate is provided. In the electrophotographic photoreceptor, an outermost layer of the photosensitive layer contains a crosslinked product formed from at least one charge transporting material having at least one substituent selected from the group consisting of —OH, —$OCH_3$, —$NH_2$, —SH, and —COOH, an acidic substance, and at least one compound selected from the group consisting of compounds represented by the following formula (A) and compounds represented by the following formula (B).

(A)

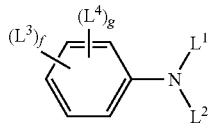

(B)

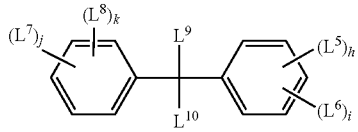

In formula (A), $L^1$ and $L^2$ each independently represent a substituted or unsubstituted alkyl group having 1 to 5 carbon atoms, or a substituted or unsubstituted aralkyl group having 7 to 15 carbon atoms. $L^3$ and $L^4$ each independently represent a substituted or unsubstituted alkyl group having 1 to 5 carbon atoms, a substituted or unsubstituted alkoxy group having 1 to 5 carbon atoms, or a substituted or unsubstituted aralkyl group having 7 to 20 carbon atoms. f and g each independently represent 1 or 2.

In formula (B), $L^5$ to $L^8$ each independently represent hydrogen, a substituted or unsubstituted alkyl group having 1 to 5 carbon atoms, a substituted or unsubstituted alkoxy group having 1 to 5 carbon atoms, a substituted or unsubstituted aralkyl group having 7 to 15 carbon atoms, or a substituted or unsubstituted aryl group having 6 to 15 carbon atoms, and at least one of $L^5$ to $L^8$ has a structure represented by the following formula (C). h to k each independently represent 1 or 2. $L^9$ and $L^{10}$ each independently represent hydrogen, a substituted or unsubstituted alkyl group having 1 to 5 carbon atoms, a substituted or unsubstituted aralkyl group having 7 to 15 carbon atoms, or a substituted or unsubstituted aryl group having 6 to 15 carbon atoms.

(C)

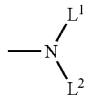

In formula (C), $L^1$ and $L^2$ each independently represent a substituted or unsubstituted alkyl group having 1 to 5 carbon atoms, or a substituted or unsubstituted aralkyl group having 7 to 15 carbon atoms.

BRIEF DESCRIPTION OF THE DRAWINGS

Exemplary embodiments of the present invention will be described in detail based on the following figures, wherein.

DETAILED DESCRIPTION (Electrophotographic Photoreceptor)

Figure 1:
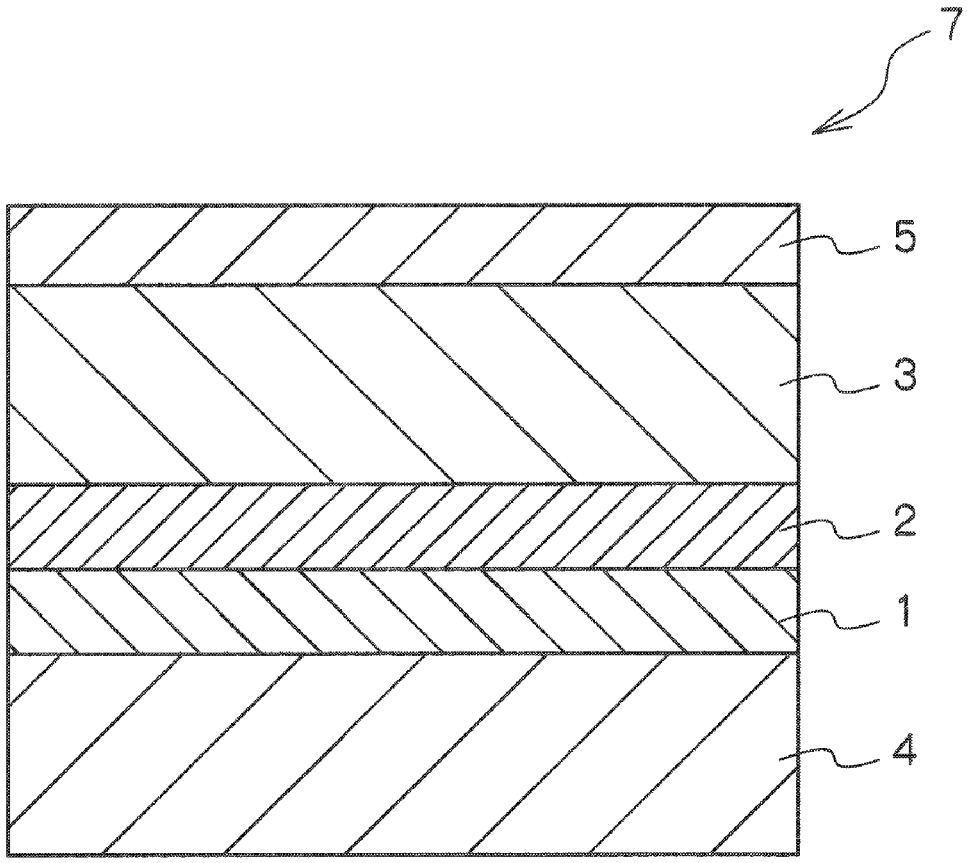
FIG. 1 is a schematic partial cross sectional view showing an electrophotographic photoreceptor according to an exemplary embodiment of the invention.

An electrophotographic photoreceptor of an exemplary embodiment of the present invention includes a conductive substrate and a photosensitive layer provided on a surface of the conductive substrate. An outermost layer of the photosensitive layer contains a crosslinked product formed from at least one charge transporting material having at least one substituent selected from the group consisting of —OH, —$OCH_3$, —$NH_2$, —SH, and —COOH, an acidic substance, and at least one compound selected from the group consisting of compounds represented by the following formula (A) and compounds represented by the following formula (B).

(A)

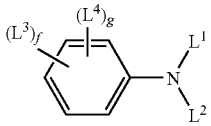

(B)

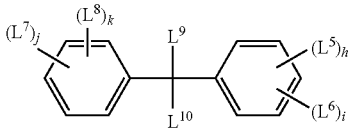

In formula (A), $L^1$ and $L^2$ each independently represent a substituted or unsubstituted alkyl group having 1 to 5 carbon atoms, or a substituted or unsubstituted aralkyl group having 7 to 15 carbon atoms. $L^3$ and $L^4$ each independently represent a substituted or unsubstituted alkyl group having 1 to 5 carbon atoms, a substituted or unsubstituted alkoxy group having 1 to 5 carbon atoms, or a substituted or unsubstituted aralkyl group having 7 to 20 carbon atoms. f and g each independently represent 1 or 2.

In formula (B), $L^5$ to $L^8$ each independently represent hydrogen, a substituted or unsubstituted alkyl group having 1 to 5 carbon atoms, a substituted or unsubstituted alkoxy group having 1 to 5 carbon atoms, a substituted or unsubstituted aralkyl group having 7 to 15 carbon atoms, or a substituted or unsubstituted aryl group having 6 to 15 carbon atoms, and at least one of $L^5$ to $L^8$ has a structure represented by the following formula (C). h to k each independently represent 1 or 2. $L^9$ and $L^{10}$ each independently represent hydrogen, a substituted or unsubstituted alkyl group having 1 to 5 carbon atoms, a substituted or unsubstituted aralkyl group having 7 to 15 carbon atoms, or a substituted or unsubstituted aryl group having 6 to 15 carbon atoms.

(C)

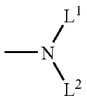

In formula (C), $L^1$ and $L^2$ each independently represent a substituted or unsubstituted alkyl group having 1 to 5 carbon atoms, or a substituted or unsubstituted aralkyl group having 7 to 15 carbon atoms.

The photosensitive photoreceptor according to the present exemplary embodiment has the above constitution, and therefore, a high mechanical strength of the outermost surface layer may be provided, and further, the hysteresis due to light exposure may not be left over, so that images may be obtained stably. The reason is not clear, but can be presumed as follows.

When a charge transporting material having at least one of substituents selected from —OH, —$OCH_3$, —$NH_2$, —SH and —COOH is cured with the use of an acidic substance as a catalyst, the curing reaction proceeds effectively, so that an electrophotographic photoreceptor with a high mechanical strength may be obtained. Meanwhile, the acidic substance used as a catalyst has a function as a catalyst during the thermal curing, and therefore, an acidic substance, that is not volatile at the temperature of being heated, may be selected, resulting in leaving the acidic substance in the outermost surface layer. When the outermost surface layer containing the residual acidic substance is exposed to light, the light-exposed area of the outermost surface layer may cause the change in the electric resistance.

As a result of enthusiastic study on the change in the electric resistance by the inventors, it has been found that when the outermost surface layer containing a residual acidic substance used as a catalyst is exposed to light, a charge separated state is formed between the charge transporting material and the acidic substance contained in the outermost surface layer in the light-exposed area of the outermost surface layer, thereby generating holes, so that the resistance value is lowered. Accordingly, it can be presumed that a difference in electrostatic contrast between the light-exposed area and the unexposed area arises, as a result, in an image formed by an image forming apparatus equipped with an electrophotographic photoreceptor, image unevenness corresponding to the hysteresis of the light exposure in the electrophotographic photoreceptor arises. It can be said that this phenomenon may easily occur with an increase in the concentration of the charge transporting material in the outermost surface layer and an increase in the acidity of the acidic substance used as a catalyst.

As a result of intensive research by the inventors, it has been found that when the outermost surface layer of an electrophotographic photoreceptor contains a crosslinked product formed from at least one charge transporting material having at least one substituent selected from —OH, —$OCH_3$, —$NH_2$, —SH and —COOH, an acidic substance as a catalyst, and at least one compound selected from compounds represented by any of the above formulae (A) and (B), mechanical strength of the outermost surface layer may be enhanced, and holes generated in the outermost surface layer may be effectively trapped by the compound represented by the above formula (A) or (B), and the change in the resistance value of the outermost surface layer attributed to the light exposure may be effectively prevented.

It is considered that this is due to the compound represented by formula (A) or (B) that functions as a donor for supplying an electron. Accordingly, the compound represented by formula (A) or (B) functions as an electron donor to a hole generated in the charge transporting material by an interaction between the charge transporting material that has become a high energy level state due to the light exposure and the acidic substance. Accordingly, the compound represented by formula (A) or (B) becomes a cationic radical state to neutralize the hole in the charge transporting material, and the cationic radical state of the compound represented by formula (A) or (B) is not apt to function as a charge carrier, so that the reduction in the resistance does not arise. For this reason, it can be presumed that the difference in the electrostatic contrast between the light-exposed area and the unexposed area in the outermost surface layer of the electrophotographic photoreceptor of the present exemplary embodiment is suppressed, and the image unevenness corresponding to the hysteresis of the light exposure in the electrophotographic photoreceptor in the image formed in the image forming apparatus equipped with the electrophotographic photoreceptor can be suppressed.

The acidic substance contained in the outermost layer is not limited to the acid catalyst, and may be an acidic substance used for developing other functions such as a crosslinking agent or the like.

Exemplary embodiments of the invention will be illustrated in detail with reference to the figures. In the figures, same or corresponding elements are indicated by the same reference numerals, and overlapping explanation is omitted.

[Electrophotographic Photoreceptor]

The electrophotographic photoreceptor of an exemplary embodiment of the invention will be described in detail below with reference to the figures. In the FIGS. 1 to 5, same or corresponding elements are indicated by the same reference numerals, and overlapping explanation is omitted.

Figure 2:
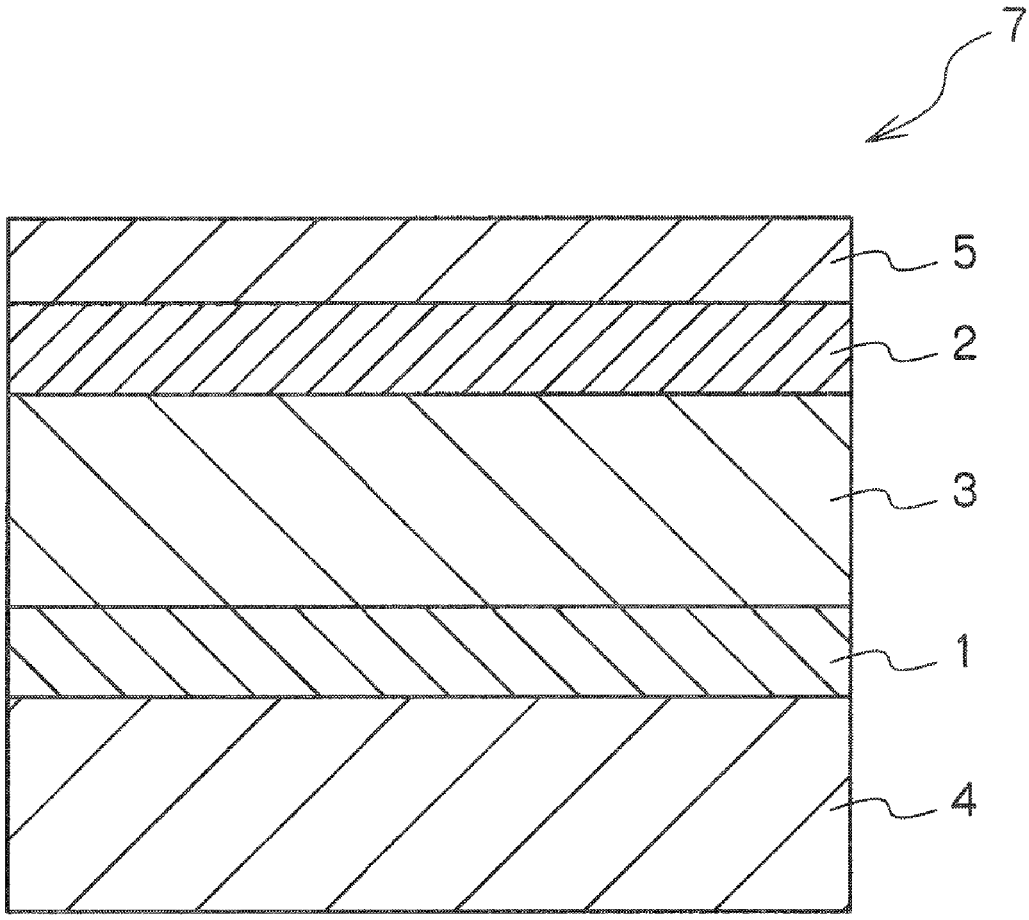
FIG. 2 is a schematic partial cross sectional view showing an electrophotographic photoreceptor according to an exemplary embodiment of the invention.
Figure 3:
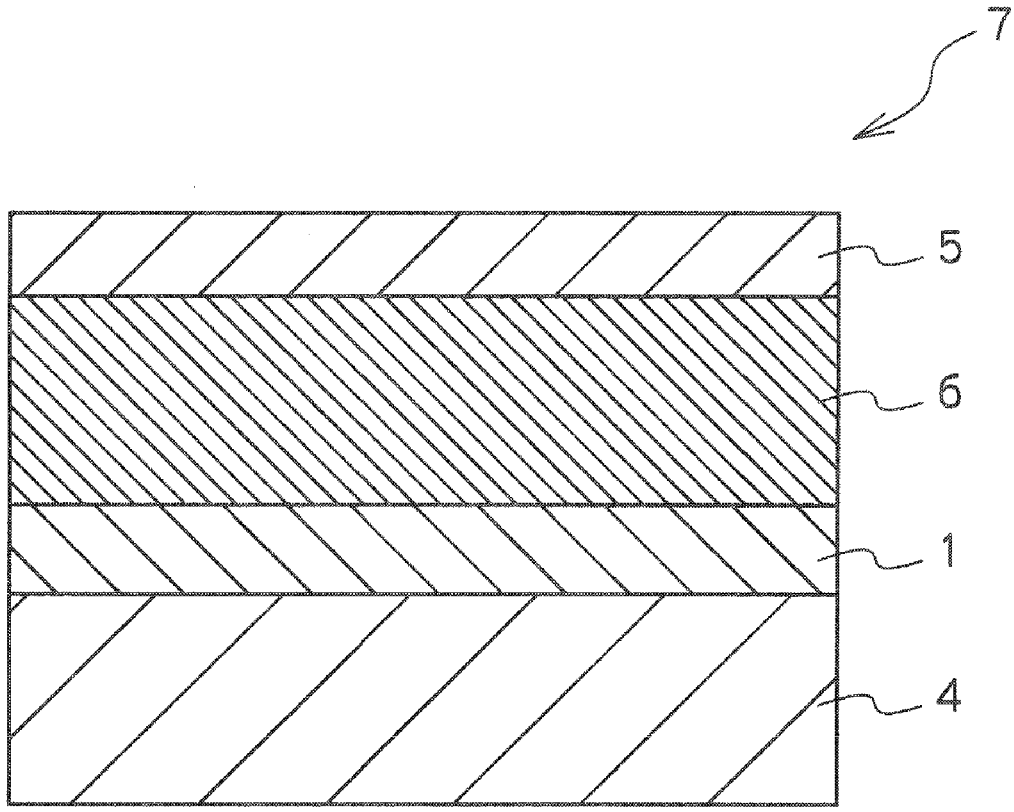
FIG. 3 is a schematic partial cross sectional view showing an electrophotographic photoreceptor according to an exemplary embodiment of the invention.

FIG. 1 is a schematic sectional view showing an exemplary embodiment of the electrophotographic photoreceptor of the invention. FIG. 2 and FIG. 3 are each a schematic sectional view showing another exemplary embodiment of the electrophotographic photoreceptor of the invention.

In the electrophotographic photoreceptor 7 shown in FIG. 1, an undercoat layer 1 is provided on a conductive substrate 4, and a charge generating layer 2, a charge transporting layer 3, and a protective layer 5 are provided in this order on the undercoat layer 1 thereby forming a photosensitive layer.

The electrophotographic photoreceptor 7 shown in FIG. 2 has a photosensitive layer in which a charge generating layer 2 and a charge transporting layer 3 are separated from each other, as is the case of the electrophotographic photoreceptor 7 shown in FIG. 1. The electrophotographic photoreceptor 7 shown in FIG. 3 contains a charge generating material and a charge transporting material in the single layer (The single-layer photosensitive layer 6 (charge generating/charge transporting layer).

In the electrophotographic photoreceptor 7 shown in FIG. 2, an undercoat layer 1 is provided on a conductive substrate 4, and a charge transporting layer 3, a charge generating layer 2, and a protective layer 5 are provided in this order on the undercoat layer 1 thereby forming a photosensitive layer. In the electrophotographic photoreceptor 7 shown in FIG. 3, an undercoat layer 1 is provided on a conductive substrate 4, and a single-layer photosensitive layer 6 and a protective layer 5 are provided in this order on the undercoat layer 1 thereby forming a photosensitive layer.

The electrophotographic photoreceptor 7 shown in FIGS. 1 through 3 corresponds to the outermost layer. In the electrophotographic photoreceptors shown in FIG. 1 through FIG. 3, the undercoat layer may be provided or not provided.

The elements provided in the electrophotographic photoreceptor 7 in FIG. 1 are further described below as examples.

<Conductive Substrate>

Examples of the conductive substrate 4 include metal plates, metal drums, and metal belts using metals such as aluminum, copper, zinc, stainless steel, chromium, nickel, molybdenum, vanadium, indium, gold, platinum or alloys thereof and papers, plastic films and belts which are coated, deposited, or laminated with a conductive compound such as a conductive polymer and indium oxide, a metal such as aluminum, palladium and gold, or alloys thereof.

The term "conductive" means that the volume resistivity is less than $10^{13}$ Ωcm.

When the electrophotographic photoreceptor 7 is used in a laser printer, the surface of the conductive substrate 4 may be roughened so as to have a centerline average roughness (Ra) of 0.04 μm to 0.5 μm in order to prevent interference fringes which are formed when irradiated by laser light. If the Ra is less than 0.04 μm, the surface is almost a mirror surface and may not exhibit satisfactory effect of interference prevention. If the Ra exceeds 0.5 μm, the image quality tends to become rough even if a film is formed. When an incoherent light source is used, surface roughening for preventing interference fringes is not necessary, and occurrence of defects due to the irregular surface of the conductive substrate 4 can be prevented to achieve a longer service life.

Examples of the method for surface roughening include wet honing in which an abrasive suspended in water is blown onto a support, centerless grinding in which a support is continuously ground by pressing the support onto a rotating grind stone, and anodic oxidation.

As another method of surface roughening, a method of surface roughening by forming on the substrate surface a layer of resin in which conductive or semiconductive particles are dispersed in the resin so that the surface roughening is achieved by the particles dispersed in the layer, without roughing the surface of the conductive substrate 4, may be used.

In the surface-roughening treatment by anodic oxidation, an oxide film is formed on an aluminum surface by anodic oxidation in which the aluminum as anode is anodized in an electrolyte solution. Examples of the electrolyte solution include a sulfuric acid solution and an oxalic acid solution. However, the porous anodic oxide film formed by anodic oxidation without modification is chemically active, easily contaminated and has a large resistance variation depending on the environment. Therefore, it is preferable to conduct a sealing treatment in which fine pores of the anodic oxide film are sealed by cubical expansion caused by a hydration in pressurized water vapor or boiled water (to which a metallic salt such as a nickel salt may be added) to transform the anodic oxide into a more stable hydrated oxide.

The thickness of the anodic oxide film may be 0.3 to 15 μm. When the thickness of the anodic oxide film is less than 0.3 μm, the barrier property against injection may be low and fail to achieve sufficient effects. If the thickness of the anodic oxide film exceeds 15 μm, the residual potential tends to be increased due to the repeated use.

The conductive substrate 4 may be subjected to a treatment with an acidic aqueous solution or a boehmite treatment. The treatment with an acidic treatment liquid including phosphoric acid, chromic acid and hydrofluoric acid is carried out as follows: phosphoric acid, chromic acid, and hydrofluoric acid are mixed to prepare an acidic treatment liquid preferably in a mixing ratio of 10 to 11% by weight of phosphoric acid, 3 to 5% by weight of chromic acid, and 0.5 to 2% by weight of hydrofluoric acid. The concentration of the total acid components is preferably in the range of 13.5 to 18% by weight.

The treatment temperature may be 42 to 48° C., and by keeping the treatment temperature high, a thicker film can be obtained more speedily compared to the case of a treatment temperature that is lower than the above range. The thickness of the film may be 0.3 to 15 μm. If the thickness of the film is less than 0.3 μm, the barrier property against injection may be low, and sufficient effects may not be achieved. If the thickness exceeds 15 μm, the residual potential due to repeated use may be increased.

The boehmite treatment is carried out by immersing the substrate in pure water at a temperature of 90 to 100° C. for 5 to 60 minutes, or by bringing it into contact with heated water vapor at a temperature of 90 to 120° C. for 5 to 60 minutes. The film thickness may be 0.1 to 5 μm. The film may further be subjected to anodic oxidation using an electrolyte solution which sparingly dissolves the film, such as adipic acid, boric acid, borate salt, phosphate, phthalate, maleate, benzoate, tartrate, and citrate solutions.

<Undercoat Layer>

The undercoat layer 1 includes, for example, a binder resin containing inorganic particles.

The inorganic particles may have powder resistance (volume resistivity) of about $10^2$ to $10^{11}$ Ω·cm so that the undercoat layer 1 can obtain adequate resistance in order to achieve leak resistance and carrier blocking properties. If the resistance value of the inorganic particles is lower than the lower limit of the range, adequate leak resistance may not be achieved, and if higher than the upper limit of the range, increase in residual potential may be caused.

Examples of the inorganic particles having the above resistance value include inorganic particles of tin oxide, titanium oxide, zinc oxide, and zirconium oxide (conductive metal oxides), and zinc oxide may be preferably used.

The inorganic particles may be the ones which are subjected to a surface treatment. Particles which are subjected to different surface treatments, or those having different particle diameters, may be used in combination of two or more kinds. The volume average particle size of the inorganic particles is preferably from 50 nm to 2000 nm, and more preferably from 60 nm to 1000 nm.

Inorganic particles having a specific surface area (measured by a BET analysis) of 10 $m^2/g$ or more are preferably used. When the specific surface area thereof is less than 10 $m^2/g$, lowering of the electrostatic properties may easily be caused and the favorable electrophotographic characteristics may not be obtained.

By including inorganic particles and acceptor compounds, the undercoat layer which is superior in long-term stability of electrical characteristics and carrier blocking property can be achieved. Any acceptor compound by which desired characteristics can be obtained may be used, but preferred examples thereof include electron transporting substances such as quinone-based compounds such as chloranil and bromanil, tetracyanoquinodimethane-based compounds, fluorenone compounds such as 2,4,7-trinitrofluorenone and 2,4,5,7-tetranitro-9-fluorenone, oxadiazole-based compounds such as 2-(4-biphenyl)-5-(4-t-butylphenyl)-1,3,4-oxadiazole, 2,5-bis(4-naphthyl)-1,3,4-oxadiazole and 2,5-bis(4-diethylaminophenyl)-1,3,4-oxadiazole, xanthone-based compounds, thiophene compounds and diphenoquinone compounds such as 3,3',5,5'-tetra-t-butyldiphenoquinone, and particularly preferable are compounds having an anthraquinone structure. Preferred examples further include acceptor compounds having an anthraquinone structure such as hydroxyanthraquinone-based compounds, aminoanthraquinone-based compounds, and aminohydroxyanthraquinone-based compounds, and specific examples thereof include anthraquinone, alizarin, quinizarin, anthrarufin, and purpurin.

The content of the acceptor compound may be determined as appropriate within the range where desired characteristics can be achieved, but preferably in the range of 0.01 to 20% by weight relative to the inorganic particles, more preferably in the range of 0.05 to 10% by weight in terms of preventing accumulation of charge and aggregation of the inorganic particles. The aggregation of the inorganic particles may cause irregular formation of conductive channels, deterioration of maintainability such as increase in residual potential, or image defects such as black points, when repeatedly used.

The acceptor compound may simply be added at the time of application of the undercoat layer, or may be previously attached to the surface of the inorganic particles. Examples of the method of attaching the acceptor compound to the surface of the inorganic particles include a dry method and a wet method as.

When a surface treatment is conducted according to a dry method, the acceptor compound is added dropwise to the inorganic particles or sprayed thereto together with dry air or nitrogen gas, either directly or in the form of a solution in which the acceptor compound is dissolved in an organic solvent, while the inorganic particles are stirred with a mixer or the like having a high shearing force, whereby the particles are treated without causing irregular formation. The addition or spraying is preferably carried out at a temperature lower than the boiling point of the solvent. If the spraying is carried out at a temperature of not less than the boiling point of the solvent, there is a disadvantage in that the solvent may evaporate before the inorganic particles are stirred to prevent variation and the acceptor compound may coagulate locally so that the treatment without causing variation will be difficult to conduct, which is undesirable. After the addition or spraying of the acceptor compound, the inorganic particles may further be subjected to baking at a temperature of 100° C. or higher. The baking may be carried out as appropriate at a temperature and timing by which desired electrophotographic characteristics can be obtained.

In a wet method, the inorganic particles are dispersed in a solvent by means of stirring, ultrasonic wave, a sand mill, an attritor, a ball mill or the like, then the acceptor compound is added and the mixture is further stirred or dispersed, thereafter the solvent is removed, and thereby the particles are surface-treated without causing variation. The solvent is removed by filtration or distillation. After removing the solvent, the particles may be subjected to baking at a temperature of 100° C. or higher. The baking can be carried out at any temperature and timing in which desired electrophotographic characteristics can be obtained. In the wet method, the moisture contained in the inorganic particles can be removed prior to adding the surface treatment agent. The moisture can be removed by, for example, stirring and heating the particles in the solvent used for the surface treatment, or by azeotropic removal with the solvent.

The inorganic particles may be subjected to a surface treatment prior to the addition of the acceptor compound. The surface treatment agent may be any agent by which desired characteristics can be obtained, and can be selected from known materials. Examples thereof include silane coupling agents, titanate-based coupling agents, aluminum-based coupling agents and surfactants. Among these, silane coupling agents are preferably used by which favorable electrophotographic characteristics can be provided, and preferred examples are the silane coupling agents having an amino group that can impart favorable blocking properties to the undercoat layer 1.

The silane coupling agents having amino groups may be any compounds by which desired electrophotographic photoreceptor characteristics can be obtained. Specific examples thereof include γ-aminopropyltriethoxysilane, N-β-(aminoethyl)-γ-aminopropyltrimethoxysilane, N-β-(aminoethyl)-γ-aminopropylmethydilmethoxysilane, and N,N-bis(β-hydroxyethyl)-γ-aminopropyltriethoxysilane, but are not limited thereto.

The silane coupling agent may be used singly or in combination of two or more kinds thereof. Examples of the silane coupling agents which can be used in combination with the above-described silane coupling agents having an amino group include vinyltrimethoxysilane, γ-methacryloxypropyl-tris-(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane, but are not limited thereto.

The surface treatment method may be any known method, and may be dry or wet method. Addition of an acceptor and a surface treatment using a coupling agent or the like may be carried out simultaneously.

The content of the silane coupling agent relative to the inorganic particles contained in the undercoat layer 1 can be determined as appropriate within a range in which the desired electrophotographic characteristics can be obtained, but preferably 0.5% by weight to 10% by weight from the viewpoint of improving dispersibility.

As the binder resin contained in the undercoat layer 1, any known resin that can form a favorable film and achieve desired characteristics may be used. Examples thereof include known polymer resin compounds, e.g. acetal resins such as polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenolic resins, phenol-formaldehyde resins, melamine resins and urethane resins; charge transporting resins having charge transporting groups; and conductive resins such as polyaniline. Particularly preferred examples are resins which are insoluble in the coating solvent for the upper layer, specifically phenolic resins, phenol-formaldehyde resins, melamine resins, urethane resins, epoxy resins and the like. When these resins are used in combination of two or more kinds, the mixing ratio can be appropriately determined according to the circumstances.

The ratio of the metal oxide imparted with the properties as an acceptor to the binder resin, or the ratio of the inorganic particles to the binder resin, in the coating liquid for forming the undercoat layer, can be appropriately determined within a range in which the desired electrophotographic photoreceptor characteristics can be obtained.

Various additives may be used for the undercoat layer 1 to improve electrical characteristics, environmental stability, or image quality. Examples of the additives include known materials such as the polycyclic condensed type or azo-based type of the electron transporting pigments, zirconium chelate compounds, titanium chelate compounds, aluminum chelate compounds, titanium alkoxide compounds, organic titanium compounds, and silane coupling agents. Silane coupling agents, which are used for surface treatment of metal oxides, may also be added to the coating liquid as additives. Specific examples of the silane coupling agents include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane. Examples of the zirconium chelate compounds include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, isostearic acid zirconium, methacrylate zirconium butoxide, stearate zirconium butoxide, and isostearate zirconium butoxide.

Examples of the titanium chelate compounds include tetraisopropyl titanate, tetranormalbutyl titanate, butyl titanate dimer, tetra(2-ethylhexyl)titanate, titanium acetyl acetonate, polytitaniumacetyl acetonate, titanium octylene glycolate, titanium lactate ammonium salt, titanium lactate, titanium lactate ethyl ester, titanium triethanol aminato, and polyhydroxy titanium stearate.

Examples of the aluminum chelate compounds include aluminum isopropylate, monobutoxy aluminum diisopropylate, aluminum butylate, diethylacetoacetate aluminum diisopropylate, and aluminum tris(ethylacetoacetate).

These compounds may be used alone, or as a mixture or a polycondensate of two or more kinds thereof.

The solvent for preparing the coating liquid that is used for preparing the undercoat layer may appropriately be selected from known organic solvents such as alcohol-based, aromatic, hydrocarbon halide-based, ketone-based, ketone alcohol-based, ether-based, and ester-based solvents. Examples thereof include common organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

These solvents used for dispersion may be used alone or as a mixture of two or more kinds thereof. When they are mixed, any mixed solvents which can solve a binder resin can be used.

To perform the dispersion, known devices such as a roll mill, a ball mill, a vibration ball mill, an attritor, a sand mill, a colloid mill, or a paint shaker can be used. For applying the undercoat layer 1, known methods such as blade coating, wire bar coating, spray coating, dip coating, bead coating, air knife coating, curtain coating or the like can be used.

The undercoat layer 1 is formed on the conductive substrate using the coating liquid obtained by the above-described method.

The undercoat layer 1 may have a Vickers hardness of 35 or more. The thickness of the undercoat layer 1 may be arbitrarily determined within the range in which the desired characteristics can be obtained, but preferably 15 μm or more, more preferably 15 μm or more and 50 μm or less.

When the thickness of the undercoat layer 1 is less than 15 μm, sufficient antileak properties may not be obtained, while when the thickness of the undercoat layer 1 exceeds 50 μm, residual potential tends to remain during the long-term operation, which may cause the defects in image concentration.

The surface roughness of the undercoat layer 1 (ten point height of irregularities) is adjusted in the range of from $\frac{1}{4}\times n\times\lambda$ to $\frac{1}{2}\times\lambda$, where λ represents the wavelength of the laser for exposure and n represents a refractive index of the upper layer, in order to prevent a moire image. Particles of a resin or the like may also be added to the undercoat layer for adjusting the surface roughness thereof. Examples of the resin particles include silicone resin particles and crosslinked polymethyl methacrylate resin particles.

Here, the undercoat layer contains a binder resin and an electroconductive metal oxide, and has preferably a light transmittance of 40% or less (desirably, from 10% to 35%, more desirably 15% to 30%) at a wavelength of 950 nm at a layer thickness of 20 μm. In an electrophotographic photoreceptor aiming for the long life, it is necessary to maintain stably a high image quality. In the case where a crosslinked outermost surface layer (protective layer) is used, the characteristics similar to the above are also required. When a crosslinked outermost surface layer (protective layer) is used, an acid catalyst is used for curing in many cases, and a higher layer-strength can be obtained with an increase in the amount of the acid catalyst with respect to the amount of solid component in the outermost surface layer (protective layer), and the print durability can be enhanced, so that the long life can be achieved. On the other hand, since the residual catalyst in the bulk acts as a trap site for an electric charge, the resistance to light-induced fatigue is deteriorated, and an image density unevenness is caused due to light exposure of the electrophotographic photoreceptor at the time of checking up the apparatus. Although the light fastness (resistance to light-induced fatigue) can be improved by optimizing the quantity of materials (in particular, the charge transporting material and acid catalyst) to a degree of being not problematic in practical use, this may not be sufficient for an increased illuminated environment such as a highly illuminated showroom than the illumination in common offices, or exposure to light with a high intensity for a long period of time at the time when foreign substances adhered to the surface of an electrophotographic photoreceptor are observed. Accordingly, in order to achieve a longer life, it is necessary to enhance the layer strength. However, when the amount of the curing catalyst is increased to enhance the layer strength, the light fastness may become insufficient. Accordingly, with the use of an undercoat layer having the predetermined light transmittance as described above (namely, a low transmittance), the light incident on the electrophotographic photoreceptor is absorbed by the undercoat layer, so that an image excellent in the fastness to light with a high intensity can be stably obtained over a long period of time. That is, since the light reflected from the surface of the electroconductive substrate is reduced, the light fastness (resistance to light-induced fatigue) to the light exposure with a high intensity over long period of time can be attained, and a longer life can be realized by increasing the printing durability by enhancing the strength of the outermost surface layer (protective layer) with an increase in the amount of the curing catalyst.

The light transmittance of the undercoat layer is measured by the following manner. A coating liquid for forming an undercoat layer is coated on a glass plate so as to form a layer having a thickness of 20 μm after being dried, and after drying, the light transmittance of the layer is measured at a wavelength of 950 nm using a spectrophotometer. The light transmittance is measured by a spectrophotometer "SPECTROPHOTOMETER (U-2000) ((trade name) manufactured by Hitachi, Ltd.).

For example, the light transmittance is adjusted by the following manner. The light transmittance is controllable by adjusting the dispersing time at the time of dispersing by the use of a roll mill, a ball mill, a vibration ball mill, an attritor, a sand mill, a colloid mill, a paint shaker or the like as described hereinbefore, can be used. The dispersing time is not specifically restricted, but an arbitrary time between five minutes to 1,000 hours is preferable, and more preferably from 30 minutes to 10 hours. The light transmittance is apt to decrease as the dispersion time is extended.

The undercoat layer may be subjected to grinding for adjusting the surface roughness thereof. The method such as buffing, a sandblast treatment, a wet honing, a grinding treatment and the like can be used for grinding.

The undercoat layer can be obtained by drying the applied coating, which is usually carried out by evaporating the solvent at a temperature at which a film can be formed.

<Charge Generating Layer>

The charge generating layer 2 contains a charge generating material and a binder resin. Examples of the charge generating material include azo pigments such as bisazo and trisazo pigments, condensed aromatic pigments such as dibromoantanthrone, perylene pigments, pyrrolopyrrole pigment, phthalocyanine pigment zinc oxides, and trigonal selenium. For laser exposure in the near-infrared region, preferred examples are metal or nonmetal phthalocyanine pigments, and more preferred are hydroxy gallium phthalocyanine disclosed in Japanese Patent Application Laid-Open (JP-A) Nos. 5-263007 and 5-279591, chlorogallium phthalocyanine disclosed in JP-A No. 5-98181, dichlorotin phthalocyanine disclosed in JP-A Nos. 5-140472 and 5-140473, and titanyl phthalocyanine disclosed in JP-A No. 4-189873. For laser exposure in the near-ultraviolet region, preferred examples are condensed aromatic pigments such as dibromoantanthrone, thioindigo-based pigments, porphyrazine compounds, zinc oxides, and trigonal selenium. When a light source of an exposure wavelength of from 380 nm to 500 nm is used, as the charge generating material, an inorganic pigment may be preferably used. When a light source of an exposure wavelength of from 700 nm to 800 nm is used, as the charge generating material, a metallic or non-metallic phthalocyanine pigment may be preferably used.

As the material for the charge generating layer, a hydroxygallium phthalocyanine pigment having a maximum peak wavelength in the range of from 810 nm to 839 nm in the absorption spectrogram in the range of from 600 nm to 900 nm is preferably used. This hydroxygallium phthalocyanine pigment is different from the conventional V-type hydroxygallium phthalocyanine pigment, and is desirable because an excellent dispersibility can be obtained. In this way, by shifting the maximum peak wavelength of the absorption spectrogram to the shorter wavelength side from that of the conventional V-type hydroxygallium phthalocyanine pigment, fine hydroxygallium phthalocyanine pigment particles with a suitably controlled crystal arrangement of the pigment particles can be formed, and when this hydroxygallium phthalocyanine pigment is used as a material for the electrophotographic photoreceptor, an excellent dispersibility, sufficient sensitivity, chargeability and dark decay property can be obtained.

Further, it is preferable that the hydroxygallium phthalocyanine pigment having a maximum peak wavelength in the range of from 810 nm to 839 nm has an average particle diameter in a specific range, and a BET specific surface area in a specific range. More specifically, the average particle diameter is preferably 0.2 μm or less, and more preferably from 0.01 μm to 0.15 μm, and meanwhile, the BET specific surface area is preferably 45 $m^2/g$ or more, more preferably 50 $m^2/g$ or more, and particularly preferably from 55 $m^2/g$ to 120 $m^2/g$. The value of the average particle diameter is a value of a volume average particle diameter (d50 average particle diameter) measured by a laser diffraction/scattering particle size distribution analyzer (LA-700 (trade name) manufactured by Horiba Ltd.), and the value of the specific surface area is a value obtained by using a BET specific surface area analyzer (FLOWSORB II2300 (trade name) manufactured by Shimadzu Corporation).

When the average particle diameter is larger than 0.20 μm, or the specific surface area is less than 45 $m^2/g$, the pigment particles may be coarse, or aggregates of the pigment particles may be formed, so that when such a pigment is used for a material for the electrophotographic photoreceptor, characteristics such as the dispersiblity, sensitivity, chargeability and dark decay property tend to be deteriorated, resulting in causing image defects easily.

Further, the maximum particle diameter (maximum value of primary particle diameter) of the hydroxygallium phthalocyanine pigment is preferably 1.2 μm or less, more preferably 1.0 μm or less, and furthermore preferably 0.3 μm or less. When the maximum particle diameter exceeds the above range, micro black spots are apt to occur.

Furthermore, from the viewpoint of surely preventing occurrence of density unevenness attributed to the exposure of the photoreceptor to the light from a fluorescent lamp, it is desirable that the hydroxygallium phthalocyanine pigment has an average particle diameter of 0.2 μm or less, a maximum particle diameter of 1.2 μm or less, and a specific surface area of 45 $m^2/g$ or more.

Moreover, the hydroxygallium phthalocyanine pigment preferably has diffraction peaks at Bragg angles (2θ±0.2°) of 7.5°, 9.9°, 12.5°, 16.3°, 18.6°, 25.1° and 28.3° in the X-ray diffraction spectrogram using the CuKα characteristic x-ray.

The ratio of thermogravimetric mass loss of the hydroxygallium phthalocyanine pigment is preferably from 2.0% to 4.0%, and more preferably 2.5% to 3.5%, when the temperature is raised from 25° C. to 400° C. The ratio of thermogravimetric mass loss is measured with the use of a thermobalance and the like. When the ratio of thermogravimetric mass loss exceeds 4.0%, impurities contained in the hydroxygallium phthalocyanine pigment influence the electrophotographic photoreceptor, and reduction in the sensitivity and the stability of potential and deterioration of image quality during reiterative use tend to take place. Further, when the ratio of thermogravimetric mass loss is less than 2.0%, reduction in sensitivity is apt to arise. It is presumed that this is attributable to a sensitizing effect due to the interaction between the hydroxygallium phthalocyanine pigment and solvent molecules in a trace amount contained in the crystals.

When the hydroxygallium phthalocyanine pigment is used as a charge generating material for the electrophotographic photoreceptor, the pigment is particularly effective from the viewpoint of obtaining an optimal sensitivity and an excellent photoelectric property of the photoreceptor, and an excellent image quality owing to the excellent dispersibility in the binder resin contained in the photosensitive layer.

Although it has been known that the occurrence of fog at the initial stage and black spots can be prevented by regulating the average particle diameter and the BET specific surface area of the hydroxygallium phthalocyanine pigment particles, there are problems that fog and black spots are generated during the use over a prolonged period. In contrast, by combining the predetermined outermost surface layer (a protective layer containing a crosslinked product formed from at least one charge transporting material having at least one substituent selected from the group consisting of —OH, —$OCH_3$, —$NH_2$, —SH, and —COOH, an acidic substance, and at least one compound selected from the group consisting of compounds represented by formula (A) and compounds represented by formula (B)) which will be described later, with the charge transport layer, the occurrence of fog and black spots due to the use over a prolonged period that is problematic in the conventional combination of the outermost surface layer and the charge generating layer, may be prevented. It is considered that the wear of the layer resulting from long-term use and the decrease in charging capacity may be suppressed by the use of the protective layer. Further, prevention of fog and black spots occurred in the conventional photoreceptor with a thinned charge transport layer that is effective for the improvement of the electric property (reduction in residual potential) can be realized.

The binder resin used in the charge generating layer 2 can be selected from a wide range of insulating resins, and may be selected from organic light conductive polymers such as poly-N-vinyl carbazole, polyvinyl anthracene, polyvinyl pyrene, and polysilane. Preferable examples of the binder resin include polyvinyl butyral resins, polyarylate resins (polycondensates of bisphenols and aromatic divalent carboxylic acid or the like), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. These binder resins may be used alone or in combination of two or more kinds thereof. The mixing ratio between the charge generating material and the binder resin may be in the range of 10:1 to 1:10 by weight ratio.

The term "insulating" means that the volume resistivity is $10^{13}$ Ωcm or more.

The charge generating layer 2 may be formed using a coating liquid in which the above-described charge generating materials and binder resins are dispersed in a given solvent.

Examples of the solvent used for dispersion include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene, which may be used alone or in combination of two or more kinds.

For dispersing the charge generating materials and the binder resins in a solvent, ordinary methods such as ball mill dispersion, attritor dispersion and sand mill dispersion can be used. By these dispersion methods, deformation of crystals of the charge generating material caused by dispersion can be prevented. The average particle diameter of the charge generating material to be dispersed is preferably 0.5 μm or less, more preferably 0.3 μm or less and further preferably 0.15 μm or less.

For forming the charge generating layer 2, conventional methods such as blade coating, Meyer bar coating, spray coating, dip coating, bead coating, air knife coating or curtain coating can be used.

The film thickness of the charge generating layer 2 obtained by the above-described methods is preferably 0.1 μm to 5.0 μm and more preferably 0.2 μm to 2.0 μm.

<Charge Transporting Layer>

The charge transporting layer 3 is formed by including a charge transporting material and a binder resin, or including a polymer charge transporting material.

Examples of the charge transporting material include electron transporting compounds such as quinone-based compounds such as p-benzoquinone, chloranil, bromanil, and anthraquinone, tetracyanoquinodimethane-based compounds, fluorenone compounds such as 2,4,7-trinitro fluorenone, xanthone-based compounds, benzophenone-based compounds, cyanovinyl-based compounds, and ethylene-based compounds; and hole transporting compounds such as triarylamine-based compounds, benzidine-based compounds, arylalkane-based compounds, aryl substituted ethylene-based compounds, stilbene-based compounds, anthracene-based compounds, and hydrazone-based compounds. These charge transporting materials may be used alone or in combination of two or more kinds thereof and are not limited the above described examples.

The charge transporting material is preferably a triaryl amine derivative represented by the following Formula (a-1) or a benzidine derivative represented by the following Formula (a-2) from the viewpoint of charge mobility.

(a-1)

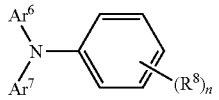

In formula (a-1), $R^8$ represents a hydrogen atom or a methyl group. n represents 1 or 2. $Ar^6$ and $Ar^7$ each independently represent a substituted or unsubstituted aryl group, $—C_6H_4—C(R^9)=C(R^{10})(R^{11})$, or $—C_6H_4—CH=CH—CH=C(R^{12})(R^{13})$, $R^9$ through $R^{13}$ each independently represent a hydrogen atom, a substituted or unsubstituted alkyl group, or a substituted or unsubstituted aryl group. The substituent is a halogen atom, an alkyl group having 1 to 5 carbon atoms, an alkoxy group having 1 to 5 carbon atoms, or an amino group substituted with an alkyl group having 1 to 3 carbon atoms.

(a-2)

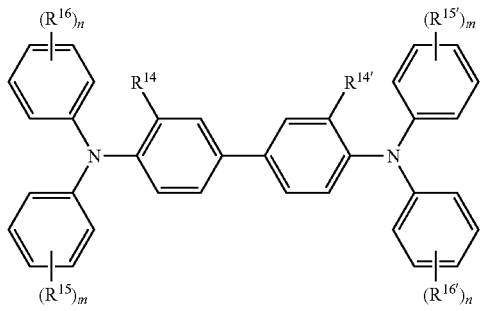

In formula (a-2), $R^{14}$ and $R^{14'}$ may be the same or different from each other, and each independently represent a hydrogen atom, a halogen atom, an alkyl group having 1 to 5 carbon atoms, or an alkoxy group having 1 to 5 carbon atoms, $R^{15}$, $R^{15'}$, $R^{16}$, and $R^{16'}$ may be the same or different from each other, and each independently represent a hydrogen atom, a halogen atom, an alkyl group having 1 to 5 carbon atoms, an alkoxy group having 1 to 5 carbon atoms, an amino group substituted by an alkyl group having 1 to 2 carbon atoms, a substituted or unsubstituted aryl group, $—C(R^{17})=C(R^{18})(R^{19})$, or $—CH=CH—CH=C(R^{20})(R^{21})$, $R^{17}$ through $R^{21}$ each independently represent a hydrogen atom, a substituted or unsubstituted alkyl group, or a substituted or unsubstituted aryl group, and m and n each independently represent an integer from 0 to 2.

Among the triarylamine derivatives represented by formula (a-1) and the benzidine derivatives represented by formula (a-2), triarylamine derivatives having "$—C_6H_4—CH=CH—CH=C(R^{12})(R^{13})$" and benzidine derivatives having "$—CH=CH—CH=C(R^{20})(R^{21})$" are particularly preferable because they are excellent in charge mobility, adhesiveness to the protective layer, and prevention of residual image development caused by the residual hysteresis of the preceding image (hereinafter, may be referred to as "ghost").

Examples of the binder resin used in the charge transporting layer 3 include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinyl carbazole and polysilane. Further, polymer charge transporting materials can also be used as the binder resin, such as the polyester-based polymer charge transporting materials disclosed in JP-A Nos. 8-176293 and 8-208820. These binder resins may be used alone or in combination of two or more kinds thereof. The mixing ratio between the charge transporting material and the binder resin may be 10:1 to 1:5 by weight ratio.

As the binder resin, for example, at least one selected from the group consisting of a polycarbonate resin having a viscosity average molecular weight of 50,000 to 80,000, and a polyacrylate resin having a viscosity average molecular weight of 50,000 to 80,000 may be preferably used, since a favorable film may be easily formed, however, is not limited thereto.

As the charge transporting material, polymer charge transporting materials can also be used. As the polymer charge transporting material, known materials having charge transporting properties such as poly-N-vinyl carbazole and polysilane can be used. Polyester-based polymer charge transporting materials disclosed in JP-A Nos. 8-176293 and 8-208820, having high charge transporting properties, are particularly preferred. Charge transporting polymer materials can form a film independently, but may also be mixed with the above-described binder resin to form a film.

The charge transporting layer 3 can be formed using the coating liquid containing the above-described constituents. Examples of the solvent used for the coating liquid for forming the charge transporting layer include ordinary organic solvents such as aromatic hydrocarbons such as benzene, toluene, xylene and chlorobenzene, ketones such as acetone and 2-butanone, aliphatic hydrocarbon halides such as methylene chloride, chloroform and ethylene chloride, cyclic or straight-chained ethers such as tetrahydrofuran and ethyl ether. These solvents may be used alone or in combination of two or more kinds thereof. Known methods can be used for dispersing the above-described constituents.

For applying the coating liquid for forming the charge transporting layer onto the charge generating layer 2, ordinary methods such as blade coating, Meyer bar coating, spray coating, dip coating, bead coating, air knife coating and curtain coating can be used.

The film thickness of the charge transporting layer 3 is preferably 5 to 50 μm and more preferably 10 to 30 μm.

<Protective Layer>

The protective layer 5 is the outermost layer of the electrophotographic photoreceptor 7, which is provided for the purpose of imparting surface resistance against abrasion or scratches, and enhancing the toner transferring efficiency.

The protective layer 5 contains a crosslinked product formed from at least one charge transporting material having at least one substituent selected from the group consisting of —OH, $—OCH_3$, $—NH_2$, —SH, and —COOH, an acidic substance and at least one compound selected from the group consisting of compounds represented by formula (A) and compounds represented by formula (B).

As described above, in formula (A), $L^1$ and $L^2$ each independently represent a substituted or unsubstituted alkyl group having 1 to 5 carbon atoms, or a substituted or unsubstituted aralkyl group having 7 to 15 carbon atoms. $L^3$ and $L^4$ each independently represent a substituted or unsubstituted alkyl group having 1 to 5 carbon atom, a substituted or unsubstituted alkoxy group having 1 to 5 carbon atoms s, or a substituted or unsubstituted aralkyl group having 7 to 20 carbon atoms. f and g each independently represent an integer from 1 to 2.

Further, in formula (B), $L^5$ to $L^8$ each independently represent a hydrogen atom, a substituted or unsubstituted alkyl group having 1 to 5 carbon atoms, a substituted or unsubstituted alkoxy group having 1 to 5 carbon atoms, a substituted or unsubstituted aralkyl group having 7 to 15 carbon atoms, or a substituted or unsubstituted aryl group having 6 to 15 carbon atoms, and at least one of $L^5$ to $L^8$ has a structure represented by formula (C). h to k each independently represent an integer from 1 to 2. $L^9$ and $L^{10}$ each independently represent a hydrogen atom, a substituted or unsubstituted alkyl group having 1 to 5 carbon atoms, a substituted or unsubstituted aralkyl group having 7 to 15 carbon atoms, or a substituted or unsubstituted aryl group having 6 to 15 carbon atoms.

Further, in formula (C), $L^1$ and $L^2$ each independently represent a substituted or unsubstituted alkyl group having 1 to 5 carbon atoms, or a substituted or unsubstituted aralkyl group having 7 to 15 carbon atoms.

As described above, in formula (A), $L^1$ and $L^2$ each independently represent a substituted or unsubstituted alkyl group having 1 to 5 carbon atoms, or a substituted or unsubstituted aralkyl group having 7 to 15 carbon atoms.

In formula (A), as the a substituted or unsubstituted alkyl group having 1 to 5 carbon atoms, represented by $L^1$ or $L^2$, an alkyl group having 1 to 3 carbon atoms is preferable.

When the alkyl group represented by $L^1$ and $L^2$ has a substituent, examples of the substituent include a hydroxyl group, an alkoxy group (preferably, having 1 to 4 carbon atoms, and more preferably, having 1 to 3 carbon atoms), and specific examples of an alkoxy group as the substituent include a methoxy group, an ethoxy group, and a butoxy group. Examples of the substituted alkyl group represented by $L^1$ and $L^2$ include a 2-hydroxyethyl group, a 3-hydroxypropyl group, a 2-hydroxyprolyl group and a 2-methoxyethyl group.

Among them, as $L^1$ and $L^2$, a 2-hydroxyethyl group or an ethyl group is preferable.

As described above, in formula (A), $L^3$ and $L^4$ each independently represent a substituted or unsubstituted alkyl group having 1 to 5 carbon atoms, a substituted or unsubstituted alkoxy group having 1 to 5 carbon atoms, or a substituted or unsubstituted aralkyl group having 7 to 20 carbon atoms. f and g each independently represent an integer from 1 to 2.

In formula (A), when $L^3$ and $L^4$ each independently represent a substituted or unsubstituted alkyl group having 1 to 5 carbon atoms, an alkyl group having 1 to 5 carbon atoms is preferable, and an alkyl group having 1 to 3 carbon atoms is particularly preferable.

When an alkyl group represented by $L^3$ or $L^4$ has a substituent, examples of the substituent include a hydroxyl group, an alkoxy group (preferably, having 1 to 4 carbon atoms, and more preferably having 1 to 3 carbon atoms), and specific examples of an alkoxy group as the substituent include a methoxy group, an ethoxy group, and a butoxy group. Examples of the alkyl group represented by $L^3$ and $L^4$ include a methyl group, an ethyl group, a propyl group, an n-butyl group, an i-butyl group, a t-butyl group, a 2-hydroxyethyl group, a 3-hydroxypropyl group, a 2-hydroxypropyl group and a 2-methoxyethyl group.

Among them, as the substituent on the alkyl group represented by $L^3$ and $L^4$, a methyl group or an ethyl group is particularly preferable.

When $L^3$ or $L^4$ is a substituted or unsubstituted alkoxy group having 1 to 5 carbon atoms, an alkoxy group having 1 to 5 carbon atoms is preferable, and an alkoxy group having 1 to 3 carbon atoms is more preferable. Specific examples thereof include a methoxy group, an ethoxy group, and a butoxy group.

When $L^3$ or $L^4$ is a substituted or unsubstituted aralkyl group having 7 to 20 carbon atoms, the aralkyl group is preferably an aralkyl group having 7 to 15 carbon atoms, and particularly preferably an aralkyl group having 7 to 10 carbon atoms.

As the substituent on the aralkyl group represented by $L^3$ and $L^4$, a benzyl group is most preferable.

As described above, in formula (B), $L^5$ to $L^8$ each independently represent a hydrogen atom, a substituted or unsubstituted alkyl group having 1 to 5 carbon atoms, a substituted or unsubstituted alkoxy group having 1 to 5 carbon atoms, a substituted or unsubstituted aralkyl group having 7 to 15 carbon atoms, or a substituted or unsubstituted aryl group having 6 to 15 carbon atoms, and at least one of $L^5$ to $L^8$ has a structure represented by the above formula (C).

When any of $L^5$ to $L^8$ represents a substituted or unsubstituted alkyl group having 1 to 5 carbon atoms, the alkyl group is preferably an alkyl group having 1 to 5 carbon atoms, and particularly preferably an alkyl group having 1 to 3 carbon atoms.

When an alkyl group represented by $L^5$ to $L^8$ has a substituent, examples of the substituent include a hydroxyl group, an alkoxy group (preferably, an alkoxy group having 1 to 5 carbon atoms, and more preferably an alkoxy group having 1 to 3 carbon atoms), and more specifically a methoxy group, an ethoxy group, and a butoxy group and the like. Examples of the alkyl group represented by $L^5$ to $L^8$ include a methyl group, an ethyl group, a propyl group, an n-butyl group, an i-butyl group, a t-butyl group, a 2-hydroxyethyl group, a 3-hydroxypropyl group, a 2-hydroxyprolyl group and a 2-methoxyethyl group.

When any of $L^5$ to $L^8$ represents a substituted or unsubstituted alkoxy group having 1 to 5 carbon atoms, examples of the alkoxy group include a methoxy group, an ethoxy group and a t-butyloxy group. Among them, an alkoxy group having 1 to 5 carbon atoms is preferable, an alkoxy group having 1 to 3 carbon atoms is more preferable, and a methoxymethyl group is particularly preferable.

When any of $L^5$ to $L^8$ represents a substituted or unsubstituted aralkyl group having 7 to 15 carbon atoms, examples of the aralkyl group preferably include a benzyl group and a phenethyl group. Among them, a benzyl group is particularly preferable.

When any of $L^5$ to $L^8$ represents a substituted or unsubstituted aryl group having 6 to 15 carbon atoms, examples of the aryl group preferably include a phenyl group and a biphenyl group. Among them, a phenyl group is particularly preferable.

At least one of $L^5$ to $L^8$ has a structure represented by formula (C). $L^1$ and $L^2$ in formula (C) have the same definition with $L^1$ and $L^2$ in formula (A), and the preferable ranges of $L^1$ and $L^2$ in formula (C) are the same as those of formula (A).

As described above, $L^9$ and $L^{10}$ each independently represent a hydrogen atom, a substituted or unsubstituted alkyl group having 1 to 5 carbon atoms, a substituted or unsubstituted aralkyl group having 7 to 15 carbon atoms, or a substituted or unsubstituted aryl group having 6 to 15 carbon atoms.

When at least one of $L^9$ and $L^{10}$ is a substituted or unsubstituted alkyl group having 1 to 5 carbon atoms, the alkyl group is preferably an alkyl group having 1 to 5 carbon atoms, and particularly preferably an alkyl group having 1 to 3 carbon atoms.

When the alkyl group represented by $L^9$ or $L^{10}$ has a substituent, examples of the substituent include a hydroxyl group, an alkoxy group (preferably, an alkoxy group having 1 to 4 carbon atoms, and more preferably an alkoxy group having 1 to 3 carbon atoms), and specific examples of an alkoxy group as the substituent include a methoxy group, an ethoxy groups and a butoxy group. Among them, as the substituent on the alkyl group represented by $L^9$ and $L^{10}$, a methoxy group or an ethoxy group is particularly preferable.

When at least one of $L^9$ and $L^{10}$ is a substituted or unsubstituted aralkyl group having 7 to 15 carbon atoms, examples of the aralkyl group include a benzyl group and a phenethyl group.

When at least one of $L^9$ and $L^{10}$ is a substituted or unsubstituted aryl group having 6 to 15 carbon atoms, examples of the aryl group include a phenyl group, a biphenyl group, a dimethyl aminophenyl group and a diethyl aminophenyl group.

Specific examples of compounds represented by formula (A) or (B) are shown below, but the invention is not limited thereto. Here, (A-1) to (A-7) each represent specific examples of compounds represented by formula (A), and (B-1) to (B-22) each represent specific examples of compounds represented by formula (B).

(A-1)

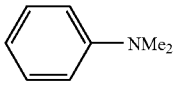

(A-2)

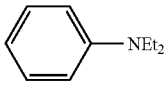

(A-3)

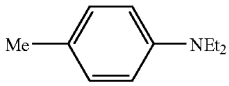

(A-4)

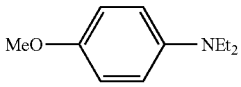

(A-5)

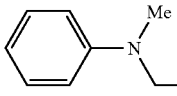

(A-6)

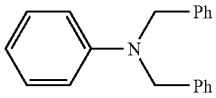

(A-7)

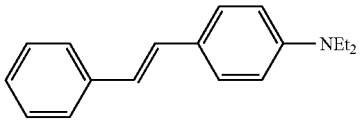

(B-1)

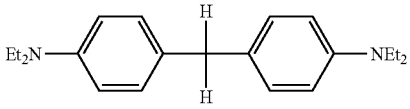

-continued (B-2)

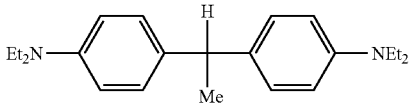

(B-3)

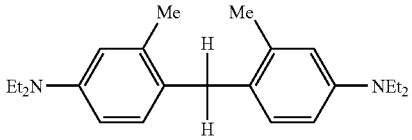

(B-4)

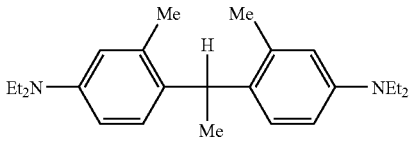

(B-5)

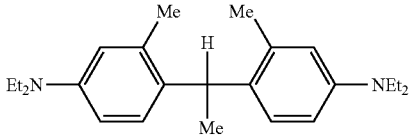

(B-6)

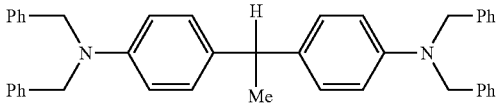

(B-7)

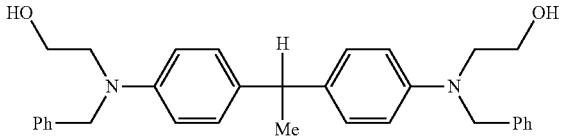

(B-8)

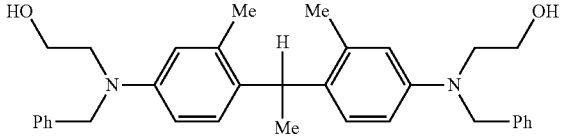

(B-9)

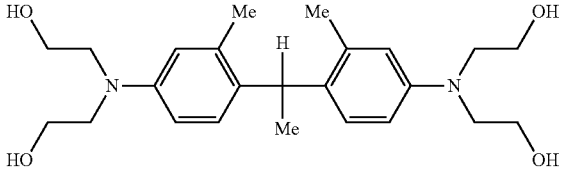

(B-10)

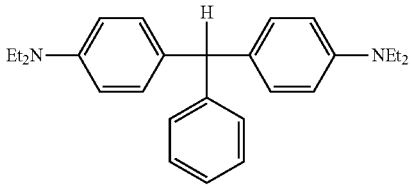

(B-11)

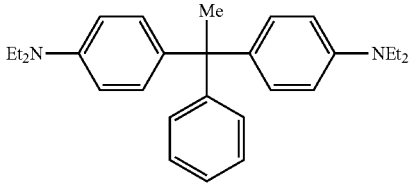

-continued (B-12)

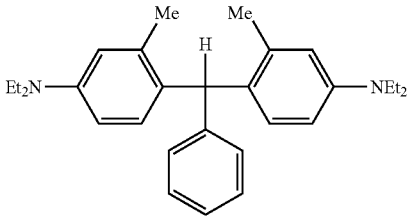

(B-13)

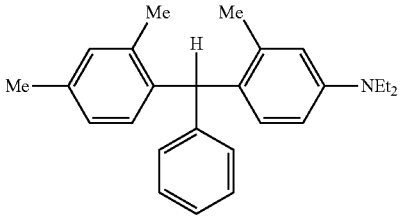

(B-14)

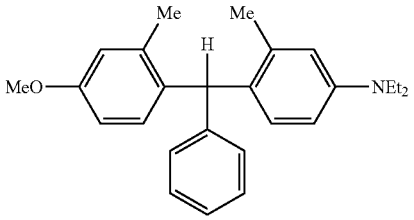

(B-15)

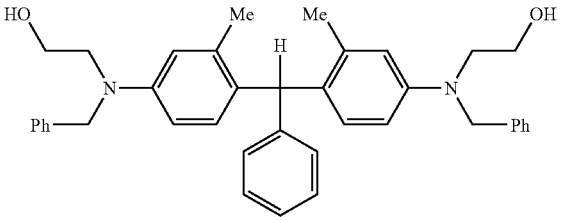

(B-16)

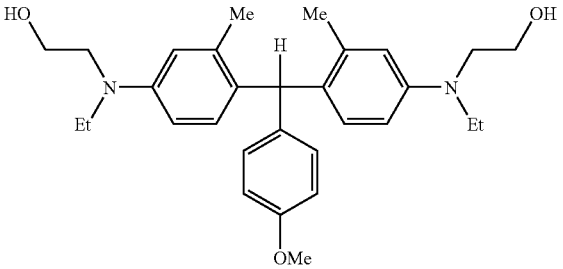

(B-17)

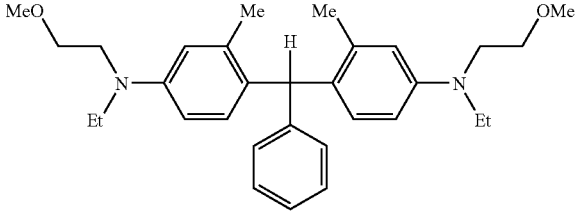

-continued (B-18)

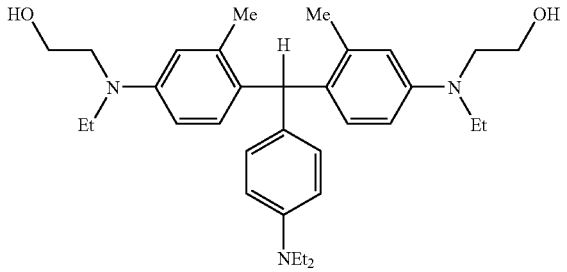

(B-19)

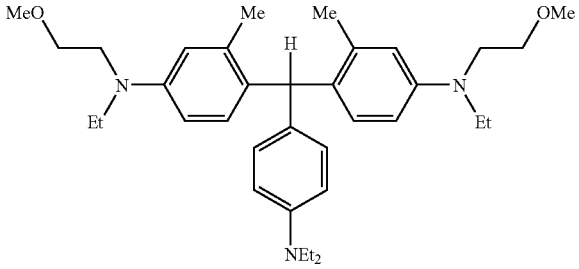

(B-20)

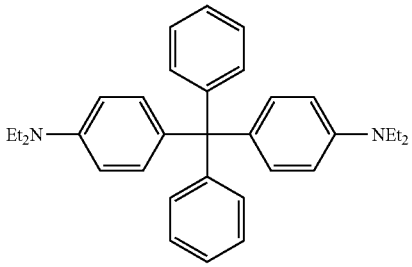

(B-21)

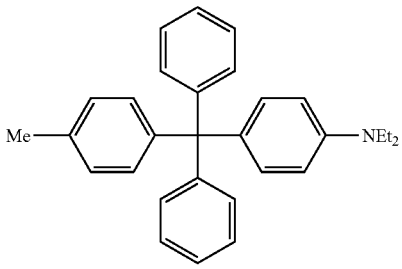

(B-22)

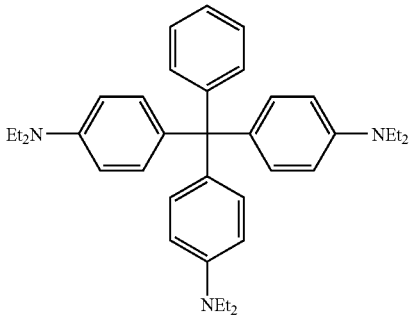

The compounds represented by formulae (A) or (B) may be used singly, but may be used in combination of two or more kinds thereof. In particular from the viewpoint of an excellent compatibility with a charge transporting material, it is preferable that the two or more kinds of compounds are used in combination, and it is also preferable that a compound having —OH group is used.

At least one compound obtained by the reaction of a compound represented by formulae (A) or (B) (a compound derived from a compound represented by formulae (A) or (B)) may be contained in an amount of from 0.1% by weight to 50% by weight, preferably from 0.2% by weight to 30% by weight, and more preferably from 0.5% by weight to 20% by weight, in the crosslinked product contained in the protective layer. When the at least one compound derived from a compound represented by formulae (A) or (B) is contained in the above range, the change in resistivity may be suppressed after the protective layer is exposed to light.

The charge transporting material contained in a protective layer (hereinafter may be referred to as "specific charge transporting material") will be described.

The specific charge transporting material preferably has at least one substituent selected from the group consisting of —OH, —$OCH_3$, —$NH_2$, —SH, and —COOH. The specific charge transporting material particularly preferably has at least two (more preferably at least three) substituents selected from the group consisting of —OH, —$OCH_3$, —$NH_2$, —SH, and —COOH. As the increase of the number of the reactive functional group (substituent) of the specific charge transporting material, the crosslinking density may increase, and the strength of the crosslinked film may increase. In particular, the running torque of the electrophotographic photoreceptor for a blade cleaner may be reduced, which reduces damages to the blade, and wear of the electrophotographic photoreceptor. The reason of this is not known, but is assumed that this is because the increase of the number of the reactive functional groups may increase the crosslinking density of the cured film, and the molecular motion on the outermost surface of the electrophotographic photoreceptor may be suppressed and the interaction with the molecules on the surface of the blade member may be weakened.

The specific charge transporting material may be for example a compound represented by formula (I).

$$F—((—R^1—X)_{n1}R^2—Y)_{n2} \quad (I)$$

In formula (I), F represents an organic group derived from a hole transporting compound, $R^1$ and $R^2$ each independently represent a linear or branched alkylene group having 1 to 5 carbon atoms, n1 represents 0 or 1, n2 represents an integer of 1 to 4, X represents an oxygen atom, NH, or a sulfur atom) and Y represents —OH, —$OCH_3$, —$NH_2$, —SH, or —COOH. Y is preferably —OH or —$OCH_3$.

In formula (I), the organic group represented by F is preferably derived from a hole transporting compound such as an arylamine derivative. Preferable examples of the arylamine derivative include triphenylamine derivatives, and tetraphenylbenzidine derivatives.

The compound represented by formula (I) is preferably the compound represented by formula (II). The compound represented by formula (II) is excellent in, in particular, stability toward charge mobility and oxidation.

(II)

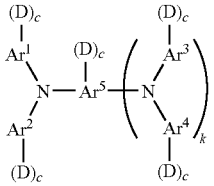

In formula (II), $Ar^1$ through $Ar^4$ may be the same or different from each other and each independently represent a substituted or unsubstituted aryl group, $Ar^5$ represents a substituted or unsubstituted aryl group or a substituted or unsubstituted arylene group, D represents —(—$R^1$—X)$_{n1}$ $R^2$—Y, c represents 0 or 1, k represents 0 or 1, the total number of D is 1 or more and 4 or less; $R^1$ and $R^2$ each independently represent a linear or branched alkylene group having 1 to 5 carbon atoms, n1 represents 0 or 1, X represents an oxygen atom, NH, or a sulfur atom, and Y represents —OH, —$OCH_3$, —$NH_2$, —SH, or —COOH.

In formula (II), "—(—$R^1$—X)$_{n1}R^2$—Y" represented by D is the same as that in formula (I), and $R^1$ and $R^2$ each independently represent a linear or branched alkylene group having 1 to 5 carbon atoms. n1 is preferably 1. X is preferably oxygen. Y is preferably a hydroxy group. The total number of D in formula (II) corresponds to n2 in formula (I), and is preferably 2 or more and 4 or less, and more preferably 3 or more and 4 or less. In formulae (I) and (II), when the total number of D is preferably 2 or more and 4 or less, and more preferably 3 or more and 4 or less in one molecule, the crosslinking density increases, and thus a stronger crosslinked film is formed. In particular, the running torque of the electrophotographic photoreceptor for a blade cleaner is reduced, which reduces damages to the blade, and wear of the electrophotographic photoreceptor. The reason of this is not known, but is assumed that this is because the increase of the number of the reactive functional groups may increase the crosslinking density of the cured film, and the molecular motion on the outermost surface of the electrophotographic photoreceptor may be suppressed and the interaction with the molecules on the surface of the blade member may be weakened.

In formula (II), $Ar_1$ through $Ar_4$ are preferably represented by any one from formulae (1) through (7). The formulae (1) through (7) are shown together with "-$(D)_c$" which may be linked to $Ar_1$ through $Ar_4$.

(1)

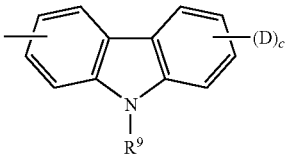

(2)

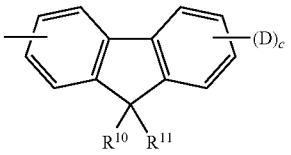

(3)

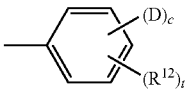

(4)

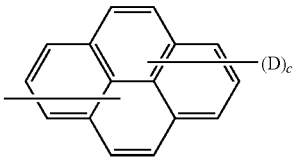

(5)

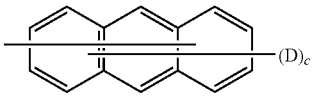

-continued (6)

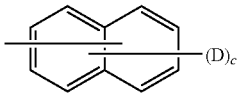

(7)

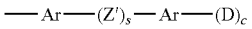

In formulae (1) to (7), $R^9$ represents one selected from the group consisting of a hydrogen atom, an alkyl group having 1 to 4 carbon atoms, a phenyl group substituted by an alkyl group having 1 to 4 carbon atoms or an alkoxy group having 1 to 4 carbon atoms, an unsubstituted phenyl group, and an aralkyl group having 7 to 10 carbon atoms, $R^{10}$ through $R^{12}$ each independently represent a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom. Ar represents a substituted or unsubstituted arylene group, D and C have the same meanings as "D" and "c" in formula (II), s represents 0 or 1, and t represents an integer from 1 to 3.

In formula (7), Ar is preferably any one represented by the following formula (8) or (9).

(8)

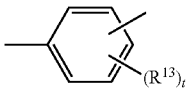

(9)

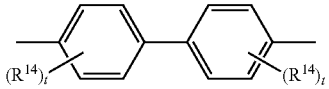

In formulae (8) and (9), $R^{13}$ and $R^{14}$ each independently represent one selected from the group consisting of a hydrogen atom, an alkyl group having 1 to 4 carbon atoms, an alkoxy group having 1 to 4 carbon atoms, a phenyl group substituted by an alkoxy group having 1 to 4 carbon atoms, an unsubstituted phenyl group, an aralkyl group having 7 to 10 carbon atoms, and a halogen atom, and t represents an integer from 1 to 3.

In formula (7), Z' is preferably any one represented by one selected from formulae (10) through (17).

(10)

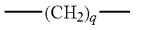

(11)

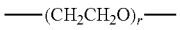

(12)

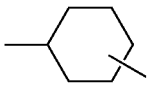

(13)

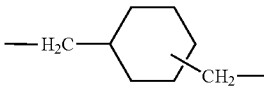

(14)

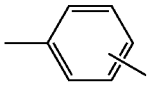

-continued (15)

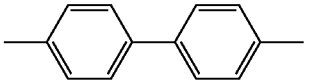

(16)

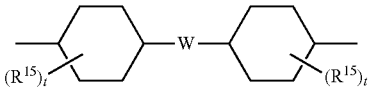

(17)

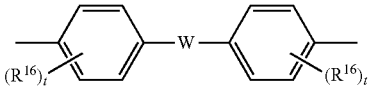

In formulae (10) through (17), $R^{15}$ and $R^{16}$ each independently represent one selected from the group consisting of a hydrogen atom, an alkyl group having 1 to 4 carbon atoms, an alkoxy group having 1 to 4 carbon atoms, a phenyl group substituted by an alkoxy group having 1 to 4 carbon atoms, an unsubstituted phenyl group, an aralkyl group having 7 to 10 carbon atoms, and a halogen atom, W represents a divalent group, q and r each independently represent an integer from 1 to 10, t represents an integer from 1 to 3.

In formulae (16) and (17), W is preferably a divalent group represented by any one of formulae (18) through (26). In formula (25), u represents an integer from 0 to 3.

(18)

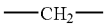

(19)

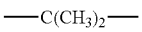

(20)

(21)

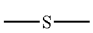

(22)

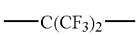

(23)

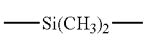

(24)

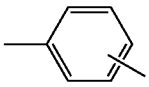

(25)

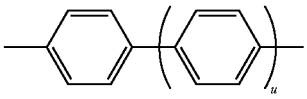

(26)

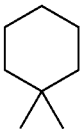

In formula (II), when k is 0, $Ar^5$ is an aryl group of any of (1) through (7) as exemplified for $Ar^1$ through $Ar^4$, and when k is 1, $Ar^5$ is an arylene group obtained by removing a hydrogen atom from the aryl group of (1) through (7).

Specific examples of the compound represented by formula (I) include the following compounds (I)-1 through (I)-34. The compound represented by formula (I) is not limited to the followings.

I-1
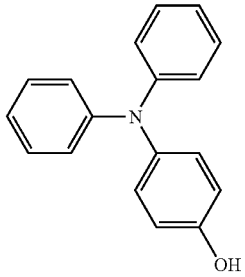
I-2
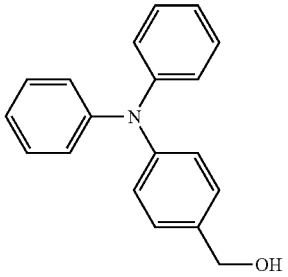
I-3
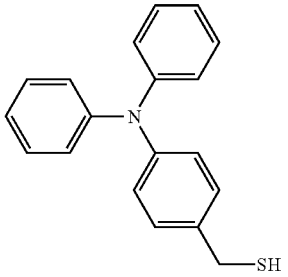
I-4
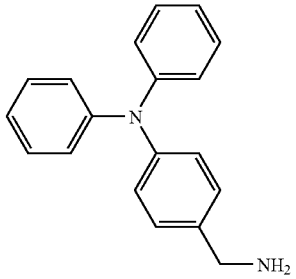
I-5
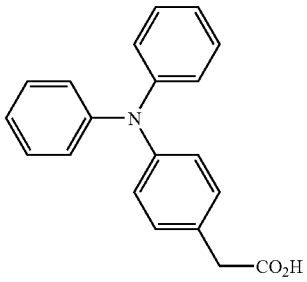
-continued
I-6
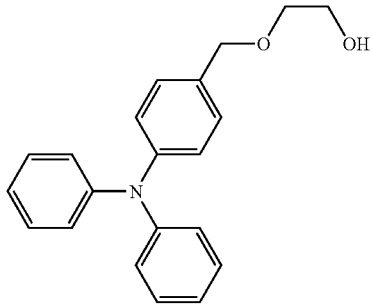
I-7
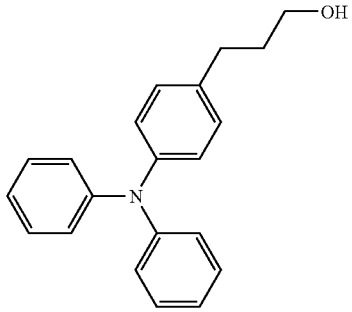
I-8
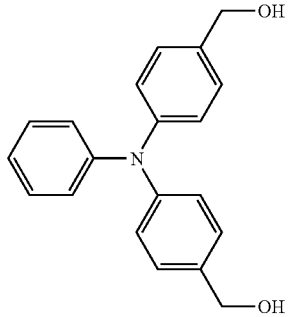
I-9
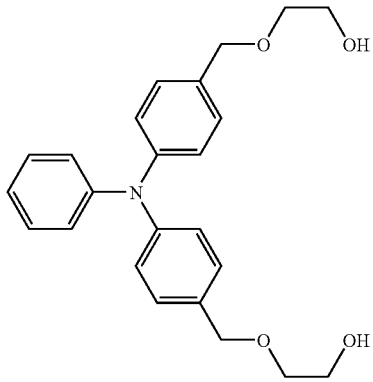

-continued
I-10
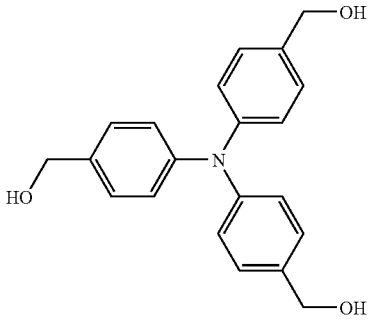
I-11
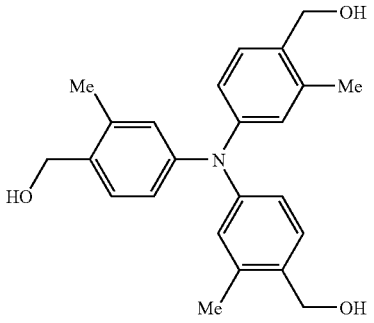
I-12
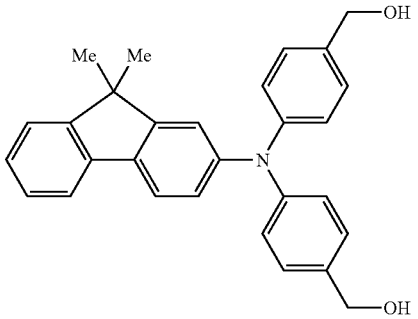
I-13
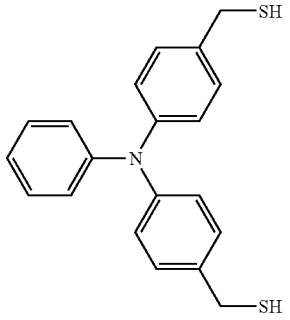
-continued
I-14
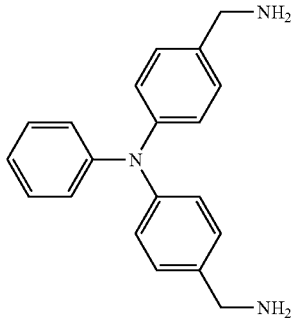
I-15
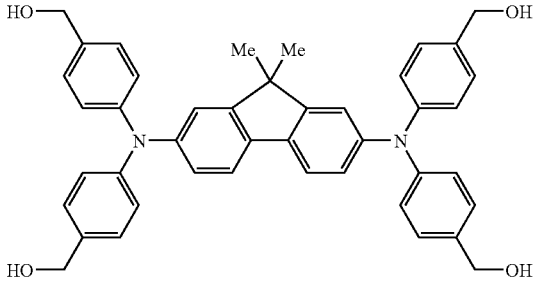
I-16
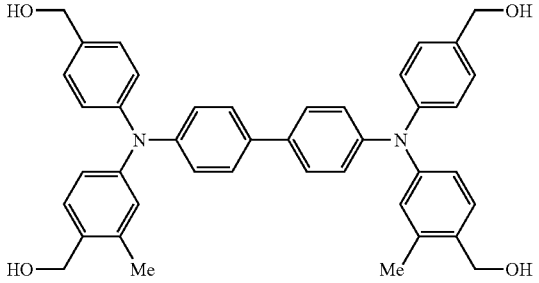
I-17
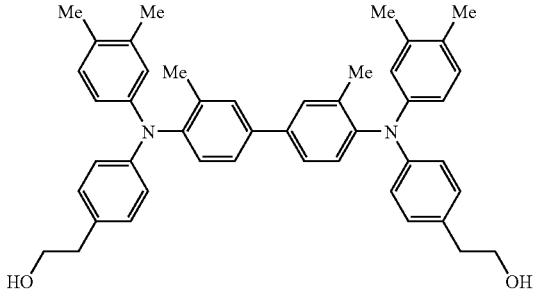

-continued
I-18
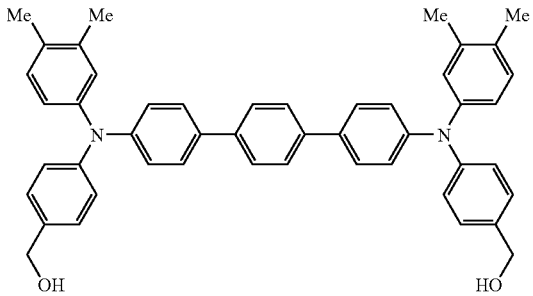
I-19
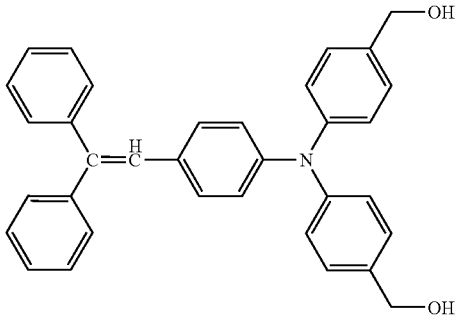
I-20
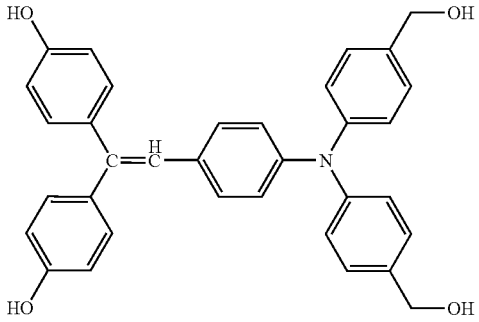
I-21
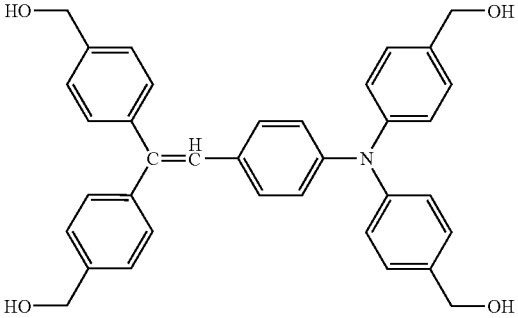
-continued
I-22
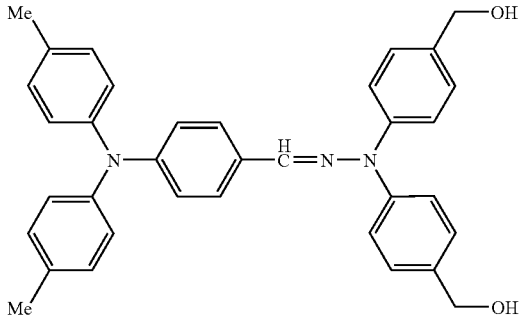
I-23
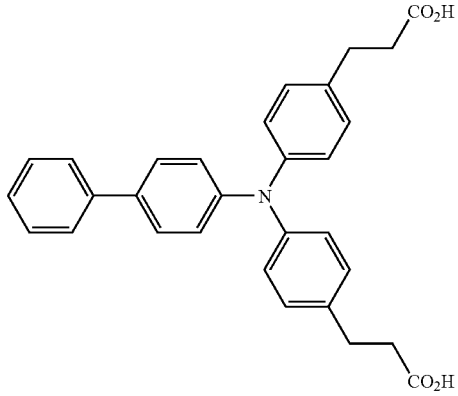
I-24
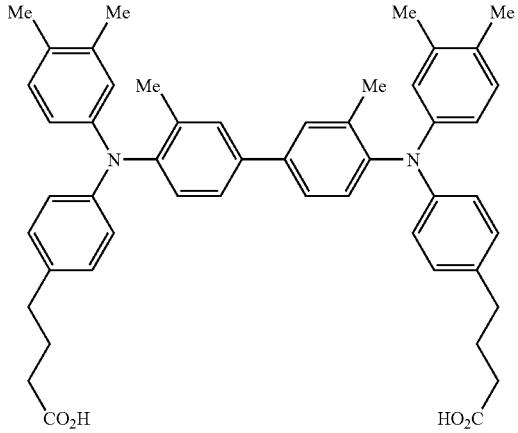
I-25
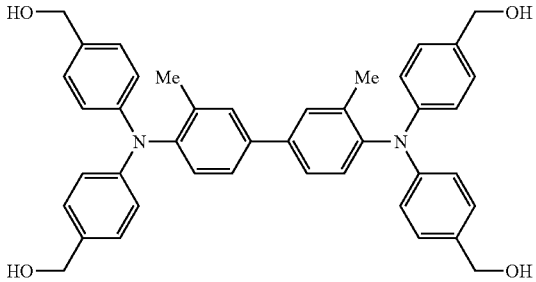

-continued
I-26
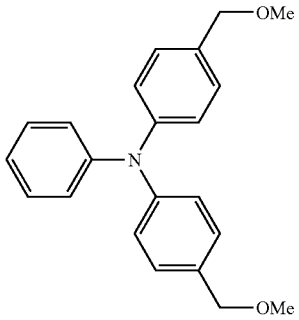
I-27
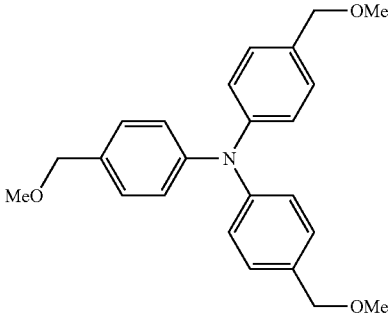
I-28
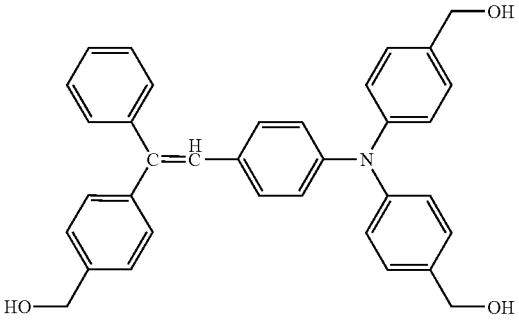
I-29
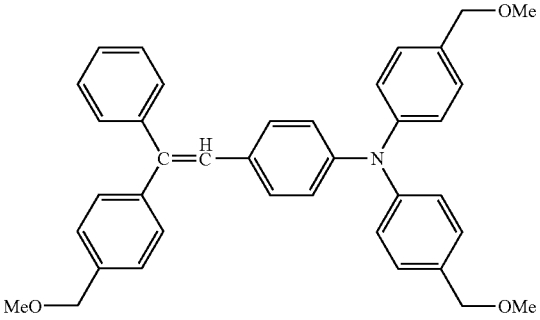
-continued
I-30
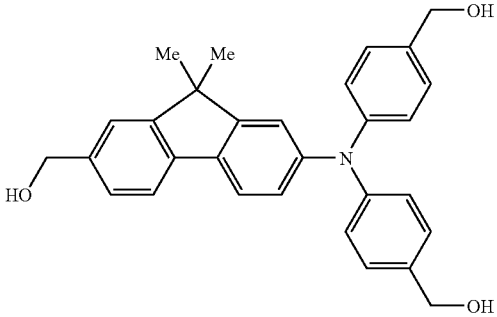
I-31
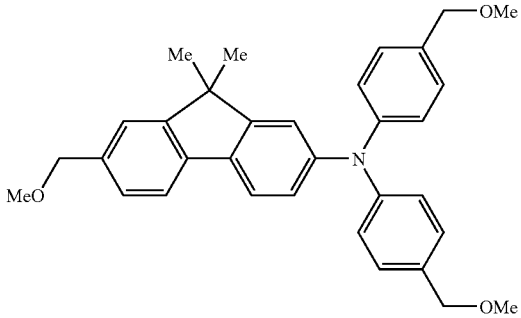
I-32
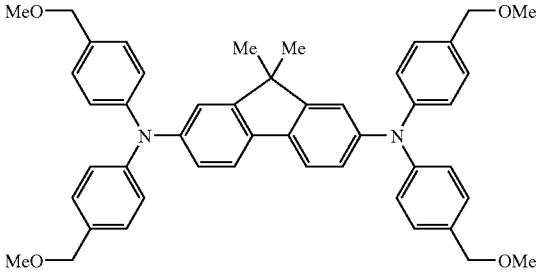
I-33
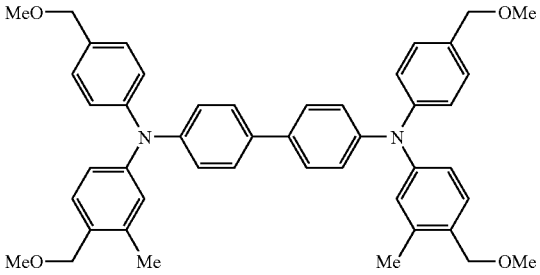
I-34
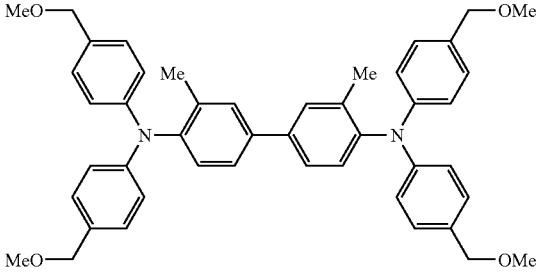

Among compounds (I)-1 through (I)-34, which are specific examples of compounds represented by formula (I), compounds (I)-2, (I)-8, (I)-10, (I)-11, (I)-12, (I)-15, (I)-16, (I)-18, (I)-19, (I)-20, (I)-21, (I)-22, (I)-25, (I)-28 and (I)-30 are preferable.

At least one compound obtained by the reaction of the charge transporting material (a compound derived from the charge transporting material) is preferably contained in an amount of at least 50% by weight or at least about 50% by weight, more preferably at least 70% by weight or at least about 70% by weight, and still more preferably at least 80% by weight or at least about 80% by weight, relative to the crosslinked product contained in the protective layer 5. If the content of the at least one compound derived from the charge transporting material is in the above described ranges, excellent electric characteristics may be obtained and the film thickness may be improved.

Further, a surfactant is preferably added to the protective layer 5. The surfactant to be used is not specifically limited as long as the surfactant contains a structure including at least one of a fluorine atom, an alkyleneoxide structure and a silicone structure, but the surfactant preferably contains more than one of the structures, because the surfactant has a high affinity for and compatibility with a charge transporting organic compound, so that the layer-forming property of the coating liquid of the protective layer may be improved and the occurrence of wrinkles and unevenness of the protective layer 5 may be suppressed.

Various kinds of surfactants containing a fluorine atom can be exemplified. Specific examples of surfactants containing a fluorine atom and an acrylic structure include, for example, POLYFLOW KL600 ((trade name) manufactured by Kyoeisha Chemical Co., Ltd.), and EFTOP EF-351, EF-352, EF-801, EF-802 and EF601 ((trade names) manufactured by JEMCO Inc.). Typical examples of the surfactants having an acrylic structure include surfactants obtained by polymerizing or copolymerizing monomers such as acrylic or methacrylic compounds.

Further, examples of the surfactants having a perfluoroalkyl group as a group containing fluorine atoms include perfluoroalkyl sulfonic acids (for example, perfluorobutane sulfonic acid and perfluorooctane sulfonic acid), perfluoroalkyl carboxylic acids (for example, perfluorobutane carboxylic acid and perfluorooctane carboxylic acid) and perfluoroalkyl group-containing phosphoric esters. The perfluoroalkyl sulfonic acids and the perfluoroalkyl carboxylic acids may be the salts or the amide-modified products thereof.

Examples of commercially available products of perfluoroalkyl sulfonic acids include, MEGAFACE F-114 ((trade name) manufactured by DIC Corporation), EFTOP EF-101, EF-102, EF-103, EF-104, EF-105, EF-112, EF-121, EF-122A, EF-122B, EF-122C and EF-123A ((trade names) manufactured by JEMCO Inc.), and FTERGENT A-K and FTERGENT 501 ((trade names) manufactured by NEOS Co., Ltd.).

Examples of commercially available products of perfluoroalkyl carboxylic acids include MEGAFACE F-410 ((trade name) manufactured by DIC Corporation), EFTOP EF-201 and EF-204 ((trade names) manufactured by JEMCO Inc.).

Examples of commercially available products of perfluoroalkyl group-containing phosphoric esters include, for example, MGAFACE F-493 and F-494 ((trade names) manufactured by DIC Corporation), EFTOP EF-123A, EF-123B, EF-125M and EF-132 ((trade names) manufactured by JEMCO Inc.).

Examples of the surfactant having an alkylene oxide structure include a polyethylene glycol, a polyether defoaming agent and a polyether-modified silicone oil. The polyethylene glycol has preferably a number average molecular weight of 2,000 or less, and examples of the polyethylene glycol having a number average molecular weight of 2,000 or less include polyethylene glycol 2000 (number average molecular weight of 2,000), polyethylene glycol 600 (number average molecular weight of 600), polyethylene glycol 400 (number average molecular weight of 400) and polyethylene glycol 200 (number average molecular weight of 200).

Further, examples of the polyether defoaming agent include PE-M and PE-L ((trade names) manufactured by Wako Pure Chemical Industries, Ltd.), and examples of the defoaming agent include Defoaming Agent No. 1 and Defoaming Agent No. 5 ((product names) manufactured by Kao Corporation).

Examples of the surfactant having a silicone structure include commonly used silicone oils, such as dimethyl silicone, methyl phenyl silicone, diphenyl silicone, and derivatives thereof.

Examples of surfactants having both of the fluorine atom and the alkylene oxide structure include a surfactant having an alkylene oxide structure or a polyalkylene structure at the side chain thereof, and a surfactant having an alkylene oxide structure or a polyalkylene structure substituted by a substituent containing a fluorine atom at the terminal end thereof. Specific examples of the surfactants having an alkylene oxide structure include MEGAFACE F-443, F-444, F-445 and F-446 ((trade names) manufactured by DIC Corporation), and POLY FOX PF636, PF6320, PF6520 and PF656 ((trade names) manufactured by Kitamura Chemicals Co., Ltd.).

Examples of surfactants having both of the alkylene oxide structure and the silicone structure include KF351(A), KF352 (A), KF353(A), KF354(A), KF355(A), KF615(A), KF618, KF945(A) and KF6004 ((trade names) manufactured by Shin-Etsu Chemical Co., Ltd.), TSF4440, TSF4445, TSF4550, TSF4446, TSF4452, TSF4453 and TSF4460 ((trade names) manufactured by GE Toshiba Silicone Co., Ltd.), BYK-300, 302, 306, 307, 310, 315, 320, 322, 323, 325, 330, 331, 333, 337, 341, 344, 345, 346, 347, 348, 370, 375, 377, 378, UV3500, UV3510 and UV3570 ((trade names) manufactured by BYK-Chemie Japan K.K.).

The content of the surfactants is preferably from 0.01% by weight to 1% by weight, and more preferably from 0.02% by weight to 0.5% by weight. When the content of the surfactant containing a fluorine atom is 0.01% by weight or more, the effect of preventing defects such as wrinkles and unevenness of a coated layer tends to be enhanced. Further, when the content of the surfactant containing a fluorine atom is 1% by weight or less, the separation between the surfactant containing a fluorine atom and a curable resin is not apt to arise, so that the strength of the resultant cured product tends to be maintained.

The protective layer 5 of the invention may further include another coupling agent or a fluorine compound for controlling the properties such as film-forming ability flexibility, lubricity, and adhesiveness of the film. Examples of such compounds include various silane coupling agents, and commercially available silicone-based hard coat agents.

Examples of the silane coupling agents include vinyltrichlorosilane, vinyltrimethoxysilane, vinyltriethoxysilane, γ-glycidoxypropylmethyldiethoxysilane, γ-glycidoxypropyltrimethoxysilane, γ-aminopropyltriethoxysilane, γ-aminopropyltrimethoxysilane, γ-aminopropylmethyldimethoxysilane, N-β(aminoethyl)-γ-aminopropyltriethoxysilane, tetramethoxysilane, methyltrimethoxysilane and dimethyldimethoxysilane. Examples of the commercially available hard coating agent include KP-85, X-40-9740, X-8239 (manufactured by Shin-Etsu Chemical Co., Ltd.), AY42-440, AY42-441, and AY49-208 (manufactured by Toray Dow Corning Silicone Co. Ltd.). In order to impart water repellency, fluorine-containing compounds such as (tridecafluoro-1,1,2,2-tetrahydrooctyl)triethoxysilane, (3,3,3-trifluoropropyl)trimethoxysilane, 3-(heptafluoroisopropoxy) propyltriethoxysilane, 1H,1H,2H,2H-perfluoroalkyltriethoxysilane, 1H,1H,2H,2H-perfluorodecyltriethoxysilane, and 1H,1H,2H,2H-perfluorooctyltriethoxysilane may be added. The amount of the silane coupling agent may be determined as appropriate. However, the amount of the fluorine-containing compound is preferably 0.25 times by weight or lower, with respect to the fluorine-free compounds. If the amount of the fluorine-containing compound exceeds the above range, the film-forming ability of the crosslinked film may be impaired.

Resins that are soluble in alcohols may also be added to the protective layer 5 for the purposes such as controlling of the discharge gas resistance mechanical strength, scratch resistance particle dispersibility and viscosity; reduction of the torque; controlling of the abrasive wear; extending a pot life; and others.

The alcohol-soluble resin means a resin soluble in an alcohol having 5 or less carbon atoms at a ratio of 1% by weight or more.

Examples of the resins that are soluble in an alcohol-based solvent include thermoplastic resins such as polyvinylbutyral resins, polyvinylformal resins, polyvinylacetal resins such as partially acetalized polyvinylacetal resins having butyral partially modified by formal or acetoacetal (for example, S-LEC B and K series, manufactured by Sekisui Chemical Co., Ltd.), polyamide resins, cellulose resins and polyvinylphenolic resins. Among these resins, although polyamide resins may be effective in preventing concentration changes after light exposure, when using a polyamide resin, electric characteristics may be deteriorated when the thickness is 5 μm or more, and therefore there may be a difficulty in obtaining a thickened film. The weight average molecular weight of the resin is preferably 2,000 to 100,000, more preferably 5,000 to 50,000. If the molecular weight of the resin is less than 2,000, effects achieved by adding of the resin may not be sufficient, and if exceeds 100,000, the solubility of the resin may lower to limit the content of the resin, which may affect film forming ability during application. Examples of the resin further include thermosetting resins such as phenolic resins, melamine resins, benzoguanamine resins, urea resins, and alkyd resins. In particular, polyvinyl acetal resins, polyvinyl phenolic resins, melamine resins, and benzoguanamine resins are preferable from the viewpoint of electrical characteristics. Copolymerizing a compound having a larger number of functional groups in one molecule, such as a spiro-acetal type guanamine resin (for example, "CTU-GUANAMINE" (manufacturer: Ajinomoto Fine Techno Co., Inc), into materials of the crosslinked product may also be effective. The content of the resin in the crosslinked film may be 20% by weight or less, preferably 10% by weight or less, from the view point of electric characteristics.

In order to prevent the deterioration of the protective layer 5 caused by oxidizing gas such as ozone that is generated by the charging device, it is preferable to add an antioxidant to the protective layer 5. Higher resistance to oxidization than ever is required for a photoreceptor having enhanced surface mechanical strength and longer operating life, since the photoreceptor tends to be exposed to oxidizing gas for the longer period of time. Preferable examples of the antioxidants include hindered phenol-based or hindered amine-based antioxidants, and known antioxidants such as organic sulfur-based antioxidant, phosphite-based antioxidants, dithiocarbamate-based antioxidants, thiourea-based antioxidants and benzimidazole-based antioxidants also may be used. The content of the antioxidant is preferably 20% by weight or less, more preferably 10% by weight or less.

Examples of the hindered phenol-based antioxidant include 2,6-di-t-butyl-4-methylphenol, 2,5-di-t-butylhydroquinone, N,N'-hexamethylene bis(3,5-di-t-butyl-4-hydroxyhydrocinnamate, 3,5-di-t-butyl-4-hydroxy-benzylphosphonate-diethylester, 2,4-bis[(octylthio)methyl]-o-cresol, 2,6-di-t-butyl-4-ethylphenol, 2,2'-methylenebis(4-methyl-6-t-butylphenol), 2,2'-methylenebis(4-ethyl-6-t-butylphenol), 4,4'-butylidenebis(3-methyl-6-t-butylphenol), 2,5-di-t-amythydroquinone, 2-t-butyl-6-(3-butyl-2-hydroxy-5-methylbenzyl)-4-methylphenylacrylate, and 4,4'-butylidenebis(3-methyl-6-t-butylphenol).

In order to decrease the residual potential or improve the strength, the protective layer 5 may include various particles. An example of the particles is silicon-containing particles. The silicon-containing particles include silicon as the constituent element, and specific examples thereof include colloidal silica and silicone particles. The colloidal silica used as silicon-containing particles is a dispersion of silica having an average particle diameter of 1 nm or more and 100 nm or less, preferably 10 nm or more and 30 nm or less in an acidic or alkaline aqueous dispersion, or an organic solvent such as alcohol, ketone, or ester, and may be commercially available one. The solid content of the colloidal silica in the protective layer 5 is not particularly limited, but preferably 0.1% by weight or more and 50% or less by weight, preferably 0.1% by weight or more and 30% or less by weight with respect to the total solid content of the protective layer 5 from the viewpoints of film-forming ability, electrical characteristics, and strength.

The silicone particles used as the silicon-containing particles may be selected from the common commercially available products of silicone resin particles, silicone rubber particles and silicone surface-treated silica particles. These silicone particles are spherical, and preferably have an average particle diameter of 1 to 500 nm, more preferably 10 to 100 nm. By using the silicone particles, the surface properties of an electrophotographic photoreceptor can be improved without inhibiting the crosslinking reaction, since the particles can exhibit an excellent dispersibility to resin because of being small in diameter and chemically inactive, and further, the content of the silicone particles required to achieve desirable characteristics is small. More specifically, the particles are incorporated into the strong crosslinking structure without causing variation, and thereby enhancing the lubricity and water repellency of the surface of the electrophotographic photoreceptor, and maintaining the favorable abrasion resistance and stain resistance over the long time. The content of the silicone particles in the protective layer 5 is preferably 0.1 to 30% by weight, more preferably 0.5 to 10% by weight relative to the total solid content in the protective layer 5.

Other examples of the particles include: fluorine particles such as ethylene tetrafluoride, ethylene trifluoride, propylene hexafluoride, vinyl fluoride, and vinylidene fluoride; the particles as described in the proceeding of the 8th Polymer Material Forum Lecture, p. 89, the particles composed of a resin prepared by copolymerization of a fluorocarbon resin with a hydroxy group-containing monomer; and semiconductive metal oxides such as $ZnO—Al_2O_3$, $SnO_2—Sb_2O_3$, $In_2O_3—SnO_2$, $ZnO_2—TiO_2$, $ZnO—TiO_2$, $MgO—Al_2O_3$, FeO—

$TiO_2$, $TiO_2$, $SnO_2$, $In_2O_3$, ZnO, and MgO. For the same purpose, an oil such as a silicone oil may be added. Examples of the silicone oil include: silicone oils such as dimethylpolysiloxane, diphenylpolysiloxane, and phenylmethylsiloxane; reactive silicone oils such as amino-modified polysiloxane, epoxy-modified polysiloxane, carboxyl-modified polysiloxane, carbinol-modified polysiloxane, methacryl-modified polysiloxane, mercapto-modified polysiloxane, and phenol-modified polysiloxane; cyclic dimethylcyclosiloxanes such as hexamethylcyclotrisiloxane, octamethylcyclotetrasiloxane, decamethylcyclopentasiloxane, and dodecamethylcyclohexasiloxane; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane, and 1,3,5,7,9-pentamethyl-1,3,5,7,9-pentaphenylcyclopentasiloxane; cyclic phenylcyclosiloxanes such as hexaphenylcyclotrisiloxane; fluorine-containing cyclosiloxanes such as (3,3,3-trifluoropropyl)methylcyclotrisiloxane; hydrosilyl group-containing cyclosiloxanes such as a methylhydrosiloxane mixture, pentamethylcyclopentasiloxane, and phenylhydrocyclosiloxane; and vinyl group-containing cyclosiloxanes such as pentavinylpentamethylcyclopentasiloxane.

The protective layer 5 may further include a metal, a metal oxide, and carbon black. Examples of the metal include aluminum, zinc, copper, chromium, nickel, silver and stainless steel, and metal-evaporated plastic particles plated with these metals. Examples of the metal oxide include zinc oxide, titanium oxide, tin oxide, antimony oxide, indium oxide, bismuth oxide, tin-doped indium oxide, antimony-doped or tantalum-doped tin oxide, and antimony-doped zirconium oxide. These metals, metal oxides and carbon black may be used alone or as a mixture of two or more kinds thereof. When two or more kinds thereof are combined, they may be simply mixed or made into a solid solution or a fusion. The average particle diameter of the conductive particles is preferably 0.3 μm or less, particularly preferably 0.1 μm or less from the viewpoint of transparency of the protective layer.

The acidic substance contained in the crosslinked product contained in the protective layer will be described.

For the protective layer 5, a curing catalyst for accelerating curing may be used. As the curing catalyst, an acid catalyst may be preferably used. This acid catalyst may function as a catalyst when the crosslinked product is formed from at least one charge transporting material as described above, at least one compound selected from the group consisting of compounds represented by formula (A) and compounds represented by formula (B) as described above, and remains as an acidic substance in the protective layer containing the crosslinked product.

Examples of the acid catalyst include: aliphatic carboxylic acids such as acetic acid, chloroacetic acid, trichloroacetic acid, trifluoroacetic acid, oxalic acid, maleic acid, malonic acid, and lactic acid; aromatic carboxylic acids such as benzoic acid, phthalic acid, terephthalic acid, and trimellitic acid; and aliphatic or aromatic sulfonic acids such as methanesulfonic acid, dodecylsulfonic acid, benzenesulfonic acid, dodecylbenzenesulfonic acid, naphthalenesulfonic acid and p-toluenesulfonic acid. Sulfur-containing materials are preferable from the view point of obtaining a protective layer having an improved mechanical strength, due to strong acidity. Among these, materials containing a sulfonic acid group are preferable from the view point of obtaining a protective layer having an improved mechanical strength.

In other words, when a sulfur-containing material is used as the curing catalyst, the sulfur-containing material exhibits excellent functions as the curing catalyst, and accelerates the curing reaction, thereby improving the mechanical strength of the resultant protective layer 5. When the compound represented by formula (I) (including formula (II)) is used as the charge transporting material, the sulfur-containing material also exhibits excellent functions as a dopant for the charge transporting material, and improves the electrical characteristics of the resultant functional layer. As a result of this, the resultant electrophotographic photoreceptor has high levels of mechanical strength, film-forming ability, and electrical characteristics.

When the acidity of the acid catalyst is stronger, such as a sulfur-containing material as described above, the mechanical strength of the protective layer may be higher. However, this may increase concern that due to the influence of the acidic substance remained after the formation of a protective layer, the reduction in the resistance in the light-exposed area of the protective layer may be caused. However, as described above, it is presumed that, due to the compound represented by formulae (A) or (B) that is used for the crosslinked product contained in the protective layer in an exemplary embodiment of the present invention, holes generated by the transition of valance electrons between the charge transporting material and the acidic substance may be stably retained by the compound represented by formula (A) or (B). Therefore, it is presumed that the reduction in the resistance due to the light exposure may be suppressed, and further, the higher mechanical strength may be achieved and the occurrence of the image unevenness corresponding to the hysteresis of the light exposure in the electrophotographic photoreceptor may also be suppressed.

The sulfur-containing material as the curing catalyst is preferably acidic at normal temperature (for example, 25° C.) or after heating, and is most preferably at least one of organic sulfonic acids and derivatives thereof from the viewpoints of adhesiveness, ghost resistance, and electrical characteristics. The presence of the catalyst in the protective layer 5 is readily detected by, for example, XPS.

Examples of the organic sulfonic acids and/or the derivatives thereof include p-toluenesulfonic acid, dinonylnaphthalenesulfonic acid (DNNSA), dinonylnaphthalenedisulfonic acid (DNNDSA), dodecylbenzenesulfonic acid and phenolsulfonic acid, and most preferred are p-toluenesulfonic acid and dodecylbenzenesulfonic acid from the viewpoint of catalytic activity and film-forming property. The salts of the organic sulfonates may also be used, as long as they can dissociate to some degree in the curable resin composition.

By using a so-called heat latent catalyst that exhibits an increased degree of catalytic activity when a temperature of a certain degree or more is applied, both of the lowering of curing temperature and the storage stability can be achieved, since the catalytic activity at a temperature at which the liquid is in storage is low, while the catalytic activity at the time of curing is high.

Examples of the heat latent catalyst include the microcapsules in which an organic sulfone compound or the like are coated with a polymer in the form of particles, porous compounds such as zeolite onto which an acid or the like is adsorbed, heat latent protonic acid catalysts in which a protonic acid and/or a derivative thereof are blocked with a base, a protonic acid and/or a derivative thereof esterified by a primary or secondary alcohol, a protonic acid and/or a derivative thereof blocked with a vinyl ether and/or a vinyl thioether, monoethyl amine complexes of boron trifluoride, and pyridine complexes of boron trifluoride.

From the viewpoint of catalytic activity, storage stability, availability and cost efficiency, the protonic acid and/or the derivative thereof that are blocked with a base are preferably used.

Examples of the protonic acid of the heat latent protonic acid catalyst include sulfuric acid, hydrochloric acid, acetic acid, formic acid, nitric acid, phosphoric acid, sulfonic acid, monocarboxylic acid, polycarboxylic acids, propionic acid, oxalic acid, benzoic acid, acrylic acid, methacrylic acid, itaconic acid, phthalic acid, maleic acid, benzene sulfonic acid, o-, m-, p-toluenesulfonic acid, styrenesulfonic acid, dinonylnaphthalenesulfonic acid, dinonylnaphthalenedisulfonic acid, decylbenzenesulfonic acid, undecylbenzenesulfonic acid, tridecylbenzenesulfonic acid, tetradecylbenzenesulfonic acid and dodecylbenzenesulfonic acid. Examples of the protonic acid derivatives include neutralized alkali metal salts or alkali earth metal salts of protonic acids such as sulfonic acid and phosphoric acid, and polymer compounds in which a protonic acid skeleton is incorporated into a polymer chain (e.g., polyvinylsulfonic acid). Examples of the base to block the protonic acid include amines.

The amines are classified into primary, secondary, and tertiary amines. In the invention, any of these amines can be used without limitation.

Examples of the primary amines include methylamine, ethylamine, propylamine, isopropylamine, n-butylamine, isobutylamine, t-butylamine, hexylamine, 2-ethylhexylamine, secondary butylamine, allylamine and methylhexylamine.

Examples of the secondary amines include dimethylamine, diethylamine, di-n-propylamine, diisopropylamine, di-n-butyl amine, diisobutyl amine, di-t-butylamine, dihexylamine, di(2-ethylhexyl)amine, N-isopropyl N-isobutylamine, di(2-ethylhexyl)amine, disecondarybutylamine, diallylamine, N-methylhexylamine, 3-pipecholine, 4-pipecholine, 2,4-lupetidine, 2,6-lupetidine, 3,5-lupetidine, morpholine, and N-methylbenzylamine.

Examples of the tertiary amines include trimethylamine, triethylamine, tri-n-propylamine, triisopropylamine, tri-n-butylamine, triisobutylamine, tri-t-butylamine, trihexylamine, tri(2-ethylhexyl)amine, N-methyl morpholine, N,N-dimethylallylamine, N-methyl diallylamine, triallylamine, N,N-dimethylallylamine, N,N,N',N'-tetramethyl-1,2-diaminoethane, N,N,N',N'-tetramethyl-1,3-diaminopropane, N,N,N',N'-tetraallyl-1,4-diaminobutane, N-methylpiperidine, pyridine, 4-ethylpyridine, N-propyldiallylamine, 3-dimethylaminopropanol, 2-ethylpyrazine, 2,3-dimethylpyrazine, 2,5-dimethylpyrazine, 2,4-lutidine, 2,5-lutidine, 3,4-lutidine, 3,5-lutidine, 2,4,6-collidine, 2-methyl-4-ethylpyridine, 2-methyl-5-ethylpyridine, N,N,N',N'-tetramethylhexamethylenediamine, N-ethyl-3-hydroxypiperidine, 3-methyl-4-ethylpyridine, 3-ethyl-4-methylpyridine, 4-(5-nonyl)pyridine, imidazole and N-methylpiperazine.

Examples of the commercially available products include NACURE 2501 (toluenesulfonic acid dissociation, methanol/isopropanol solvent, pH; 6.0 to 7.2, dissociation temperature; 80° C.), NACURE 2107 (p-toluenesulfonic acid dissociation, isopropanol solvent, pH; 8.0 to 9.0, dissociation temperature; 90° C.), NACURE 2500 (p-toluenesulfonic acid dissociation, isopropanol solvent, pH; 6.0 to 7.0, dissociation temperature; 65° C.), NACURE 2530 (p-toluenesulfonic acid dissociation, methanol/isopropanol solvent, pH; 5.7 to 6.5, dissociation temperature; 65° C.), NACURE 2547 (p-toluenesulfonic acid dissociation, aqueous solution, pH; 8.0 to 9.0, dissociation temperature; 107° C.), NACURE 2558 (p-toluene sulfonic acid dissociation, ethyleneglycol solvent, pH; 3.5 to 4.5, dissociation temperature; 80° C.), NACURE XP-357 (p-toluenesulfonic acid dissociation, methanol solvent, pH; 2.0 to 4.0, dissociation temperature; 65° C.), NACURE XP-386 (p-toluenesulfonic acid dissociation, aqueous solution, pH; 6.1 to 6.4, dissociation temperature; 80° C.), NACURE XC-2211 (p-toluenesulfonic acid dissociation, pH; 7.2 to 8.5, dissociation temperature; 80° C.), NACURE 5225 (dodecylbenzenesulfonic acid dissociation, isopropanol solvent, pH; 6.0 to 7.0, dissociation temperature; 120° C.), NACURE 5414 (dodecylbenzenesulfonic acid dissociation, xylene solvent, dissociation temperature; 120° C.), NACURE 5528 (dodecylbenzenesulfonic acid dissociation, isopropanol solvent, pH; 7.0 to 8.0, dissociation temperature; 120° C.), NACURE 5925 (dodecylbenzenesulfonic acid dissociation, pH; 7.0 to 7.5, dissociation temperature; 130° C., NACURE 1323 (dinonyl naphthalene sulfonic acid dissociation, xylene solvent, pH; 6.8 to 7.5, dissociation temperature; 150° C.), NACURE 1419 (dinonylnaphthalenesulfonic acid dissociation, xylene/methylisobutylketone solvent, dissociation temperature; 150° C.), NACURE 1557 (dinonylnaphthalenesulfonic acid dissociation, butanol/2-butoxyethanol solvent, pH; 6.5 to 7.5, dissociation temperature; 150° C.), NACURE X49-110 (dinonylnaphthalenedisulfonic acid dissociation, isobutanol/isopropanol solvent, pH; 6.5 to 7.5, dissociation temperature; 90° C.), NACURE 3525 (dinonylnaphthalenedisulfonic acid dissociation, isobutanol/isopropanol solvent, pH; 7.0 to 8.5, dissociation temperature; 120° C.), NACURE XP-383 (dinonylnaphthalenedisulfonic acid dissociation, xylene solvent, dissociation temperature; 120° C.), NACURE 3327 (dinonylnaphthalenedisulfonic acid dissociation, isobutanol/isopropanol solvent, pH; 6.5 to 7.5, dissociation temperature; 150° C.), NACURE 4167 (phosphoric acid dissociation, isopropanol/isobutanol solvent, pH; 6.8 to 7.3, dissociation temperature; 80° C.), NACURE XP-297 (phosphoric acid dissociation, water/isopropanol solvent, pH; 6.5 to 7.5, dissociation temperature; 90° C., and NACURE 4575 (phosphoric acid dissociation, pH; 7.0 to 8.0, dissociation temperature; 110° C.) (manufactured by King Industries).

These heat latent catalysts may be used alone or in combination of two or more kinds thereof.

The content of the acid catalyst is preferably from 0.01 to 5% by weight, more preferably from 0.05 to 4% by weight, with respect to the solid content except for the catalyst. If the content is within the above described ranges, it is possible to obtain an electrophotographic photoreceptor with which image flowing may be suppressed.

The protective layer 5 having the above-described structure may be formed using a film forming coating liquid containing at least one charge transporting material having at least one substituent selected from the group consisting of —OH, —$OCH_3$, —$NH_2$, —SH and —COOH, the above-described acid catalyst as an acidic substance, and at least one compound selected from the group consisting of compounds represented by formula (A) and compounds represented by formula (B). The film forming coating liquid contains, as necessary, the components of the protective layer 5.

The film forming coating liquid may be prepared with no solvent, or as necessary with a solvent. Examples of the solvent include alcohols such as methanol, ethanol, propanol, and butanol; ketones such as acetone and methyl ethyl ketone; and ethers such as tetrahydrofuran, diethyl ether, and dioxane. The solvent may be used alone or as a mixture of two or more kinds thereof and the solvent preferably has a boiling point of 100° C. or lower. The solvent particularly preferably has at least one or more hydroxy groups (for example, an alcohol).

As the solvent, two or more secondary alcohols may be preferably used. The ratio of the secondary alcohol having the highest viscosity in the two more ore secondary alcohol is preferably from 20% to 80%, and the ratio of the secondary alcohol having the lowest viscosity in the two more ore secondary alcohol is preferably from 40% to 60%, relative to the total solvent. By using two or more secondary alcohols and, in particular, setting the ratio of the secondary alcohol having the highest viscosity relative to the total solvent in the above-described range, dripping of the liquid may be prevented, and further uneven image density caused by uneven film thickness when the image is output may also be suppressed. The secondary alcohol having the highest viscosity is preferably cyclopentanol and another secondary alcohol other than cyclopentanol is preferably 2-butanol.

The amount of the solvent may be arbitrarily selected, but is usually from 0.5 parts by to 30 parts by weight, and preferably from 1 part by weight to 20 parts by weight with respect to 1 part by weight of the solid content of the coating liquid to prevent deposition of the materials contained in the coating liquid.

When a coating liquid of the above described components is prepared, the components are mixed and dissolved optionally under heating at a temperature from room temperature (for example, 25° C.) to 100° C., preferably from 30+ C. to 80° C. for 10 minutes or more and 100 hours or less, preferably 1 hour or more and 50 hours or less. During heating, it is preferable to apply ultrasonic vibration. This probably progresses partial reaction, and facilitates formation of a film with no coating defect and little variation in the film thickness.

The film forming coating liquid is applied to the charge transporting layer 3 by an ordinary method such as blade coating, Mayer bar coating, spray coating, dip coating, bead coating, air knife coating, or curtain coating. The coating is cured as necessary under heated at a temperature, for example, from 100° C. to 170° C. thereby forming the protective layer 5.

The film forming coating liquid is used for photoreceptors, and, for example, fluorescence paints and anti-static films on glass or plastic surfaces. The film forming coating liquid forms a film having excellent adhesiveness to the underlying layer, and prevents performance deterioration caused by repeated use over the long term.

The above-described electrophotographic photoreceptor is of function separated type.

The content of the charge generating material in the single-layer photosensitive layer 6 (charge generating/charge transporting layer) is about 10 to 85% by weight, and preferably 20 to 50% by weight. The content of the charge transporting material is preferably 5 to 50% by weight. The single-layer photosensitive layer 6 (charge generating/charge transporting layer) is formed in the same manner as the charge generating layer 2 and the charge transporting layer 3. The thickness of the single-layer photosensitive layer (charge generating/charge transporting layer) 6 is preferably about 5 μm to 50 μm, more preferably 10 μm to 40 μm.

In the above-described exemplary embodiment, a crosslinked product of a specific charge transporting material (the compound represented by formula (I)) and a compound represented by formula (A) is included in the protective layer 5. In cases where the protective layer 5 is absent, for example, the crosslinked product may be included in the charge transporting layer placed on the outermost surface.

(Image Forming Apparatus/Process Cartridge)

Figure 4:
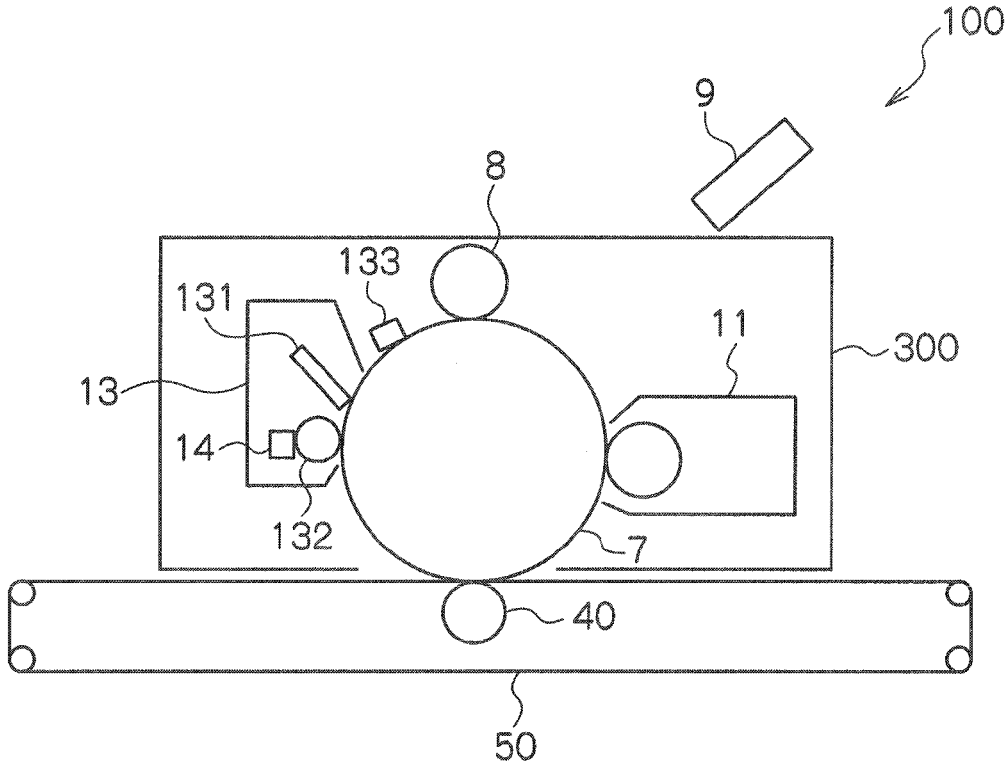
FIG. 4 is a schematic block diagram showing an image forming apparatus according to an exemplary embodiment of the invention.

FIG. 4 is a schematic block diagram showing an image forming apparatus according to an exemplary embodiment of the invention. As shown in FIG. 4, the image forming apparatus 100 includes a process cartridge 300, an exposure device 9, a transfer device 40, and an intermediate transfer body 50, wherein the process cartridge 300 includes an electrophotographic photoreceptor 7. In the image forming apparatus 100, the exposure device 9 is arranged so as to irradiate the electrophotographic photoreceptor 7 through the opening of the process cartridge 300, the transfer device 40 is arranged so as to face the electrophotographic photoreceptor 7 via the intermediate transfer body 50, and the intermediate transfer body 50 is arranged so as to partially contact with the electrophotographic photoreceptor 7.

The process cartridge 300 integrally supports the electrophotographic photoreceptor 7, the charging device 8, a developing device 11 and a cleaning device 13, in a housing. The cleaning device 13 has a cleaning blade 131 (cleaning member). The cleaning blade 131 is disposed so as to contact the surface of the electrophotographic photoreceptor 7.

A fibrous member 132 (roll-formed) for supplying a lubricant 14 to the surface of the photoreceptor 7, and a fibrous member 133 for assisting cleaning (flat-formed) may be used if necessary.

As the charging device 8, for example, a contact type charging device using a conductive or semiconductive charging roller, a charging brush, a charging film, a charging rubber blade, a charging tube or the like can be used. Known charging devices such as a non-contact type roller charging device using a charging roller, and scorotron or corotron charging devices utilizing corona discharge can also be used.

Although not shown, in order to improve stability of the image, a photoreceptor heating member may be provided around the electrophotographic photoreceptor 7 thereby increasing the temperature of the electrophotographic photoreceptor 7 and reducing the relative temperature.

Examples of the exposure device 9 include optical instruments which can expose the surface of the photoreceptor 7 so that a desired image is formed by using light of a semiconductor laser, an LED, a liquid-crystal shutter light or the like. The wavelength of light sources to be used is in the range of the spectral sensitivity region of the photoreceptor. As the semiconductor laser light, near-infrared light having an oscillation wavelength in the vicinity of 780 nm is predominantly used. However, the wavelength of the light source is not limited to the above-described wavelength, and lasers having an oscillation wavelength on the order of 600 nm and blue lasers having an oscillation wavelength in the vicinity of 400 to 450 nm can also be used. Surface-emitting type laser light sources which are capable of multi-beam output are effective to form a color image.

As the developing device 11, for example, a common developing device, in which a magnetic or non-magnetic one- or two-component developer is contacted or not contacted for forming an image, can be used. Such developing device is not particularly limited as long as it has above-described functions, and can be appropriately selected according to the preferred use. Examples thereof include known developing device in which the one- or two-component developer is applied to the photoreceptor 7 using a brush or a roller.

A toner to be used in the developing device will be described below.

The electrophotographic toner particles preferably have an average shape factor ($(ML^2/A)\times(\pi/4)\times100$, wherein ML represents the maximum length of a particle and A represents the projection area of the particle) of 100 to 150, more preferably 105 to 145, further preferably 110 to 140 from the viewpoint of achieving high developability, high transferring property, and high quality image. Furthermore, the volume-average particle diameter of the toner particles is preferably 3 to 12 μm, more preferably 3.5 to 10 μm, further preferably 4 to 9 μm. By using such toner particles having the above-described average shape factor and volume-average particle diameter, developability and transferring property can be enhanced and a high quality image, so-called photographic image, can be obtained.

Although the toner is not specifically restricted by the manufacturing method, the toner manufactured by the method by which the average shape factor and the volume average particle diameter as described above are satisfied is preferably used, for example, the toner manufactured by a kneading and pulverizing method in which a binder resin, a colorant, a releasing agent and optionally a charge control agent or the like are added, and kneaded, pulverized and classified; a method of changing the size of particles obtained by the kneading and pulverizing method by applying a mechanical impact or thermal energy; an emulsion polymerizing aggregating method in which a dispersion obtained by emulsion-polymerizing polymerizable monomers of a binder resin is mixed with a dispersion of a colorant, a releasing agent, and optionally a charge control agent, and the mixture is agglomerated and heat-fused to obtain toner particles; a suspension polymerizing method in which polymerizable monomers for obtaining a binder resin, and a solution of a colorant, a releasing agent, and optionally a charge control agent are suspended in an aqueous medium; and a dissolving suspension method in which a binder resin, and a solution containing a colorant, a releasing agent, and optionally a charge control agent are suspended in an aqueous medium, and forming particles, may be used.

Further, it is preferable that the electrophotographic toner contains at least one kind of crystalline resin having a melting point in the temperature range of from 45° C. to 120° C., preferably from 50° C. to 100° C., and still more preferably from 60° C. to 80° C., whereby a toner having an excellent fixability at low temperature and a reduced power consumption at the time of fixation may be obtained. The viscosity of the electrophotographic toner is greatly reduced on reaching the melting point, which may result in a blocking when the toner is stored at the melting point or higher. Accordingly, the melting point of the toner is preferably the same as or higher than the temperature at the time of the use or storage of the toner, or higher temperature, namely, 45° C. or higher. On the other hand, when the melting point is higher than 120° C., the fixation at low temperature may not be attained. The melting point can be obtained as a melting peak temperature by a power compensation differential scanning calorimetric measurement in accordance with JIS K-7121, the disclosure of which is incorporated by reference herein.

The crystalline resin may be any resins as far as the resin satisfies the above conditions, but a crystalline polyester resin is desirable.

<Binder Resin>

The crystalline polyester resin contains a polyester resin containing a constituent component derived from an acid and a constituent component derived from an alcohol, and optionally contains other components.

Here, the polyester resin is synthesized from an acid (dicarboxylic acid) component and an alcohol (diol) component, and in the invention, the "constituent component derived from acid" refers to the constituent moiety of an acid component prior to the synthesis of a polyester resin, and the "constituent component derived from alcohol" refers to the constituent moiety of an alcohol component prior to the synthesis of a polyester resin. In the invention, "the crystalline polyester resin" refers to a resin showing, not a change in a stepwise endothermic amount in the differential scanning calorimetric analysis (DSC), but a clear endothermic peak in the differential scanning calorimetric analysis (DSC). In addition, in the case of a polymer formed by copolymerizing the main chain of the crystalline polyester with other component, when the other component is 50% by weight or less, the copolymer is called the crystalline polyester.

—Constituent Component Derived from Acid—

The constituent component derived from an acid is preferably a constituent component derived from an aliphatic dicarboxylic acid, and in particular, a constituent component derived from a straight-chained carboxylic acid is preferable. Examples of the aliphatic acid include oxalic acid, malonic acid, succinic acid, glutaric acid, adipic acid, pimelic acid, suberic acid, azelic acid, sebacic acid, 1,9-nonane dicarboxylic acid, 1,10-decane dicarboxylic acid, 1,11-undecane dicarboxylic acid, 1,12-dodecane dicarboxylic acid, 1,13-tridecane dicarboxylic acid, 1,14-tetradecane dicarboxylic acid, 1,16-hexadecane dicarboxylic acid and 1,18-octadecane dicarboxylic acid, or lower alkyl esters and acid anhydrides thereof, but are not limited thereto.

As the constituent component derived from an acid, constituent components such as a constituent component derived from a dicarboxylic acid having a double bond, and a constituent component derived from a dicarboxylic acid having a sulfonic acid group may be contained in addition to the above constituent component derived from an aliphatic acid.

Examples of the constituent component derived from a dicarboxylic acid having a double bond include constituent components derived from a lower alkyl ester or acid anhydride of dicarboxylic acid having a double bond in addition to the constituent components derived from a dicarboxylic acid having a double bond. Further, examples of the constituent component derived from a dicarboxylic acid having a sulfonic acid group include constituent components derived from a lower alkyl ester or acid anhydride of dicarboxylic acid having a sulfonic acid group in addition to the constituent components derived from a dicarboxylic acid having a sulfonic acid group.

The dicarboxylic acid having a double bond is capable of polymerizing the whole resin with the use of the double bonds, and is suitably used for preventing the hot offset at the time of fixation. Examples of such a carboxylic acid include fumaric acid, maleic acid, 3-hexenedioic acid, and 3-octenedioic acid, but are not limited thereto. Further, the lower alkyl esters and acid anhydrides of these compounds may be exemplified. In particular, fumaric acid and maleic acid are preferable from the viewpoint of costs.

The dicarboxylic acid having a sulfonic acid group is effective in view of a good dispersibility of a colorant such as a pigment. Further, when fine particles are prepared by emulsifying or suspending resin as a whole in water, if a sulfonic acid group is present, an emulsification or suspension can be performed without using a surfactant. Such a dicarboxylic acid having a sulfonic group includes, for example, sodium 2-sulfoterephthalate, sodium 5-sulfoisophthalate and sodium sulfosuccinate, but are not limited to them. Further, the lower alkyl esters and acid anhydrides of these compounds may be exemplified. In particular, sodium 5-sulfoisophthalate and the like are preferable from the viewpoint of costs.

The content of the constituent components derived from acid (constituent component derived from dicarboxylic acid having a double bond and/or dicarboxylic acid having a sulfonic acid group) other than the constituent components derived from the aliphatic dicarboxylic acid is preferably from 1 constituent % by mole to 20 constituent % by mole, and more preferably from 2 constituent % by mole to 10 constituent % by mole in the constituent components derived from acid.

When the content is from 1 constituent % by mole to 20 constituent % by mole, a good pigment dispersibility can be attained and an increase in emulsified particle diameter can be suppressed, and the toner particle diameter can be easily controlled. Further, the melting point depression can be prevented by suppressing the reduction in crystallinity of the polyester resin so that a good image storability can be achieved, and a phenomenon where a latex cannot be formed due to dissolution of emulsified particles in water resulting from too small emulsified particle diameter can be prevented.

Here, the "constituent % by mole" refers to the percentage when each constituent component (constituent component derived from acid and constituent component derived from alcohol) in the polyester resin is one unit (by mole).

<Constituent Component Derived from Alcohol>

The constituent component derived from an alcohol is preferably a constituent component derived from an aliphatic diol, and examples thereof include ethylene glycol, 1,3-propane diol, 1,4-butane diol, 1,5-pentane diol, 1,6-hexane diol, 1,7-heptane diol, 1,8-octane diol, 1,9-nonane diol, 1,10-decane diol, 1,11-dodecane diol, 1,12-undecane diol, 1,13-tridecane diol, 1,14-tetradecane diol, 1,18-octadecane diol and 1,20-eicosane diol, but are not restricted thereto.

In the constituent components derived from an alcohol, the content of the constituent components derived from an aliphatic diol may be 80 constituent % by mole or more, and other components may be contained. The content of the constituent components derived from an aliphatic diol is preferably 90 constituent % by mole or more of the constituent component derived from an aliphatic diol.

When the content of the constituent components derived from an aliphatic diol in the constituent components derived from an alcohol is 80 constituent % by mole or more, the melting point of the polyester resin increases owing to suppression of the crystallinity of the polyester resin, so that a toner blocking resistance, a high image storability and a fixability at low temperature can be achieved.

Examples of the other components optionally contained include a constituent component derived from diol having a double bond and a constituent component derived from diol having a sulfonic acid group.

Examples of the diol having a double bond include 2-butene-1,4-diol, 3-butene-1,6-diol and 4-butene-1,8-diol.

Examples of the diol having a sulfonic acid group include sodium 1,4-dihydroxy-2-benzene sulfonate, sodium 1,3-dihydroxymethyl-5-benzene sulfonate and 2-sulfo-1,4-butane diol sodium salt.

When a constituent component derived from an alcohol (constituent component derived from diol having a double bond and a constituent component derived from diol having a sulfonic acid group) other than the constituent components derived from a straight-chained aliphatic diol is added, the content of the constituent component(s) derived from an alcohol other than the constituent component derived from a straight-chained aliphatic diol is preferably 1 to 20 constituent % by mole, and more preferably 2 to 10 constituent % by mole.

When the content of the constituent component(s) derived from an alcohol other than the constituent components derived from a straight-chained aliphatic diol is from 1 constituent % by mole to 20 constituent % by mole, a good pigment dispersibility can be attained, and an increase in emulsified particle diameter can be suppressed, and the toner particle diameter can be easily controlled, and the melting point depression can be prevented by suppressing the reduction in crystallinity of the polyester resin so that a good image storability can be achieved, and a phenomenon where a latex cannot be formed due to dissolution of emulsified particles in water resulting from too small emulsified particle diameter can be prevented.

In the invention, the measurement of the melting point is carried out by the use of a differential scanning calorimeter (DSC), and the top value of the endothermic peak when the measurement is performed at a temperature increasing velocity of 10° C./minute from room temperature to 150° C.

<Colorant>

The colorants are not specifically limited, but known colorants may be arbitrarily used in accordance with the intended use. One kind of pigment may be used singly or two or more of kinds of the colorant of the same system may be mixed and used. Further, two or more kinds of different systems of colorants may be mixed and used. Examples of the colorants include various kinds of pigments such as Chrome Yellow, Hansa Yellow, Benzidine Yellow, Threne Yellow, Quinoline Yellow, Permanent Orange GTR, Pyrazolone Orange, Vulcan Orange, Watchyoung Red, Permanent Red, Brilliant Carmine 3B, Brilliant Carmine 6B, DuPont Oil Red, Pyrazolone Red, Lithol Red, Rhodamine B Lake, Lake Red C, Rose Bengal, Aniline Blue, Ultramarine Blue, Calco Oil Blue, Methyleneblue Chloride, Phthalocyanine Blue, Phthalocyanine Green and Malachite Green Oxalate; various kinds of dyes such as acridine-based, xanthenes-based, azo-based, benzoquinone-based, azine-based, anthraquinone-based, dioxazine-based, thiadiazine-based, azomethine-based, indigo-based, thioindigo-based, phthalocyanine-based, aniline black-based, polymethine-based, triphenyl methane-based, diphenyl methane-based, thiazole-based, and xanthene-based dyes. Black pigments such as carbon black or dyes may be added to these colorants to the extent that the transparency is not impaired. Furthermore, examples of the colorant include dispersion dyes and oil-soluble dyes.

Although the content of the colorant in the electrophotographic toner is preferably from 1 to 30 parts by weight with respect to the 100 parts by weight of the binder resin, the content is preferably as much as possible in the above range to the extent that the smoothness of the surface of an image after fixation is not impaired. When the content of the colorant is higher, the thickness of an image can be thinner to obtain an image with the same density, and the higher content is advantageous for preventing offset.

Furthermore, by selecting the coolants appropriately, various colorants such as a yellow toner, a magenta toner, a cyan toner and a black toner can be obtained.

<Other Components>

The other components can be arbitrarily selected without specific limitation in accordance with the intended use. Examples of the other components include known various additives such as inorganic fine particles, organic fine particles, charge control agents and releasing agents.

The inorganic fine particles are generally used for the purpose of improving the flowability of toner. Examples of the inorganic fine particles include fine particles of silica, alumina, titanium oxide, barium titanate, magnesium titanate, calcium titanate, strontium titanate, zinc oxide, silica sand, clay, mica, Wollastonite, diatom earth, cerium chloride, ion oxide red, chromium oxide, cerium oxide, antimony trioxide, magnesium oxide, zirconium oxide, silicon carbide and silicon nitride. Among them, silica fine particles are preferable, and hydrophobicized silica fine particles are particularly preferable.

The average primary particle diameter (number average particle diameter) of the inorganic fine particles is desirably from 1 to 1,000 nm, and the addition amount of the inorganic fine particles is desirably from 0.01 to 20 parts by weight relative to 100 parts by weight of toner.

In general, the inorganic fine particles are used for the purpose of improving the cleaning property and transfer property. Examples of the organic fine particles include fine particles of polystyrene, polymethyl methacrylate and polyfluorovinylidene.

In general, the charge control agents are used for the purpose of enhancing the chargeability. Examples of the charge control agents include metal salicylates, metal-containing azo compounds, nigrosine and quaternary ammonium salts.

The releasing agent is generally used for the purpose of improving the releasing property.

Specific examples of the releasing agents include low molecular weight polyolefins such as polyethylene, polypropylene and polybutene; silicones having a softening point due to heating; aliphatic acid amide such as oleic acid amide, erucic acid amide, ricinolic acid amide and stearic acid amide; vegetable waxes such as carnauba wax, rice wax, candelilla wax, Japan tallow and Jojoba oil; animal waxes such as beeswax; mineral and petroleum waxes such as Montan wax, ozokerite, ceresin, paraffin wax, microcrystalline wax and Fischer-Tropsch wax. In the invention, the wax may be used singly, or two or more kinds of waxes may be used in combination.

The addition amount of these releasing agents is preferably from 0.5 to 50% by weight, more preferably from 1 to 30% by weight, and still more preferably from 5 to 15% by weight. When the addition amount is less than 0.5% by weight, the releasing agent may not exert the effect of addition of the releasing agent. When the addition amount is more than 50% by weight, the releasing agent tends to influence the chargeability, and may tend to break the toner in the developing machine, thereby causing deterioration of carrier because of spent toner due to the releasing agent. Accordingly, an adverse effect such as a tendency to lower the charge is not merely caused, but the releasing agent is insufficiently exuded onto the surface of an image at the time of fixation when a color toner is used, so that the releasing agent is apt to be remained in the image, resulting in deteriorating transparency unfavorably.

<Other Constituent Elements>

In the electrophotographic toner used in the exemplary embodiment, the surface of the toner particles may be covered with a surface layer. It is desirable that the surface layer does not influence the dynamic property and melt viscoelasticity of the toner as a whole. For example, when toner particles are covered with a non-fused or high melting point thick surface layer, the fixability at low temperature attributable to the use of the crystalline resin cannot be fully exerted.

Accordingly, the thickness of the surface layer is desirably thinner, and specifically the thickness is desirably in the range of from 0.001 to 0.5 μm.

In order to form a thin surface layer with the thickness of the above range, the surface of the particles containing optionally added inorganic fine particles and other materials in addition to a binder resin and colorant is suitably subjected to a chemical treatment.

The components to form the surface layer include a silane coupling agent, isocyanates, or vinyl-based monomers, and the component, into which polar groups are introduced, is preferable, so that the adhesive force between the toner and a receiving body such as paper can be enhanced by forming a chemical bond therebetween.

The polar groups may be any of polarizable functional groups, and examples thereof include a carboxyl group, a carbonyl group, an epoxy group, an ether group, a hydroxyl group, an amino group, an imino group, a cyano group, an amide group, an imide group, an ester group or a sulfonic group.

The method of the chemical treatment may be, for example, a method of oxidizing with the use of a strong oxidizing material such as peroxides, a method of oxidizing with ozone oxidization and plasma oxidization, and a method of bonding polymerizable monomers containing a polar group by a graft polymerization. By the chemical treatment, the polar group is firmly bonded to the molecular chain of the crystalline resin by a covalent bond.

In the exemplary embodiment, a chargeable material may be additionally chemically or physically adhered to the surface of the toner particles. Further, for the purpose of improving chargeability, conductivity, powder flowability and lubricity, fine particles of metal, metal oxide, metal salt, ceramic, resin or carbon black may be externally added.

The volume average particle diameter of the electrophotographic toner of the exemplary embodiment is preferably from 1 to 20 μm, and more preferably from 2 to 8 μm, and the number average particle diameter is preferably from 1 to 20 μm, and more preferably from 2 to 8 μm.

The volume average particle diameter and the number average particle diameter can be obtained by measuring thereof by use of COULTER COUNTER (TA-II type) ((trade name) manufactured by Beckman Coulter Inc.) at an aperture diameter of 50 μm. At this time, the measurement is performed after the toner is dispersed in ISOTON aqueous solution ((trade name) (manufactured by Beckman Coulter Inc.), by applying ultrasonic wave to the toner dispersion for 30 seconds or more.

(Electrophotographic Developer)

The electrophotographic developer used in the exemplary embodiment may be a magnetic or nonmagnetic one component electrophotographic developer containing at least the electrophotographic toner, or may be a two component electrophotographic developer containing at least the electrophotographic toner and a carrier.

When the one component electrophotographic developer is a magnetic one component electrophotographic developer, magnetic powder may be added, or all or a part of the black colorant in colorants may be replaced with magnetic powder. As the magnetic powder, any of known conventionally used magnetic powder may be used. For example, metals such as iron, cobalt and nickel, or alloys thereof metal oxides such as $Fe_3O_4$, $\gamma$-$Fe_2O_3$, cobalt-added iron oxide and magnetite, and ferrites such as MnZn ferrite and NiZn ferrite. In general, these magnetic substances are added and used from 30 to 70% by weight.

In the two component electrophotographic developer, the carrier is not specifically limited, known carriers such as a resin-coated carrier may be preferably exemplified. In the resin-coated carrier, the surface of core material is coated with a resin. Examples of the core material include magnetic powder such as iron powder, ferrite powder and nickel powder. Examples of the resins include fluoro resins, vinyl resins and silicone resins.

[Image Forming Apparatus/Process Cartridge]

FIG. 4 is a schematic block diagram showing an image forming apparatus according to an exemplary embodiment of the invention. As shown in FIG. 4, the image forming apparatus 100 includes a process cartridge 300, an exposure device 9, a transfer device 40, and an intermediate transfer body 50, wherein the process cartridge 300 includes an electrophotographic photoreceptor 7. In the image forming apparatus 100, the exposure device 9 is arranged so as to irradiate the electrophotographic photoreceptor 7 through the opening of the process cartridge 300, the transfer device 40 is arranged so as to face the electrophotographic photoreceptor 7 via the intermediate transfer body 50, and the intermediate transfer body 50 is arranged so as to partially contact with the electrophotographic photoreceptor 7.

The process cartridge 300 integrally supports the electrophotographic photoreceptor 7, the charging device 8, a developing device 11 and a cleaning device 13, in a housing. The cleaning device 13 has a cleaning blade 131 (cleaning member). The cleaning blade 131 is disposed so as to contact with the surface of the electrophotographic photoreceptor 7.

A fibrous member 132 (roll-formed) for supplying a lubricant 14 to the surface of the photoreceptor 7, and a fibrous member 133 for assisting cleaning (flat-formed) may be used if necessary.

As the charging device 8, for example, a contact type charging device using a conductive or semiconductive charging roller, a charging brush, a charging film, a charging rubber blade, a charging tube or the like can be used. Known charging devices such as a non-contact type roller charging device using a charging roller, and scorotron or corotron charging devices utilizing corona discharge can also be used.

Although not shown, in order to improve stability of the image, a photoreceptor heating member may be provided around the electrophotographic photoreceptor 7 thereby increasing the temperature of the electrophotographic photoreceptor 7 and reducing the relative temperature.

Examples of the exposure device 9 include optical instruments which can expose the surface of the photoreceptor 7 so that a desired image is formed by using light of a semiconductor laser, an LED, a liquid-crystal shutter light or the like. The wavelength of light sources to be used is in the range of the spectral sensitivity region of the photoreceptor. As the semiconductor laser light, near-infrared light having an oscillation wavelength in the vicinity of 780 nm is predominantly used. However, the wavelength of the light source is not limited to the above-described wavelength, and lasers having an oscillation wavelength on the order of 600 nm and blue lasers having an oscillation wavelength in the vicinity of 400 to 450 nm can also be used. Surface-emitting type laser light sources which are capable of multi-beam output are effective to form a color image.

As the developing device 11, for example, a common developing device, in which a magnetic or non-magnetic one- or two-component developer is contacted or not contacted for forming an image, can be used. Such developing device is not particularly limited as long as it has above-described functions, and can be appropriately selected according to the preferred use. Examples thereof include known developing devices in which said one- or two-component developer is applied to the photoreceptor 7 using a brush or a roller. In particular, a developing roller carrying a developer on the surface thereof is preferably used.

Examples of the transfer device 40 include known transfer charging devices such as a contact type transfer charging devices using a belt, a roller, a film, a rubber blade, a scorotron transfer charging device and a corotron transfer charging device utilizing corona discharge.

As the intermediate transfer body 50, a belt which is imparted semiconductivity (intermediate transfer belt) of polyimide, polyamide imide, polycarbonate, polyarylate, polyester, rubber or the like is used. The intermediate transfer body 50 may also take the form of a drum.

In addition to the above-described devices, the image forming apparatus 100 may further be provided with, for example, a photo-erasor for photo-erasing the photoreceptor 7.

Figure 5:
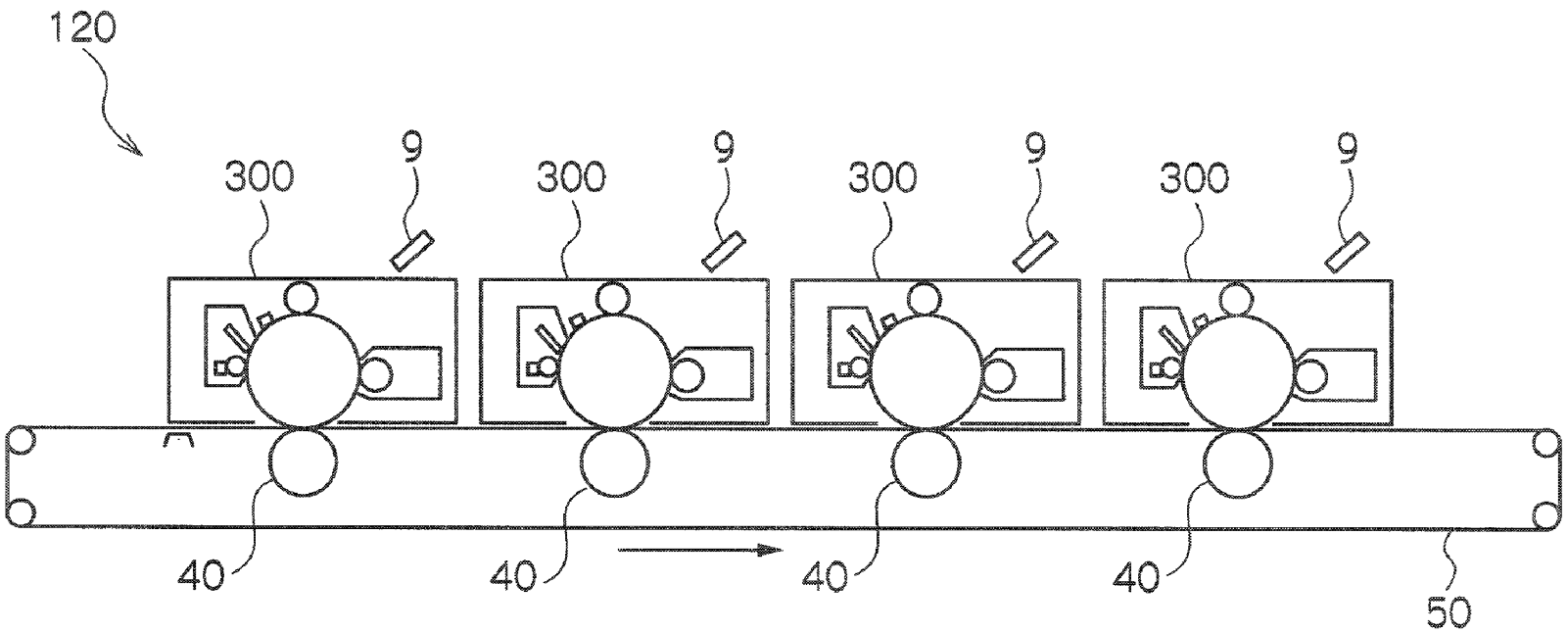
FIG. 5 is a schematic block diagram showing an image forming apparatus according to another exemplary embodiment of the invention.

FIG. 5 is a schematic block diagram showing an image forming apparatus according to another exemplary embodiment of the invention. As shown in FIG. 5, the image forming apparatus 120 is a full color image forming apparatus of tandem type including four process cartridges 300. In the image forming apparatus 120, four process cartridges 300 are disposed parallel with each other on the intermediate transfer body 50, and one electrophotographic photoreceptor can be used for one color. The image forming apparatus 120 has the same constitution as the image forming apparatus 100, except being tandem type.

When the electrophotographic photoreceptor of the invention is used in a tandem type image forming apparatus, the electrical characteristics of the four photoreceptors are stabilized, which provides high image quality with excellent color balance over the long time.

In the image forming apparatus (process cartridge) according to the present exemplary embodiment, the developing device (developing unit) preferably has a developing roller as a developer holding member, the roller being moved (rotated) in the reverse direction to the moving direction (rotating direction) of the electrophotographic receptor. Here, the developer roller has a cylindrical developer sleeve for holding a developer on the surface of the developer roller, and the developing device may have a structure having a regulating member for regulating the quantity of the developer to be supplied to the developer sleeve. By moving (rotating) the developer roller of the developing device in the direction opposite to the rotating direction of the electrophotographic receptor, the surface of the electrophotographic receptor is rubbed with the toner remained between the developer roller and the electrophotographic receptor. Further, when the toner remained on the surface of the electrophotographic receptor is cleaned, for example, for cleaning the toner particles having almost a spherical shape to a higher degree, the pressing pressure of a blade or the like against the surface of the electrophotographic receptor is made higher, resulting in strong rubbing against the surface of the electrophotographic receptor.

Due to the rubbing, the conventionally known electrophotographic receptors are severely damaged, so that abrasion, scratches or filming of toner is easily caused, resulting in occurrence of deterioration of image quality. In the invention, the surface of the electrophotographic receptor with an enhanced strength by the crosslinked product of the specific charge transporting material (in particular, the material which has increased number of reactive functional groups and is contained at a high concentration and therefore can provide a cured layer having a highly crosslinked density) of the invention, and with a large thickness owing to an excellent electric property, can be formed, and therefore, a high image quality can be maintained over a long period of time. It is presumed that depositions of an electrodischarge product can be prevented over extremely long time. Further, in the image forming apparatus of the exemplary embodiment, from the viewpoint of preventing the depositions of the discharge products over a long period of time, the distance between the developer sleeve and the photoreceptor is preferably from 200 μm to 600 μm, and more preferably from 300 μm to 500 μm. Furthermore, from the similar viewpoint, the distance between the developer sleeve and the regulating blade for regulating the quantity of the developer is preferably from 300 μm to 1,000 μm, and more preferably from 400 μm to 750 μm.

Moreover, from the viewpoint of preventing the depositions of the discharge products over a long period of time, the absolute value of the moving velocity of the surface of the developer roller is preferably from 1.5 to 2.5 times the absolute value of the moving velocity (process speed) of the surface of the photoreceptor, and more preferably from 1.7 to 2.0 times the absolute value of the moving velocity of the surface of the photoreceptor.

In the image forming apparatus (process cartridge) according to an exemplary embodiment of the invention, the development apparatus (development unit) preferably includes a developer holding member having a magnetic substance, and develops an electrostatic latent image with preferably a two-component developer containing a magnetic carrier and a toner. With the structure, finer color images may be produced, and higher quality and longer life may be achieved in comparison with other structure using a one-component developing solution, particularly a non-magnetic one-component developer.

EXAMPLES

Hereinafter, the invention will be explained with reference to the following examples in more detail, but the invention shall not be construed to be limited to the examples.

The brevity codes of materials used are shown below:

Guanamine resin (AG-1): SUPER BECKAMINE® L-148-55 ((trade name) (butylated benzoguanamine resin) manufactured by DIC Corporation;

Guanamine resin (AG-2): SUPER BECKAMINE® 13-535 ((trade name) (methylated benzoguanamine resin) manufactured by DIC Corporation;

Guanamine resin (AG-3): NIKALAC BL-60 ((trade name) manufactured by Nippon Carbide Industries Co., Inc.);

Melamine resin (AM-1): U-VAN 20SE60 ((trade name) (n-butylated melamine resin) manufactured by Mitsui Cytec Ltd.); solid content: 60% by weight, solvent: xylene/n-butanol);

Melamine resin-A2 (AM-2): U-VAN 122 ((trade name) (n-butylated melamine resin) manufactured by Mitsui Cytec Ltd.); solid content: 60% by weight, solvent: n-butanol);

Melamine resin (AM-3): U-VAN 361 ((trade name) (isobutylated melamine resin) manufactured by Mitsui Cytec Ltd.); solid content: 60% by weight, solvent: xylene/isobutanol);

Catalyst CA-1: NACURE5528 ((trade name) manufactured by King Industries, Inc.) (containing sulfur as a sulfonic acid group);

Catalyst CA-2: NACURE2107 ((trade name) manufactured by King Industries, Inc.) (containing sulfur as a sulfonic acid group);

Catalyst CA-3: NACURE5225 ((trade name) manufactured by King Industries, Inc.) (containing sulfur as a sulfonic acid group);

Leveling agent L-1: BYK-302 ((trade name) manufactured by BYK Chemie Japan K.K.);

Leveling agent L-2: POLYFLOW KL-600 ((trade name) manufactured by Kyoeisha Chemical Co., Ltd.);

Antioxidant UO-1: 3,5-di-t-butyl-4-hydroxytoluene;

Antioxidant UO-2: 2,2'-methylenebis(4-methyl-6-t-butylphenol).

Example I

An electrophotographic photoreceptor is prepared as follows:

Example I-1

(Preparation of Undercoat Layer)

Zinc oxide (100 parts by weight) (average particle diameter: 70 nm; manufactured by Teica Corporation; specific surface area: 15 $m^2/g$) and 500 parts by weight of tetrahydrofuran are mixed and stirred, and 1.3 parts by weight of a silane coupling agent (KBM 503 (trade name) manufactured by Shin-Etsu Chemical Co., Ltd.) is added thereto, and the mixture is stirred for two hours. Thereafter, toluene is distilled away by distillation under reduced pressure, and the resultant mixture is subjected to a baking treatment at 120° C. for three hours to obtain a surface-treated zinc oxide with silane coupling agent.

The surface-treated zinc oxide (110 parts by weight) and 500 parts by weight of tetrahydrofuran are mixed and stirred, and to the mixture a solution formed by dissolving 0.6 part by weight of alizarin in 50 parts by weight of tetrahydrofuran is added, and the resultant mixture is stirred at 50° C. for five hours, and thereafter, alizarin-added zinc oxide is filtrated and separated under reduced pressure, and further is dried at 50° C. under reduced pressure to obtain alizarin-added zinc oxide.

A solution (38 parts by weight) formed by mixing the alizarin-added zinc oxide (60 parts by weight), 13.5 parts by weight of a curing agent (blocked isocyanate (SUMIJULE 3175) ((trade name) manufactured by Sumitomo Bayer Urethane Co., Ltd.), and 15 parts by weight of butyral resin (S-LEC BM-1) ((trade name) manufactured by Sekisui Chemical Co., Ltd.) with 85 parts by weight of methyl ethylketone, is mixed with 25 parts by weight of methyl ethylketone, and the mixture is dispersed by a sand mill with the use of glass beads having a diameter of 1 mmϕ for two hours, and thus a dispersion is obtained.

To the thus obtained dispersion, 0.005 parts by weight of dioctyl tin dilaurate as a catalyst are added, and 40 parts by weight of silicone resin particles (TOSPEARL (trade name) manufactured by GE Toshiba Silicones Co., Ltd.), and thus a coating liquid for undercoat layer is obtained. The coating liquid is coated on an aluminum substrate having a diameter of 30 mm, a length of 340 mm and a thickness of 1 mm and is dried at 170° C. for 40 minutes for curing to obtain an undercoat layer with a thickness of 19 μm. The undercoat layer is referred to as undercoat-1.

(Preparation of Charge Generating Layer)

A mixture composed of 15 parts by weight of hydroxygallium phthalocyanine as a charge generating substance having diffraction peaks at Bragg angles (2θ±0.2°) of 7.3°, 16.0°, 24.9° and 28.0° in the X-ray diffraction spectrogram using the CuKα characteristic x-ray, 10 parts by weight of vinyl chloride-vinyl acetate copolymer (VMCH (trade name) manufactured by Nippon Unicar Co., Ltd.) as a binder resin, and 200 parts by weight of n-butyl acetate is dispersed by a sand mill with the use of glass beads having a diameter of 1 mmϕ for four hours. To the dispersion, 175 parts by weight of n-butyl acetate and 180 parts by weight of methyl ethyl ketone are added to obtain a coating liquid for charge generating layer. The thus obtained coating liquid is coated on the undercoat layer by dip coating, and dried at ordinary temperature (25° C.) to form a charge generating layer having a layer thickness of 0.2 μm.

(Preparation of Charge Transport Layer)

A coating liquid for charge transport layer is prepared by dissolving 45 parts by weight of N,N'-diphenyl-N,N'-bis(3-methylphenyl)-[1,1']-biphenyl-4,4'-diamine and 55 parts by weight of bisphenol Z polycarbonate resin (viscosity average molecular weight of 50,000) in 800 parts by weight of chlorobenzene. The coating liquid is coated on the charge generating layer, and is dried at 130° C. for 45 minutes to form a charge transport layer having a layer thickness of 20 μm.

(Preparation of Protective Layer)

A coating liquid for protective layer is prepared by mixing 40 parts by weight of a benzoguanamine resin (SUPER BECKAMINE® L-148-55 ((trade name) (butylated benzoguanamine resin) manufactured by DIC Corporation, 60 parts by weight of the compound represented by (I-8), 1.7 parts by weight of 3,5-di-t-butyl-4-hydroxytoluene (BHT) as an antioxidant, 0.2 part by weight of NACURE5528, 2 parts by weight of the compound represented by (A-6), 0.1 part by weight of a leveling agent BYK-302 (manufactured by BYK-Chemie Japan K.K.) and 80 parts by weight of 1-methoxy-2-propanol. The coating liquid is coated on the charge transport layer by A dip coating method, and is air-dried at room temperature for 30 minutes, and is subjected to a heating treatment at 150° C. for one hour to be cured to form a protective layer having a layer thickness of about 6 μm. Thus, a photoreceptor (I-1) of Example I-1 is prepared.

[Evaluation]

—Evaluation of Density Reduction Due to Light Exposure—

The electrophotographic photoreceptor thus prepared is covered with a black sheet of paper with a hole of 1 cm square and is exposed to light with a white fluorescent lamp with 600 lux for 10 minutes under the condition of a temperature of 20° C. and a humidity of 55%. The electrophotographic photoreceptor after the light-exposure is mounted to the black toner section of DocuCentre Color 400CP ((trade name) manufactured by Fuji Xerox Co., Ltd.) and 60% halftone (black) is outputted, and the difference between the density of light-exposed area (Dirr) and the density of light-unexposed area ($D_0$), $\Delta D=D_0-Dirr$ is determined using a Macbeth densitometer (manufactured by X-Rite Inc.). The constituent compositions are shown in Table 1 and evaluation results are shown in Table 3.

—Evaluation of Density Recovery Property—

The light-exposed photoreceptor in the evaluation of density reduction is stored under the condition of a high humidity and high temperature (28° C. and 55% RH) for a long period of time, and evaluations of image quality recovery are performed on the basis of the following indices:

A: recovered in 10 minutes;

B: recovered in one hour; and

C: not recovered in 5 hours.

—Evaluation of Image Quality—

The photoreceptor is mounted to the DocuCentre Color 400CP ((trade name) manufactured by Fuji Xerox Co., Ltd.), and the following evaluations are performed consecutively under the condition of a low temperature and a low humidity (10° C. and 20% RH), and under the condition of a high temperature and a high humidity (28° C. and 85% RH).

Namely, image forming tests using 10,000 sheets of paper are performed under the condition of a high temperature and high humidity (28° C. and 85% RH), and the image quality of the 10,000th sheet are assessed on the ghost, fog, streak, toner filming on the photoreceptor and image degradation, and the image quality of the first sheet after allowing the photoreceptor to stand under the condition of a high temperature and high humidity (28° C. and 85% RH) for 24 hours after the image forming tests using 10,000 sheets are assessed on the ghost, the fog, the streak, the toner filming on the photoreceptor and the image degradation. The results are shown in Table 3.

Here, in the image forming tests, P paper manufactured by Fuji Xerox Office Supply Co., Ltd. (A4 size transverse sheet feed) is used.

—Evaluation of Ghost—

Figure 6A:
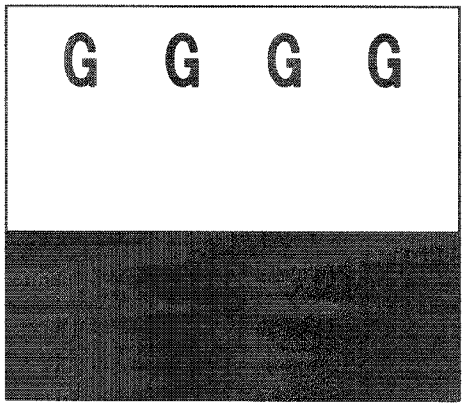
FIGS. 6A to 6C are each an explanatory drawing showing the criterion of ghost evaluation.

The ghost is visually assessed and evaluated based on the appearance of the character G in the black area on a print having a pattern of the character G and the black area as shown in FIG. 6A. The evaluation results are shown in Table 3.

Figure 6B:
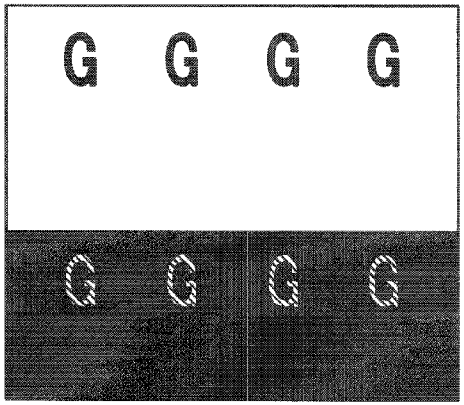

A: as shown in FIG. 6A, ghost is not appeared or very slight;

B: as shown in FIG. 6B, ghost is slightly visible; and

Figure 6C:
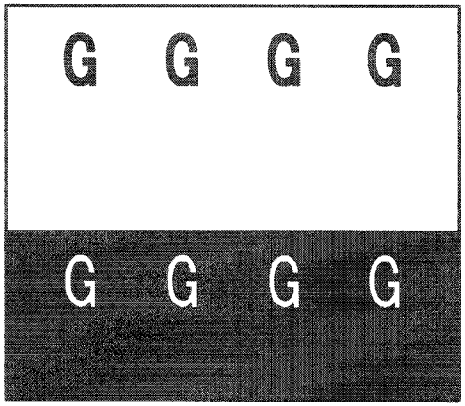

C: as shown in FIG. 6C, ghost is clearly observed.

—Evaluation of Image Degradation—

The image degradation is visually judged using the same samples as the ghost assessment. The results are shown in Table 3.

A: excellent;

B: image degradation is not problematic during consecutive printings, but arises after being allowed to stand for 24 hours, and C: image degradation arises during consecutive printings.

—Evaluation of Streak—

The streaks are visually judged using the same samples as the ghost assessment. The results are shown in Table 3.

A: excellent;

B: streaks occur in part; and

C: streaks occur to the extent of being problematic in image quality.

—Evaluation of Fog—

The fog is visually judged using the same samples as the ghost assessment. The results are shown in Table 3.

A: excellent;

B: fog occurs in part; and

C: fog occurs to the extent of being problematic in image quality.

—Evaluation of Toner Filming—

The toner filming is visually judged using the same samples as the ghost assessment. The results are shown in Table 3.

A: excellent;

B: toner filming occurs in part; and

C: toner filming occurs to the extent of being problematic in image quality.

—Evaluation of Electric Characteristics—

The photoreceptor is mounted to the DocuCentre Color 400CP ((trade name) manufactured by Fuji Xerox Co., Ltd.), and the difference between a residual potential (VR1) before the first print and a residual potential (VR100) before the 100th print in the print tests under the condition of a low temperature and low humidity (10° C. and 20% RH); $\Delta VR=VR100-VR1$ is measured. The results are shown in Table 3.

—Evaluation of Wear Amount—

The photoreceptor is mounted to the DocuCentre Color 400CP ((trade name) manufactured by Fuji Xerox Co. Ltd.), and print tests are performed on 1,000 sheets of paper under each condition of a low temperature and low humidity (10° C. and 20% RH), and a high temperature and high humidity (28° C. and 85% RH), and the wear amounts of the layer (decrease in the layer thickness) are measured. The results are shown in Table 3.

Example I-2 to Example I-9

Photoreceptors (I-2) to (I-9) of Examples I-2 to I-9 are prepared in the same manner as in Example I-1 except that materials and compounded amounts thereof are changed as shown in Table 1, and are evaluated in the same manner as in Example I-1. The results are shown in Table 3.

Example I-10

A photoreceptor (I-10) of Example I-10 is prepared in the same manner as in Example I-1 except that 45 parts by weight of the following compound (α) and 55 parts by weight of bisphenol Z polycarbonate resin (viscosity average molecular weight of 70,000) are used in place of 45 parts by weight of N,N'-diphenyl-N,N'-bis(3-methylphenyl)-[1,1']-biphenyl-4, 4'-diamine and 55 parts by weight of bisphenol Z polycarbonate resin (viscosity average molecular weight of 50,000), and is evaluated in the same manner as in Example I-1. The results are shown in Table 3.

Example I-11

A photoreceptor (I-11) of Example I-11 is prepared in the same manner as in Example I-1 except that 55 parts by weight of bisphenol Z polycarbonate resin (viscosity average molecular weight of 40,000) is used in place of 55 parts by weight of bisphenol Z polycarbonate resin (viscosity average molecular weight of 50,000), and is evaluated in the same manner as in Example I-1. The constituent compositions are shown in Table 1 and the evaluation results are shown in Table 3. When the photoreceptor is subjected to the cross-cut test in accordance with JIS K5600-5-6 (1999), the disclosure of which is incorporated by reference herein, no exfoliation in the sample of Example I-1 arises, but exfoliation in the sample of Example I-11 arises in two portions of 25 portions.

Example I-12

A photoreceptor (I-12) of Example I-12 is prepared by preparing a charge generating layer, charge transport layer and protective layer in the same manner as in Example I-3 except that the curing catalyst is change to acetic acid, and is evaluated in the same manner as in Example I-3. The constituent components are shown in Table 1, and the evaluation results are shown in Table 3. When the photoreceptor is subjected to the cross-cut test in accordance with JIS K5600-5-6 (1999), no exfoliation in the sample of Example I-3 arises, but exfoliation in the sample of Example I-12 arises in four portions of 25 portions.

Example I-13

A photoreceptor (I-13) of Example 13 is prepared in the same manner as in Example I-1 except that Compound (I-1) is used in place of the compound represented by (I-8), and is evaluated in the same manner as in Example I-1. The results are shown in Table 3.

Example I-14

A photoreceptor (I-14) of Example I-14 is prepared in the same manner as in Example I-1 to the formation of the charge transport layer. A coating liquid for protective layer is prepared by mixing 65 parts by weight of a benzoguanamine resin (SUPER BECKAMINE® L-148-55 ((trade name) (butylated benzoguanamine resin) manufactured by DIC Corporation), 60 parts by weight of the compound represented by Compound (α)

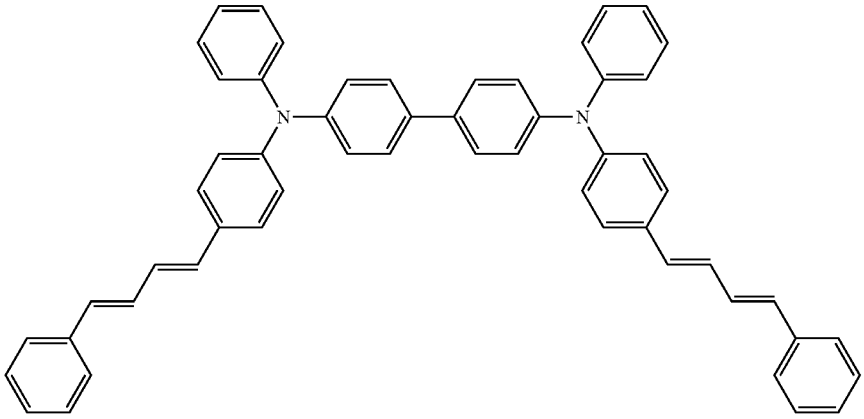

(I-8), 1.7 parts by weight of 3,5-di-t-butyl-4-hydroxytoluene (BHT) as an antioxidant, 0.2 part by weight of NACURE5528, 1 parts by weight of the compound represented by (A-6), 0.1 part by weight of a leveling agent BYK-302 (manufactured by BYK-Chemie Japan K.K.), and 8 parts by weight of 1-methoxy-2-propanol. The coating liquid is coated on the charge transport layer by a dip coating method, and is air-dried at room temperature for 30 minutes, and is subjected to heating treatment at 150° C. for one hour to be cured to form a protective layer having a layer thickness of about 6 μm. Thus, a photoreceptor (I-14) of Example I-14 is prepared, and is evaluated in the same manner as in Example I-1. The results are shown in Table 3.

Example I-15

A photoreceptor (I-15) of Example I-15 is prepared in the same manner as in Example I-5 except that 100 parts by weight of the compound represented by (I-5) is used, and is evaluated in the same manner as in Example I-5. The results are shown in Table 3.

Example I-16

A photoreceptor (I-16) of Example I-16 is prepared in the same manner as in Example I-1 to the formation of the charge transport layer. A coating liquid for protective layer is prepared by mixing 5 parts by weight of ELVAMIDE 8061 ((trade name)) manufactured by E. I. DuPont de Nemours & Company), 60 parts by weight of the compound represented by (I-8), 1.7 parts by weight of 3,5-di-t-butyl-4-hydroxytoluene (BHT) as an antioxidant, 0.2 part by weight of NACURE5528, 1 parts by weight of the compound represented by (A-6), 0.1 part by weight of a leveling agent BYK-302 (manufactured by BYK-Chemie Japan K.K.) and 8 parts by weight of 1-methoxy-2-propanol. The coating liquid is coated on the charge transport layer by a dip coating method, and is air-dried at room temperature for 30 minutes, and is subjected to a heating treatment at 150° C. for one hour to be cured to form a protective layer having a layer thickness of about 6 μm. Thus, a photoreceptor (I-16) of Example I-16 is prepared, and is evaluated as in the same manner as in Example I-1. The results are shown in Table 3.

Example I-17 to Example I-19

Photoreceptors (I-17) to (I-19) of Example I-17 to I-19 are prepared in the same manner as in Example I-1 except that materials and compounded amounts thereof are changed as shown in Table 1, and are evaluated in the same manner as in Example I-1. The results are shown in Table 3.

Example II

Example II-1-Example II-3

A drawn cylinder (diameter of 84 mm and length of 357 mm) formed from the alloy number A3003 alloy in accordance with JIS H4080, the disclosure of which is incorporated by reference herein, is prepared and ground with a centerless grinder to finish the surface to a ten-point average surface roughness $R_z$ of 0.6 μm. Subsequently, the surface of the drawn cylinder is subjected to a degrease treatment, an etching treatment in a 2% by weight sodium hydroxide solution for one minute, a neutralizing treatment, and washing with pure water, sequentially. Thereafter an anodized layer (current density of 1.0 A/dm$^2$) is formed on the surface of the cylinder in a 10% by weight sulfuric acid solution in an anodizing process. After washing with pure water, the cylinder is subjected to a sealing treatment by being immersed in a 1% by weight nickel acetate solution at 80° C. for 20 minutes. Further, the cylinder is washed with pure water and dried. Thus, an electroconductive support having an anodized layer with a thickness of 7 μm on the outer peripheral surface of the drawn cylinder is obtained. The cylinder is referred to as an undercoat-2.

Photoreceptors (II-1), (II-2) and (II-3) of Example II-1, Example II-2 and Example II-3 are prepared by forming a charge generating layer, a charge transport layer and a protective layer sequentially, on the undercoat-2 in the same manner as in Example I-3, Example I-5 and Example I-6, respectively except that the undercoat-2 is used. The photoreceptors are evaluated in the same manner as in Example I-3. The constituent components are shown in Table 1, and the evaluation results are shown in Table 3.

Example III

Example III-1-Example III-3

On a cylindrical aluminum substrate subjected to a honing treatment, a solution composed of 100 parts by weight of a zirconium compound (ORGATIX ZC-540 ((trade name) manufactured by Matsumoto Fine Chemical Co., Ltd.), 10 parts by weight of a silane compound ((A1100) trade name) manufactured by manufactured by Nippon Unicar Co., Ltd.), 400 parts by weight of isopropanol and 200 parts by weight of butanol is coated by a dip coating method, and the coated layer is heat-dried at 150° C. for 10 minutes to form an undercoat layer with a thickness of 0.1 μm. Thus obtained layer is referred to as undercoat-3.

Photoreceptors (III-1), (III-2) and (III-3) of Example III-1, Example III-2 and Example III-3 are prepared by forming a charge generating layer, a charge transport layer and a protective layer sequentially on the undercoat-3 in the same manner as in Example I-3, Example I-5 and Example I-6, respectively, except that the undercoat-3 is used. The photoreceptors are assessed in the same manner as in Example I-3. The constituent components are shown in Table 1, and the evaluation results are shown in Table 3.

Comparative Example 1 to Comparative Example 6

Photoreceptors of Comparative examples 1 to 6 are prepared by forming a charge generating layer a charge transport layer and a protective layer in the same manner as in Example I-3, Example I-5, Example I-6, Example I-8, Example II-1 and Example III-1, respectively, except that the compounds (A) and (B) are not used, and are evaluated in the same manner as in the examples. The constituent components are shown in Table 2, and the evaluation results are shown in Table 3.

Comparative Example 7

A photoreceptor of Comparative example 7 is prepared by forming a charge generating layer, a charge transport layer and a protective layer in the same manner as in Example I-3, except that 0.5 parts by weight of trimethyl amine (TEA) is used in place of 2 parts by weight of B-8. However, curing is insufficient and cannot be assessed. The constituent components are shown in Table 2.

Comparative Example 8

A photoreceptor of Comparative example 8 is prepared by forming a charge generating layer, a charge transport layer and a protective layer in the same manner as in Example I-3, except that 0.5 parts by weight of piperidine (PP) is used in place of 2 parts by weight of B-8. However, curing is insufficient and cannot be assessed. The constituent components are shown in Table 2.

Comparative Example 9

A photoreceptor of Comparative example 9 is prepared by forming a charge generating layer, a charge transport layer and a protective layer sequentially in the same manner as in Example I-3, except that 0.5 parts by weight of benzyl amine (BA) is used in place of 2 parts by weight of B-8. However, curing is insufficient and cannot be assessed. The constituent components are shown in Table 2.

Comparative Example 10

A photoreceptor of Comparative example 10 is prepared by forming a charge generating layer, a charge transport layer and a protective layer sequentially in the same manner as in Example I-3, except that 0.2 parts by weight of triethyl amine (TEA) is used in place of 2 parts by weight of B-8, and is evaluated in the same manner as in Examples I-3. The constituent components are shown in Table 2, and the evaluation results are shown in Table 3.

Comparative Example 11

A photoreceptor of Comparative example 11 is prepared by forming a charge generating layer, a charge transport layer and a protective layer sequentially in the same manner as in [Example I-3], except that 0.3 parts by weight of piperidine (PP) is used in place of 2 parts by weight of B-8, and is evaluated in the same manner as in Example I-3. The constituent components are shown in Table 2, and the evaluation results are shown in Table 3.

Comparative Example 12

A photoreceptor of Comparative example 12 is prepared by forming a charge generating layer, a charge transport layer and a protective layer sequentially in the same manner as in [Example I-3], except that 0.3 parts by weight of benzyl amine (BA) is used in place of 2 parts by weight of B-8, and is evaluated in the same manner as in Example I-3. The constituent components are shown in Table 2, and the evaluation results are shown in Table 3.

TABLE 1

| | | Protective Player | | | | | | |
|---|---|---|---|---|---|---|---|---|
| | Undercoat | Charge transport Material/ Content (part by weight) | Formula (A); Formula (B)/ Content (part by weight) | Catalyst/ Content (part by weight) | Additive 1/ Content (part by weight) | Additive 2/ Content (part by weight) | Additive 3/ Content (part by weight) | Layer thickness (μm) |
| Example I-1 | Undercoat 1 | I-8/60 | A-6/2 | CA-1/0.2 | UO-1/ 1.7 | AG-1/2 | L-1/0.1 | 6 |
| Example I-2 | Undercoat 1 | I-8/80 | A-6/2 | CA-1/0.2 | UO-1/ 1.7 | AM-1/2 | L-1/0.1 | 9 |
| Example I-3 | Undercoat 1 | I-16/80 | B-8/2 | CA-2/0.2 | UO-1/ 1.3 | AM-3/2 | L-2/0.1 | 14 |
| Example I-4 | Undercoat 1 | I-3/10 I-21/90 | B-15/2 | CA-3/0.2 | UO-2/ 1.3 | AM-2/2 | L-2/0.1 | 10 |
| Example I-5 | Undercoat 1 | I-5/10 I-21/90 | B-15/3 | CA-2/0.2 | UO-2/ 1.3 | AM-1/2 | L-2/0.1 | 14 |
| Example I-6 | Undercoat 1 | I-10/80 I-33/10 | B-18/2 | CA-2/0.2 | UO-2/ 1.3 | AM-1/2 | L-2/0.1 | 15 |
| Example I-7 | Undercoat 1 | I-3/10 I-21/90 | B-15/1 | CA-3/0.2 | — | AG-2/2 | L-2/0.1 | 14 |
| Example I-8 | Undercoat 1 | I-15/80 | B-8/2 | CA-3/0.2 | LUBLON L-2*/3 | AG-3/2 | L-2/0.1 | 14 |
| Example I-9 | Undercoat 1 | I-8/40 | A-6/2 | CA-1/0.2 | UO-1/ 1.7 | AG-1/40 | L-1/0.1 | 6 |
| Example I-10 | Undercoat 1 | I-8/50 | A-6/2 | CA-1/0.2 | UO-1/ 1.7 | AG-1/40 | L-1/0.1 | 6 |
| Example I-11 | Undercoat 1 | I-8/50 | A-6/2 | CA-1/0.2 | UO-1/ 1.7 | AG-1/40 | L-1/0.1 | 6 |
| Example I-12 | Undercoat 1 | I-8/50 | A-6/2 | Acetic acid/0.2 | UO-1/ 1.7 | AG-1/40 | L-1/0.1 | 6 |
| Example I-13 | Undercoat 1 | I-1/60 | A-6/2 | CA-1/0.2 | UO-1/ 1.7 | AG-1/40 | L-1/0.1 | 6 |
| Example I-14 | Undercoat 1 | I-1/60 | A-6/2 | CA-1/0.2 | UO-1/ 1.7 | AG-1/65 | L-1/0.1 | 6 |
| Example I-15 | Undercoat 1 | I-5/100 | B-15/3 | CA-2/0.2 | UO-2/ 1.3 | AM-1/2 | L-2/0.1 | 14 |
| Example I-16 | Undercoat 1 | I-8/60 | A-6/2 | CA-1/0.2 | UO-1/ 1.7 | ELVAMIDE 8061/5 | L-1/0.1 | 6 |
| Example I-17 | Undercoat 1 | I-8/60 | A-6/2 | CA-1/0.2 | UO-1/ 1.7 | AG-1/25 | L-1/0.1 | 7 |
| Example I-18 | Undercoat 1 | I-8/60 | A-6/2 | CA-1/0.2 | UO-1/ 1.7 | AG-1/20 | L-1/0.1 | 8 |
| Example I-19 | Undercoat 1 | I-8/60 | A-6/2 | CA-1/0.2 | UO-1/ 1.7 | AG-1/10 | L-1/0.1 | 8 |
| Example II-1 | Undercoat 2 | I-16/80 | B-8/2 | CA-2/0.2 | UO-1/ 1.3 | AM-3/2 | L-2/0.1 | 14 |
| Example II-2 | Undercoat 2 | I-5/10 I-21/90 | B-15/3 | CA-2/0.2 | UO-2 1.3 | AM-1/2 | L-2/0.1 | 14 |
| Example II-3 | Undercoat 2 | I-10/80 I-33/10 | B-18/2 | CA-2/0.2 | UO-2/ 1.3 | AM-1/2 | L-2/0.1 | 15 |
| Example III-1 | Undercoat 3 | I-16/80 | B-8/2 | CA-2/0.2 | UO-1/ 1.3 | AM-3/2 | L-2/0.1 | 14 |
| Example III-2 | Undercoat 3 | I-5/10 I-21/90 | B-15/3 | CA-2/0.2 | UO-2/ 1.3 | AM-1/2 | L-2/0.1 | 14 |
| Example III-3 | Undercoat 3 | I-10/80 I-33/10 | B-18/2 | CA-2/0.2 | UO-2/ 1.3 | AM-1/2 | L-2/0.1 | 15 |

*LUBLON L-2 (trade name) manufactured by Daikin Industries.

TABLE 2

| | | Protective Player | | | | | | |
|---|---|---|---|---|---|---|---|---|
| | Undercoat | Charge transport Material/ Content (part by weight) | Formula (A); Formula (B)/ Content (part by weight) | Catalyst/ Content (part by weight) | Additive 1/ Content (part by weight) | Additive 2/ Content (part by weight) | Additive 3/ Content (part by weight) | Layer thickness (μm) |
| Comparative Example 1 | Undercoat 1 | I-16/80 | — | CA-2/0.2 | UO-1/ 1.3 | AM-3/2 | L-2/0.1 | 14 |

TABLE 2-continued

| | | Protective Player | | | | | | |
|---|---|---|---|---|---|---|---|---|
| | Undercoat | Charge transport Material/ Content (part by weight) | Formula (A); Formula (B)/ Content (part by weight) | Catalyst/ Content (part by weight) | Additive 1/ Content (part by weight) | Additive 2/ Content (part by weight) | Additive 3/ Content (part by weight) | Layer thickness (μm) |
| Comparative Example 2 | Undercoat 1 | I-5/10 I-21/90 | — | CA-2/0.2 | UO-2/ 1.3 | AM-1/2 | L-2/0.1 | 14 |
| Comparative Example 3 | Undercoat 1 | I-10/80 I-33/10 | — | CA-2/0.2 | UO-2/ 1.3 | AM-1/2 | L-2/0.1 | 15 |
| Comparative Example 4 | Undercoat 1 | I-15/80 | — | CA-2/0.2 | LUBLON L-2*/3 | AM-3/2 | L-2/0.1 | 14 |
| Comparative Example 5 | Undercoat 2 | I-16/80 | — | CA-2/0.2 | UO-1/ 1.3 | AM-3/2 | L-2/0.1 | 14 |
| Comparative Example 6 | Undercoat 3 | I-16/80 | — | CA-2/0.2 | UO-1/ 1.3 | AM-3/2 | L-2/0.1 | 14 |
| Comparative Example 7 | Undercoat 1 | I-16/80 | TEA/0.5 | CA-2/0.2 | UO-1/ 1.3 | AM-3/2 | L-2/0.1 | 14 |
| Comparative Example 8 | Undercoat 1 | I-16/80 | PP/0.5 | CA-2/0.2 | UO-1/ 1.3 | AM-3/2 | L-2/0.1 | 14 |
| Comparative Example 9 | Undercoat 1 | I-16/80 | BA/0.5 | CA-2/0.2 | UO-1/ 1.3 | AM-3/2 | L-2/0.1 | 14 |
| Comparative Example 10 | Undercoat 1 | I-16/80 | TEA/0.2 | CA-2/0.2 | UO-1/ 1.3 | AM-3/2 | L-2/0.1 | 14 |
| Comparative Example 11 | Undercoat 1 | I-16/80 | PP/0.3 | CA-2/0.2 | UO-1/ 1.3 | AM-3/2 | L-2/0.1 | 14 |
| Comparative Example 12 | Undercoat 1 | I-16/80 | BA/0.3 | CA-2/0.2 | UO-1/ 1.3 | AM-3/2 | L-2/0.1 | 14 |

*LUBLON L-2 (trade name) manufactured by Daikin Industries.

TABLE 3

| | Density Reduction due to Light Exposure ΔD | Density Recovery | Ghost | Fog | Streak | Toner Filming | Image Degradation | Electric Property ΔVR(V) | Wear Amount (μm) |
|---|---|---|---|---|---|---|---|---|---|
| Example I-1 | −0.03 | A | A | A | A | A | A | −6 | 0.6 |
| Example I-2 | −0.02 | A | A | A | A | A | A | −10 | 0.9 |
| Example I-3 | −0.01 | A | A | A | A | A | A | −13 | 0.3 |
| Example I-4 | −0.01 | A | A | A | A | A | A | −10 | 0.4 |
| Example I-5 | −0.01 | A | A | A | A | A | A | −15 | 0.3 |
| Example I-6 | −0.02 | A | A | A | A | A | A | −13 | 0.5 |
| Example I-7 | −0.01 | A | A | A | A | A | B | −10 | 0.4 |
| Example I-8 | −0.02 | A | A | A | A | A | A | −10 | 0.4 |
| Example I-9 | −0.02 | A | A | A | A | A | A | −10 | 0.5 |
| Example I-10 | −0.02 | A | A | A | A | A | A | −4 | 0.6 |
| Example I-11 | −0.02 | A | A | A | A | A | A | −6 | 0.6 |
| Example I-12 | −0.01 | A | A | A | A | A | A | −15 | 1.4 |
| Example I-13 | −0.03 | A | A | A | A | A | A | −23 | 1.1 |
| Example I-14 | −0.01 | A | B | B | A | A | A | −50 | 0.8 |
| Example I-15 | −0.03 | A | B | A | A | B | A | −15 | 1.2 |
| Example I-16 | −0.02 | A | B | B | A | A | A | −45 | 0.6 |
| Example I-17 | −0.03 | A | A | A | A | A | A | −7 | 0.6 |
| Example I-18 | −0.03 | A | A | A | A | A | A | −7 | 0.6 |
| Example I-19 | −0.03 | A | A | A | A | A | A | −5 | 0.6 |
| Example II-1 | −0.01 | A | A | B | A | A | A | −15 | 0.3 |
| Example II-2 | −0.01 | A | A | B | A | A | A | −13 | 0.3 |
| Example II-3 | −0.02 | A | A | B | A | A | A | −14 | 0.5 |
| Example III-1 | −0.01 | A | B | A | A | A | A | −18 | 0.3 |
| Example III-2 | −0.01 | A | B | A | A | A | A | −17 | 0.3 |
| Example III-3 | −0.02 | A | B | A | A | A | A | −18 | 0.5 |
| Comparative Example 1 | −0.08 | B | A | A | A | A | A | −5 | 0.3 |
| Comparative Example 2 | −0.09 | B | A | A | A | A | A | −3 | 0.3 |
| Comparative Example 3 | −0.07 | C | A | A | A | A | A | −5 | 0.5 |
| Comparative Example 4 | −0.07 | B | A | A | A | A | A | −8 | 0.4 |
| Comparative Example 5 | −0.08 | B | A | A | A | A | A | −9 | 0.3 |

TABLE 3-continued

| | Density Reduction due to Light Exposure ΔD | Density Recovery | Ghost | Fog | Streak | Toner Filming | Image Degradation | Electric Property ΔVR(V) | Wear Amount (μm) |
|---|---|---|---|---|---|---|---|---|---|
| Comparative Example 6 | −0.09 | B | A | A | A | A | A | −8 | 0.3 |
| Comparative Example 7 | — | — | — | — | — | — | — | — | — |
| Comparative Example 8 | — | — | — | — | — | — | — | — | — |
| Comparative Example 9 | — | — | — | — | — | — | — | — | — |
| Comparative Example 10 | 0 | A | B | A | B | B | A | −60 | 1.8 |
| Comparative Example 11 | −0.01 | A | B | A | B | B | A | −45 | 1.5 |
| Comparative Example 12 | −0.01 | A | B | A | B | B | A | −50 | 1.6 |

As shown in Table 3, in the examples of the invention the reduction in density due to light exposure is suppressed and the electric property is excellent as compared with the comparative examples, and the wear amount is smaller than that of the comparative examples, and it can be said that the reduction in density due to light exposure is suppressed and the mechanical strength is enhanced. Further, since the reduction in density due to light exposure is suppressed in the examples of the invention s compared with the comparative examples, it can be said that the residual of the hysteresis due to light exposure is suppressed.

Furthermore, the examples are excellent in all the density recovery, ghost, fog, streak, toner filming and image degradation, compared with the comparative examples.

The forgoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive substrate; and a photosensitive layer provided on a surface of the conductive substrate, an outermost layer of the photosensitive layer containing a crosslinked product formed from at least one charge transporting material having at least one substituent selected from the group consisting of —OH, —$OCH_3$, —$NH_2$, —SH, and —COOH, an acidic substance, and at least one compound selected from the group consisting of compounds represented by the following formula (A) and compounds represented by the following formula (B):

(A)

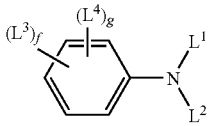

-continued (B)

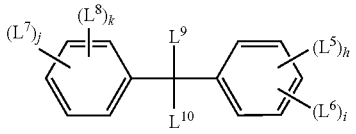

wherein, in formula (A), $L^1$ and $L^2$ each independently represent a substituted or unsubstituted alkyl group having 1 to 5 carbon atoms, or a substituted or unsubstituted aralkyl group having 7 to 15 carbon atoms; $L^3$ and $L^4$ each independently represent a substituted or unsubstituted alkyl group having 1 to 5 carbon atoms, a substituted or unsubstituted alkoxy group having 1 to 5 carbon atoms, or a substituted or unsubstituted aralkyl group having 7 to 20 carbon atoms; and f and g each independently represent 1 or 2; and wherein, in formula (B), $L^5$ to $L^8$ each independently represent hydrogen, a substituted or unsubstituted alkyl group having 1 to 5 carbon atoms, a substituted or unsubstituted alkoxy group having 1 to 5 carbon atoms, a substituted or unsubstituted aralkyl group having 7 to 15 carbon atoms, or a substituted or unsubstituted aryl group having 6 to 15 carbon atoms; at least one of $L^5$ to $L^8$ has a structure represented by the following formula (C); h to k each independently represent 1 or 2; and $L^9$ and $L^{10}$ each independently represent hydrogen, a substituted or unsubstituted alkyl group having 1 to 5 carbon atoms, a substituted or unsubstituted aralkyl group having 7 to 15 carbon atoms, or a substituted or unsubstituted aryl group having 6 to 15 carbon atoms:

(C)

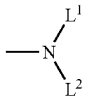

wherein, in formula (C), $L^1$ and $L^2$ each independently represent a substituted or unsubstituted alkyl group having 1 to 5 carbon atoms, or a substituted or unsubstituted aralkyl group having 7 to 15 carbon atoms.

2. The electrophotographic photoreceptor of claim 1, wherein the acidic substance comprises a sulfur element.

3. The electrophotographic photoreceptor of claim 1, wherein the acidic substance comprises a sulfonic acid group.

4. The electrophotographic photoreceptor of claim 1, wherein the crosslinked product contains at least one compound derived from the at least one charge transporting material having at least one substituent selected from the group consisting of —OH, —$OCH_3$, —$NH_2$, —SH, and —COOH in an amount of at least about 50% by weight relative to the crosslinked product.

5. The electrophotographic photoreceptor of claim 1, wherein the crosslinked product contains at least one compound derived from the at least one charge transporting material having at least one substituent selected from the group consisting of —OH, —$OCH_3$, —$NH_2$, —SH, and —COOH in an amount of at least about 70% by weight relative to the crosslinked product.

6. The electrophotographic photoreceptor of claim 1, wherein the crosslinked product contains at least one compound derived from the at least one charge transporting material having at least one substituent selected from the group consisting of —OH, —$OCH_3$, —$NH_2$, —SH, and —COOH in an amount of at least about 80% by weight relative to the crosslinked product.

7. The electrophotographic photoreceptor of claim 1, wherein the content of the acidic substance is from 0.01% by weight to 5% by weight with respect to the solid content of the total components for forming the outermost layer except for the acidic substance.

8. The electrophotographic photoreceptor of claim 1, wherein the acidic substance is at least one selected from the group consisting of p-toluenesulfonic acid, dinonylnaphthalenesulfonic acid (DNNSA), dinonylnaphthalenedisulfonic acid (DNNDSA), dodecylbenzenesulfonic acid, and phenolsulfonic acid.

9. An electrophotographic photoreceptor comprising:

a conductive substrate; and a photosensitive layer provided on a surface of the conductive substrate, an outermost layer of the photosensitive layer containing a crosslinked product formed from at least one charge transporting material, an acidic substance, and at least one compound selected from the group consisting of compounds represented by the following formula (A) and compounds represented by the following formula (B): $F—((—R^1—X)_{n1}R^2Y)_{n2}$ (I), wherein, in the formula (I), F represents an organic group derived from a hole transporting compound, $R^1$ and $R^2$ each independently represent a linear or branched alkylene group having 1 to 5 carbon atoms, $n_1$ represents 0 or 1, $n_2$ represents an integer of 1 to 4, X represent an oxygen atom, NH, or a sulfur atom, and Y represents —OH or —OCH3;

(A)

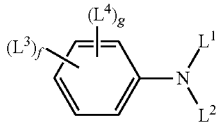

(B)

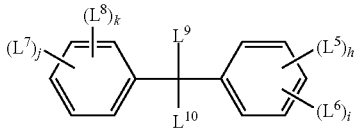

wherein, in formula (A), $L^1$ and $L^2$ each independently represent a substituted or unsubstituted alkyl group having 1 to 5 carbon atoms, or a substituted or unsubstituted aralkyl group having 7 to 15 carbon atoms; $L^3$ and $L^4$ each independently represent a substituted or unsubstituted alkyl group having 1 to 5 carbon atoms, a substituted or unsubstituted alkoxy group having 1 to 5 carbon atoms, or a substituted or unsubstituted aralkyl group having 7 to 20 carbon atoms; and f and g each independently represent 1 or 2;

wherein, in formula (B), $L^5$ to $L^8$ each independently represent hydrogen, a substituted or unsubstituted alkyl group having 1 to 5 carbon atoms, a substituted or unsubstituted alkoxy group having 1 to 5 carbon atoms, a substituted or unsubstituted aralkyl group having 7 to 15 carbon atoms, or a substituted or unsubstituted aryl group having 6 to 15 carbon atoms; at least one of $L^5$ to $L^8$ has a structure represented by the following formula (C); h to k each independently represent 1 or 2; and $L^9$ and $L^{10}$ each independently represent hydrogen, a substituted or unsubstituted alkyl group having 1 to 5 carbon atoms, a substituted or unsubstituted aralkyl group having 7 to 15 carbon atoms, or a substituted or unsubstituted aryl group having 6 to 15 carbon atoms:

(C)

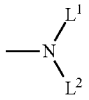

wherein, in formula (C), $L^1$ and $L^2$ each independently represent a substituted or unsubstituted alkyl group having 1 to 5 carbon atoms, or a substituted or unsubstituted aralkyl group having 7 to 15 carbon atoms.

* * * * *

UNITED STATES PATENT AND TRADEMARK OFFICE

CERTIFICATE OF CORRECTION

PATENT NO. : 8,268,521 B2
APPLICATION NO. : 12/466701
DATED : September 18, 2012
INVENTOR(S) : Katsumi Nukada et al.

It is certified that error appears in the above-identified patent and that said Letters Patent is hereby corrected as shown below:

Column 67, Claim 9, line 6: after "charge transporting material" add --including a compound represented by the following formula (I)--.

Column 68, line 51: Add the following claims 10-20:

--10. An image forming apparatus comprising:
the electrophotographic photoreceptor of Claim 1, and
at least one selected from the group consisting of a charging unit that charges the electrophotographic photoreceptor, an electrostatic latent image forming unit that forms an electrostatic latent image on the electrophotographic photoreceptor, a development unit that develops an electrostatic latent image formed on the electrophotographic photoreceptor with a toner, and a toner removal unit that removes residual toner from a surface of the electrophotographic photoreceptor.

11. The image forming apparatus of Claim 10, wherein, in the electrophotographic photoreceptor, the acidic substance comprises a sulfur atom.

12. The image forming apparatus of Claim 10, wherein, in the electrophotographic photoreceptor, the acidic substance comprises a sulfonic acid group.

13. The image forming apparatus of Claim 10, wherein, in the electrophotographic photoreceptor, the crosslinked product contains at least one compound derived from the at least one charge transporting material having at least one substituent selected from the group consisting of -OH, $-OCH_3$, $-NH_2$, -SH, and -COOH in an amount of at least about 50% by weight relative to the crosslinked product.

14. The image forming apparatus of Claim 10, wherein the at least one charge transporting material includes a compound represented by the following formula (I):

$$F\text{-}((\text{-}R^1\text{-}X)_{n1}\ R^2\text{-}Y)_{n2} \qquad (I)$$

wherein, in formula (I), F represents an organic group derived from a hole

Signed and Sealed this
Fifteenth Day of January, 2013

David J. Kappos

David J. Kappos
*Director of the United States Patent and Trademark Office* transporting compound, $R^1$ and $R^2$ each independently represent a linear or branched alkylene group having 1 to 5 carbon atoms, n1 represents 0 or 1, n2 represents an integer of 1 to 4, X represents an oxygen atom, NH, or a sulfur atom, and Y represents -OH or $-OCH_3$.

15. A process cartridge comprising:
the electrophotographic photoreceptor of Claim 1, and
at least one selected from the group consisting of a charging unit that charges the electrophotographic photoreceptor, a development unit that develops an electrostatic latent image formed on the electrophotographic photoreceptor with a toner, and a toner removal unit that removes residual toner from a surface of the electrophotographic photoreceptor.

16. The process cartridge of Claim 15, wherein, in the electrophotographic photoreceptor, the acidic substance comprises a sulfur atom.

17. The process cartridge of Claim 15, wherein, in the electrophotographic photoreceptor, the acidic substance comprises a sulfonic acid group.

18. The process cartridge of Claim 15, wherein, in the electrophotographic photoreceptor, the crosslinked product contains at least one compound derived from the at least one charge transporting material having at least one substituent selected from the group consisting of -OH, $-OCH_3$, $-NH_2$, -SH, and -COOH in an amount of at least about 50% by weight relative to the crosslinked product.

19. The process cartridge of Claim 15, wherein the at least one charge transporting material includes a compound represented by the following formula (I):

$$F\text{-}((\text{-}R^1\text{-}X)_{n1}\ R^2\text{-}Y)_{n2} \qquad (I)$$

wherein, in formula (I), F represents an organic group derived from a hole transporting compound, $R^1$ and $R^2$ each independently represent a linear or branched alkylene group having 1 to 5 carbon atoms, n1 represents 0 or 1, n2 represents an integer of 1 to 4, X represents an oxygen atom, NH, or a sulfur atom, and Y represents -OH or $-OCH_3$.

20. The electrophotographic photoreceptor of Claim 1, wherein in Formula (A) and (B), at least one of $L^1$, $L^2$, $L^3$, $L^4$, $L^5$, $L^6$, $L^7$, $L^8$, $L^9$ or $L^{10}$ is an alkyl group having 1 to 5 carbon atoms which has a hydroxyl group or an alkoxy group as a substituent.--.

UNITED STATES PATENT AND TRADEMARK OFFICE

CERTIFICATE OF CORRECTION

PATENT NO. : 8,268,521 B2
APPLICATION NO. : 12/466701
DATED : September 18, 2012
INVENTOR(S) : Katsumi Nukada et al.

It is certified that error appears in the above-identified patent and that said Letters Patent is hereby corrected as shown below:

Delete the title page and substitute therefore the attached title page showing the corrected number of claims.

Column 67, Claim 9, line 6: after "charge transporting material" add --including a compound represented by the following formula (I)--.

Column 68, line 51: Add the following claims 10-20:

--10. An image forming apparatus comprising:
the electrophotographic photoreceptor of Claim 1, and
at least one selected from the group consisting of a charging unit that charges the electrophotographic photoreceptor, an electrostatic latent image forming unit that forms an electrostatic latent image on the electrophotographic photoreceptor, a development unit that develops an electrostatic latent image formed on the electrophotographic photoreceptor with a toner, and a toner removal unit that removes residual toner from a surface of the electrophotographic photoreceptor.

11. The image forming apparatus of Claim 10, wherein, in the electrophotographic photoreceptor, the acidic substance comprises a sulfur atom.

12. The image forming apparatus of Claim 10, wherein, in the electrophotographic photoreceptor, the acidic substance comprises a sulfonic acid group.

13. The image forming apparatus of Claim 10, wherein, in the electrophotographic photoreceptor, the crosslinked product contains at least one compound derived from the at least one charge transporting material having at least one substituent selected from the group consisting of -OH, $-OCH_3$, $-NH_2$, -SH, and -COOH in an amount of at least about 50% by weight relative to the crosslinked product.

This certificate supersedes the Certificate of Correction issued January 15, 2013.

Signed and Sealed this
Nineteenth Day of February, 2013

Teresa Stanek Rea
*Acting Director of the United States Patent and Trademark Office*

14. The image forming apparatus of Claim 10, wherein the at least one charge transporting material includes a compound represented by the following formula (I):

$$F\text{-}((\text{-}R^1\text{-}X)_{n1}\ R^2\text{-}Y)_{n2} \qquad (I)$$

wherein, in formula (I), F represents an organic group derived from a hole transporting compound, $R^1$ and $R^2$ each independently represent a linear or branched alkylene group having 1 to 5 carbon atoms, n1 represents 0 or 1, n2 represents an integer of 1 to 4, X represents an oxygen atom, NH, or a sulfur atom, and Y represents -OH or $-OCH_3$.

15. A process cartridge comprising:

the electrophotographic photoreceptor of Claim 1, and at least one selected from the group consisting of a charging unit that charges the electrophotographic photoreceptor, a development unit that develops an electrostatic latent image formed on the electrophotographic photoreceptor with a toner, and a toner removal unit that removes residual toner from a surface of the electrophotographic photoreceptor.

16. The process cartridge of Claim 15, wherein, in the electrophotographic photoreceptor, the acidic substance comprises a sulfur atom.

17. The process cartridge of Claim 15, wherein, in the electrophotographic photoreceptor, the acidic substance comprises a sulfonic acid group.

18. The process cartridge of Claim 15, wherein, in the electrophotographic photoreceptor, the crosslinked product contains at least one compound derived from the at least one charge transporting material having at least one substituent selected from the group consisting of -OH, $-OCH_3$, $-NH_2$, -SH, and -COOH in an amount of at least about 50% by weight relative to the crosslinked product.

19. The process cartridge of Claim 15, wherein the at least one charge transporting material includes a compound represented by the following formula (I):

$$F\text{-}((\text{-}R^1\text{-}X)_{n1}\ R^2\text{-}Y)_{n2} \qquad (I)$$

wherein, in formula (I), F represents an organic group derived from a hole transporting compound, $R^1$ and $R^2$ each independently represent a linear or branched alkylene group having 1 to 5 carbon atoms, n1 represents 0 or 1, n2 represents an integer of 1 to 4, X represents an oxygen atom, NH, or a sulfur atom, and Y represents -OH or $-OCH_3$.

20. The electrophotographic photoreceptor of Claim 1, wherein in Formula (A) and (B), at least one of $L^1$, $L^2$, $L^3$, $L^4$, $L^5$, $L^6$, $L^7$, $L^8$, $L^9$ or $L^{10}$ is an alkyl group having 1 to 5 carbon atoms which has a hydroxyl group or an alkoxy group as a substituent.--.

(12) United States Patent
Nukada et al.

(10) Patent No.: US 8,268,521 B2
(45) Date of Patent: Sep. 18, 2012

(54) ELECTROPHOTOGRAPHIC PHOTORECEPTOR, PROCESS CARTRIDGE, AND IMAGE FORMING APPARATUS

(75) Inventors: Katsumi Nukada, Kanagawa (JP); Hirofumi Nakamura, Kanagawa (JP); Mitsuhide Nakamura, Kanagawa (JP); Koji Bando, Kanagawa (JP); Kenny-tuan T Dinh, Webster, NY (US); Giuseppa Baranyi, Mississauga (CA); Nan-Xing Hu, Mississauga (CA); Michael Zak, Webster, NY (US)

(73) Assignees: Fuji Xerox Co., Ltd., Tokyo (JP); Xerox Corporation, Norwalk, CT (US)

( * ) Notice: Subject to any disclaimer, the term of this patent is extended or adjusted under 35 U.S.C. 154(b) by 516 days.

(21) Appl. No.: 12/466,701

(22) Filed: May 15, 2009

(65) Prior Publication Data

US 2010/0151366 A1 Jun. 17, 2010

(30) Foreign Application Priority Data

Dec. 16, 2008 (JP) ..... 2008-319780

(51) Int. Cl.
*G03G 5/00* (2006.01)
*G03G 15/00* (2006.01)

(52) U.S. Cl. ..... 430/66; 430/58.75; 430/58.85; 430/69; 399/11; 399/159

(58) Field of Classification Search ..... 430/66, 430/69, 58.75, 58.85; 399/111, 159
See application file for complete search history.

(56) References Cited

U.S. PATENT DOCUMENTS 5,283,145 A 2/1994 Nukada et al.
(Continued)

FOREIGN PATENT DOCUMENTS

EP 1174771 * 1/2002
(Continued)

OTHER PUBLICATIONS

Shimada et al., A-15 of the Proceedings of Imaging Conference, The Imaging Society of Japan, 2007.

*Primary Examiner* — Thorl Chea
(74) *Attorney, Agent, or Firm* — Oliff & Berridge, PLC

(57) ABSTRACT

According to an aspect of the invention, an electrophotographic photoreceptor including a conductive substrate and a photosensitive layer provided on a surface of the conductive substrate is provided. In the electrophotographic photoreceptor, an outermost layer of the photosensitive layer containing a crosslinked product formed from at least one charge transporting material having at least one substituent selected from the group consisting of —OH, —$OCH_3$, —$NH_2$, —SH, and —COOH, an acidic substance, and at least one compound selected from the group consisting of compounds represented by the following formula (A) and compounds represented by the following formula (B).

(A)

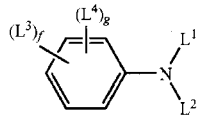

(B)

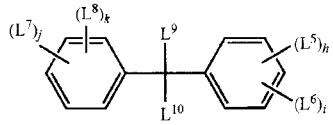

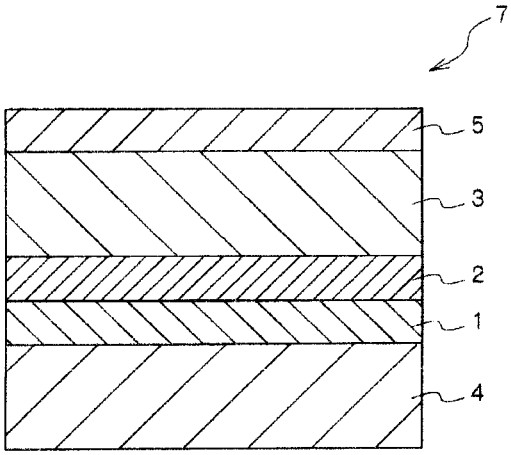

20 Claims, 6 Drawing Sheets